United States Patent [19]

Falk et al.

[11] 4,108,333

[45] Aug. 22, 1978

[54] ARTICLE VENDOR WITH ELEVATOR

[75] Inventors: Leonard P. Falk, Florissant; Robert L. Stadler, Overland; James R. Alford, Florissant, all of Mo.

[73] Assignee: UMC Industries, Inc., New York, N.Y.

[21] Appl. No.: 750,428

[22] Filed: Dec. 14, 1976

Related U.S. Application Data

[63] Continuation-in-part of Ser. No. 577,297, May 14, 1975, abandoned.

[51] Int. Cl.[2] ..... G07F 11/58

[52] U.S. Cl. ..... 221/13; 198/817; 221/85; 221/130; 221/191

[58] Field of Search ..... 221/129, 130, 131, 191, 221/85, 12, 13; 198/193, 195, 198, 199, 200, 817

[56] References Cited

U.S. PATENT DOCUMENTS

| | | | |
|---|---|---|---|
| 2,371,316 | 3/1945 | Rice et al. | 221/13 |
| 2,930,478 | 3/1960 | Ruffino | 198/193 X |
| 3,174,646 | 3/1965 | Johnson | 221/130 X |
| 3,251,447 | 5/1966 | Brown et al. | 221/12 |
| 3,263,857 | 8/1966 | Krakauer et al. | 221/130 X |
| 3,294,282 | 12/1966 | Brown | 221/12 |
| 3,325,049 | 6/1967 | Craven et al. | 221/6 |
| 3,357,133 | 12/1967 | Helsing | 221/12 X |
| 3,722,743 | 3/1973 | Atchley | 198/195 X |
| 3,840,147 | 8/1974 | O'Neal et al. | 221/75 |
| 3,861,562 | 1/1975 | Owen | 221/85 |

FOREIGN PATENT DOCUMENTS

| | | | |
|---|---|---|---|
| 1,000,605 | 8/1965 | United Kingdom | 221/129 |

*Primary Examiner*—Robert B. Reeves
*Assistant Examiner*—Francis J. Bartuska
*Attorney, Agent, or Firm*—Koenig, Senniger, Powers and Leavitt

[57] ABSTRACT

An article vendor, particularly for food products such as sandwiches, salads, lunch platters and dessert items, wherein the articles are stocked on endless belt conveyors extending in rear-to-front direction in a cabinet having a front window for merchandising display of the articles. The conveyors are arranged in tiers one above another and side by side in each tier, and the vendor includes an elevator movable up and down at the front of the conveyors for receiving an article from any one (or more) of the conveyors and transporting it to a delivery station. Upon selection by a purchaser of an article on a particular conveyor, the elevator is raised to the level of the tier which includes the selected conveyor, and that conveyor is indexed forward one step to dispense the forward article therefrom on to the elevator, after which the elevator is lowered to the delivery station.

46 Claims, 43 Drawing Figures

FIG. 23
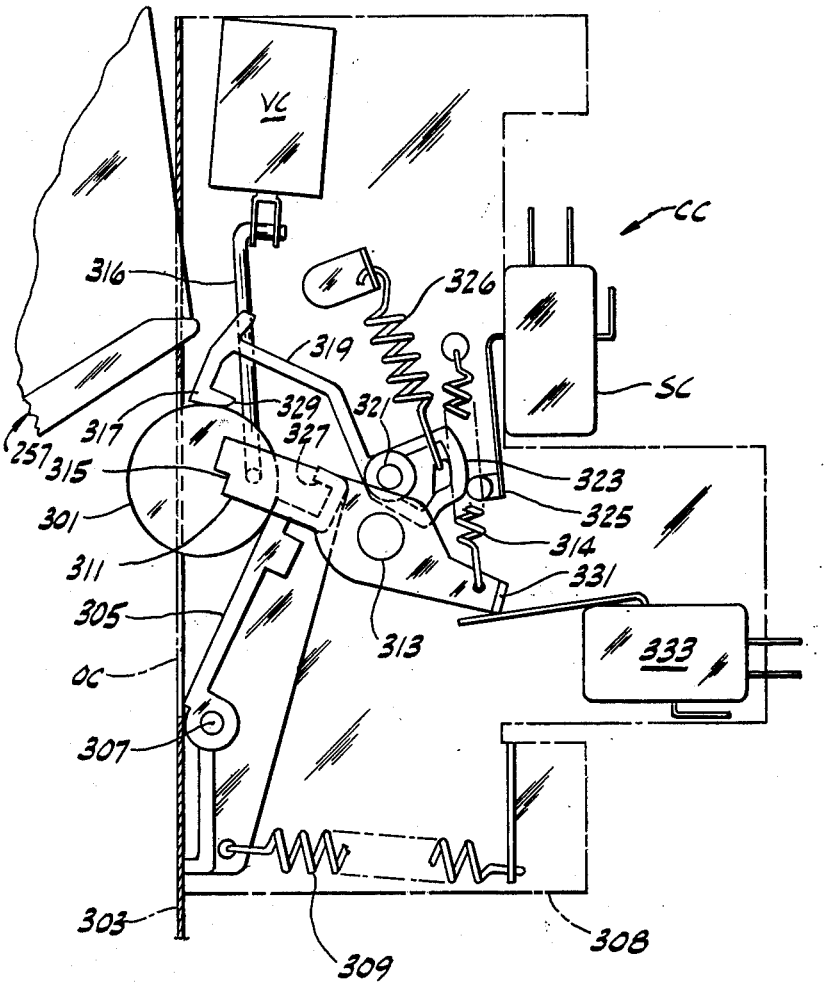
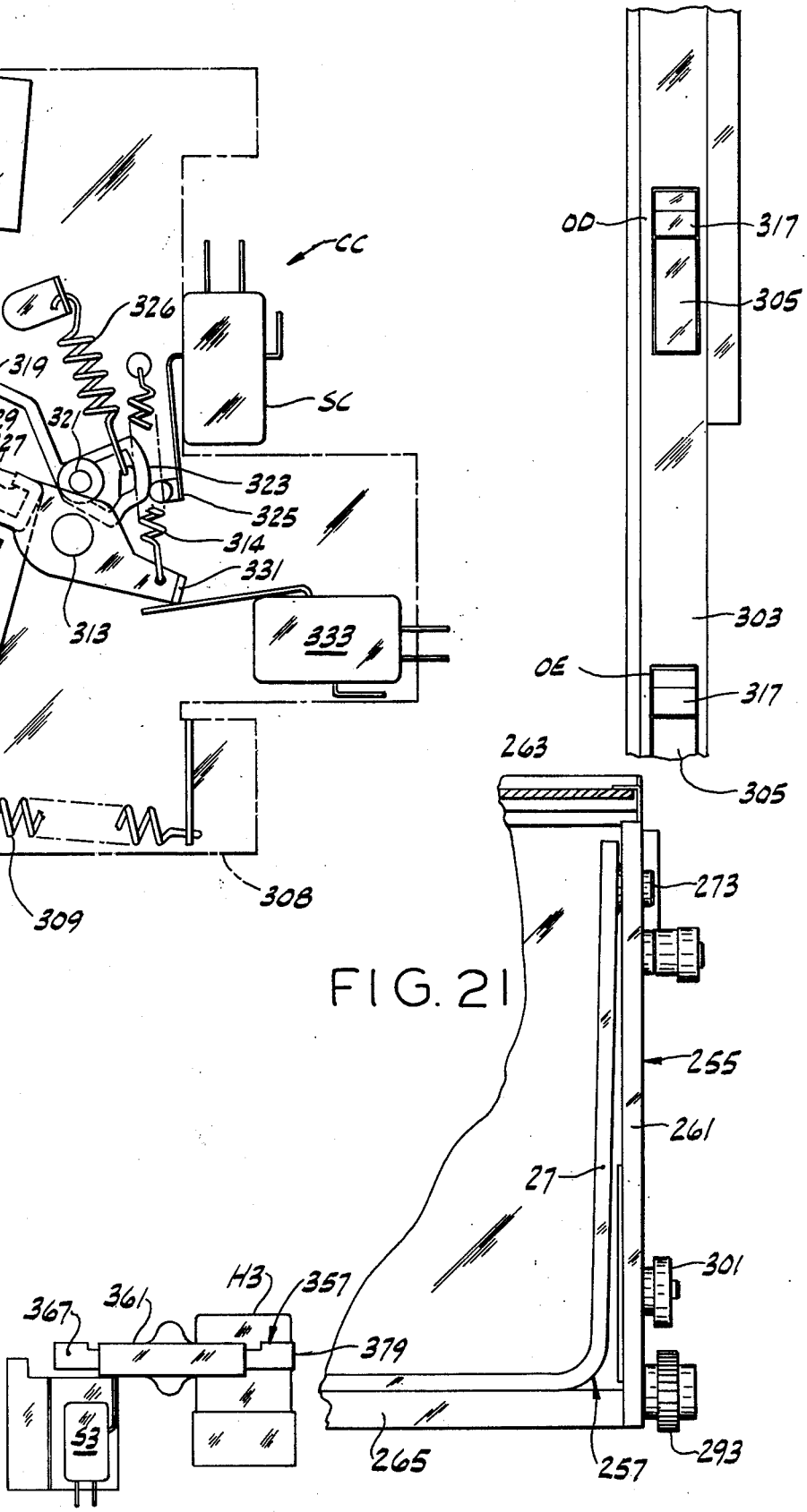
FIG. 21

ARTICLE VENDOR WITH ELEVATOR

CROSS-REFERENCE TO RELATED APPLICATION

This application is a continuation-in-part of our copending U.S. application Ser. No. 577,297, filed May 4, 1975, now abandoned.

BACKGROUND OF THE INVENTION

This invention relates to article vendors, and more particularly to an article vendor with an elevator for the articles.

The invention is especially concerned with a vendor for food products such as sandwiches, salads, lunch platters, milk in cartons, juices in cartons or cans, desserts including pies, etc.

A problem attendant upon provision of a vendor for food products such as above described is that some of them, such as pies, cannot be dispensed simply by having them drop to a delivery station, but need to be delivered relatively gently so as not to break up upon delivery. The problem may be readily envisioned by considering the dispensing of a piece of pie which, even though packaged, may be broken up if dropped even a short distance. Heretofore, the problem has been generally taken care of by stocking the products on horizontal rotary drums (see, for example, U.S. Pat. Nos. 3,102,762, 3,107,815, 3,122,401). or in compartments on a horizontally moving endless conveyor (see U.S. Pat. No. 3,147,838). While the rotary drum type of vendor may provide for first-in first-out vending, as is desirable, it has disadvantages of being limited in the number of selections made available and in the display of what limited selections are made available. While the endless conveyor type referred to may provide for display of a large number of selections, it does not involve first-in first-out vending.

Reference may be made to U.S. Pat. Nos. 2,858,042, 3,193,138, 3,294,282, 3,325,049 and 3,608,777 and British Pat. No. 1,000,605 showing the state of the art on article vendors with elevators, and reference may also be made to U.S. Pat. Nos. 2,637,611 and 3,001,669 as showing state of the art rear-to-front endless conveyor type vendors with a front window which may be relevant.

SUMMARY OF THE INVENTION

Among the several objects of this invention may be noted that provision of an improved article vendor particularly capable of handling food or other items which should not be dropped in being vended, which handles the items gently as they are dispensed without dropping them; the provision of such a vendor which displays its content of items to be vended to customers for effective merchandising, minimizing the time required to view all the items and make a selection; the provision of such a vendor wherein items are vended on a first-in first-out basis; the provision of such a vendor which delivers the item the customer has seen in making his selection; the provision of such a vendor adapted to handle a relatively large number of selections (e.g., up to 25 different selections, as herein illustrated); and the provision of such a vendor which may be readily adapted to handle relatively large items such as lunch platters.

In general, an article vendor of this invention has a delivery opening in the front at a delivery level and a plurality of article dispensers each adapted to hold a row of articles to be vended extending in rear-to-front direction. The dispensers are arranged in tiers one above another with a plurality of dispensers in each tier located in side-by-side relationship in the tier. Each dispenser in each tier is individually operable independently of the other dispensers in the tier. The forward ends of the dispensers are spaced rearward from the front so that there is a passage between the front and the forward ends of the dispensers. Each dispenser comprises means for feeding the respective row of articles forward and discharging the forward article off the forward end of the dispenser. An elevator is movable up and down in the passage. The elevator is adapted to occupy an article delivery position at the delivery level for access to an article on the elevator via the delivery opening and a position at the level of any of the tiers for receiving an article from a dispenser of that tier. The elevator extends throughout the width of the tiers for receiving an article from any dispenser of any tier when at the level of that tier. Selector means is provided for selecting any one of the dispensers for dispensing the forward article therefrom. First means conditioned by the selector means controls the movement of the elevator to effect its movement to the level of the tier which includes the selected dispenser; and second means conditioned by the selector means controls operation of the drive means for the dispensers to start the drive means of the selected dispenser driving the feeding means of the selected dispenser forward to discharge the forward article therefrom on to the elevator when the elevator reaches a position in proximity to the tier which includes the selected dispenser, the elevator then being moved to its article delivery position so that the selected article may be obtained from the elevator via the delivery opening.

Other objects and features will be in part apparent and in part pointed out hereinafter.

BRIEF DESCRIPTION OF THE DRAWINGS

FIG. 21 is a partial front elevation of FIG. 20, with parts broken away;

FIG. 23 is an enlarged fragment of FIG. 20 showing parts in a moved position;

Corresponding reference characters indicate corresponding parts throughout the several view of the drawings.

DESCRIPTION OF THE PREFERRED EMBODIMENT

Figure 1:
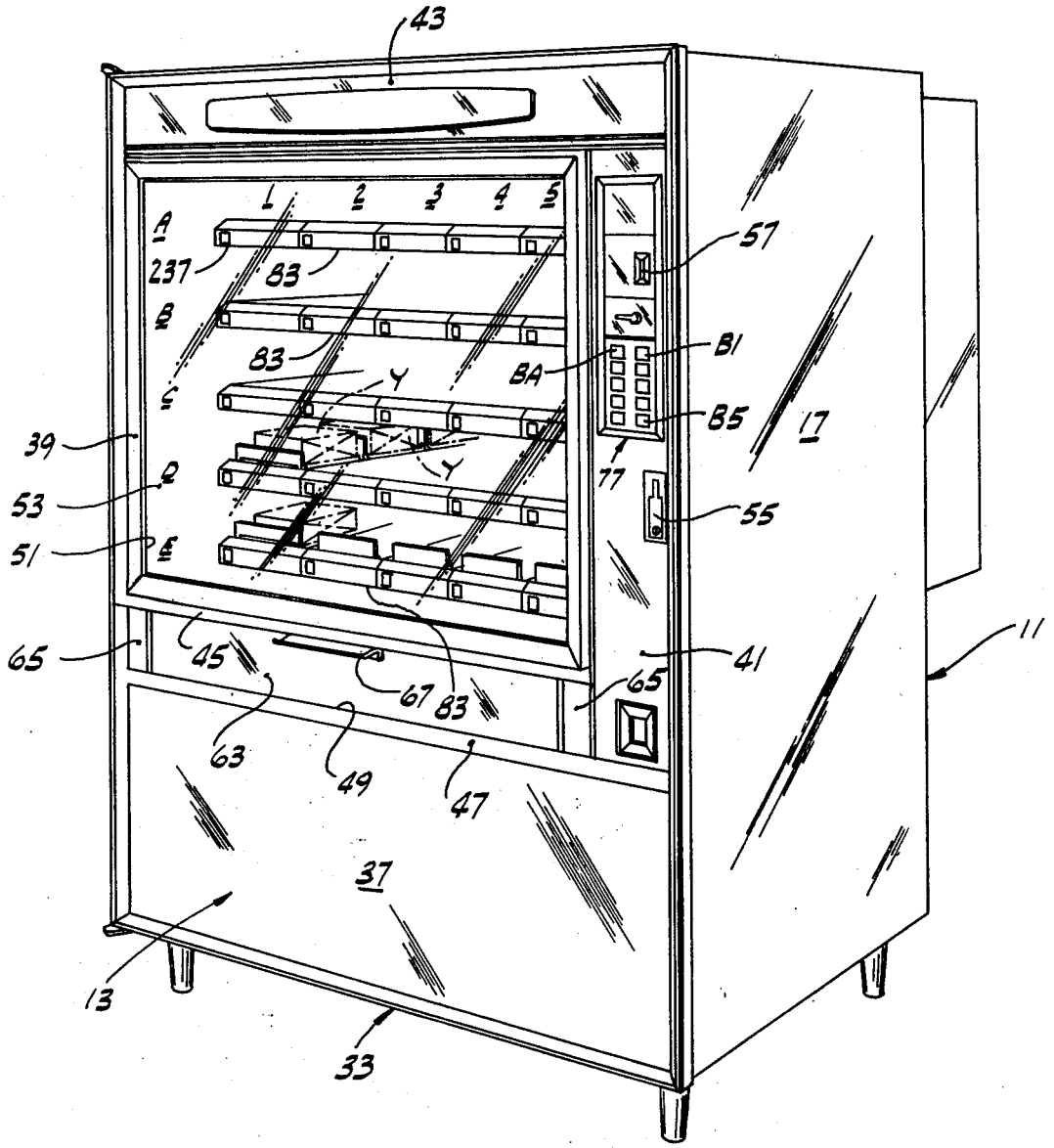
FIG. 1 is a perspective of an article vendor of this invention.

Referring to the drawings, an article vendor of this invention is shown to comprise a cabinet designated in its entirety by the reference numeral 11. The front of the cabinet is designated 13, its left and right sides 15 and 17 and its rear 19, "left" and "right" being as viewed from the front. Interiorly, the cabinet has a horizontal partition 21 (see FIGS. 3 and 4) extending from its left to its right side and a vertical partition 23 parallel to and adjacent its right side dividing the interior of the cabinet into a lower compartment 25 and left and right upper compartments 27 and 29 with 27 considerably wider than 29. Compartment 27 may be refrigerated or heated by means of refrigeration or heating equipment (not shown) housed in compartment 25. Compartment 29 houses the coin-handling unit 31 of the vendor.

The front 13 of the cabinet comprises an outer door 33 pivoted to swing on suitable hinge means at the left of the cabinet, this outer door closing the entire front of the cabinet. The outer door has a lower panel 37 which extends some distance above the level of the horizontal partition 21, left and right panels 29 and 41 and a top panel 43, all these panels being formed of sheet metal. Extending between the left and right panels of the outer door spaced above the top of the lower panel is a trim strip 45. The top of the lower panel has a trim strip 47. The latter, the inner edges of the left and right panels, and the bottom of the trim strip 45 define a rectangular delivery opening 49 in the outer door. The top of the strip 45, the inner edges of the left and right panels and the bottom of the top panel define a window opening 51 which is single-glazed by a pane of glass 53. At 55 in FIG. 1 is indicated the usual lock for door 33. At 57 is indicated the usual coin inlet in the right side door panel 41 for receiving coins of different denominations, the coins dropping through a chute (not shown) to the coin-handling unit 31 in conventional manner. It will be understood that the coin-handling unit includes a totalizer for registering the total value of coins deposited, and means for controlling the vending operation, and may include a change maker.

Figure 4:
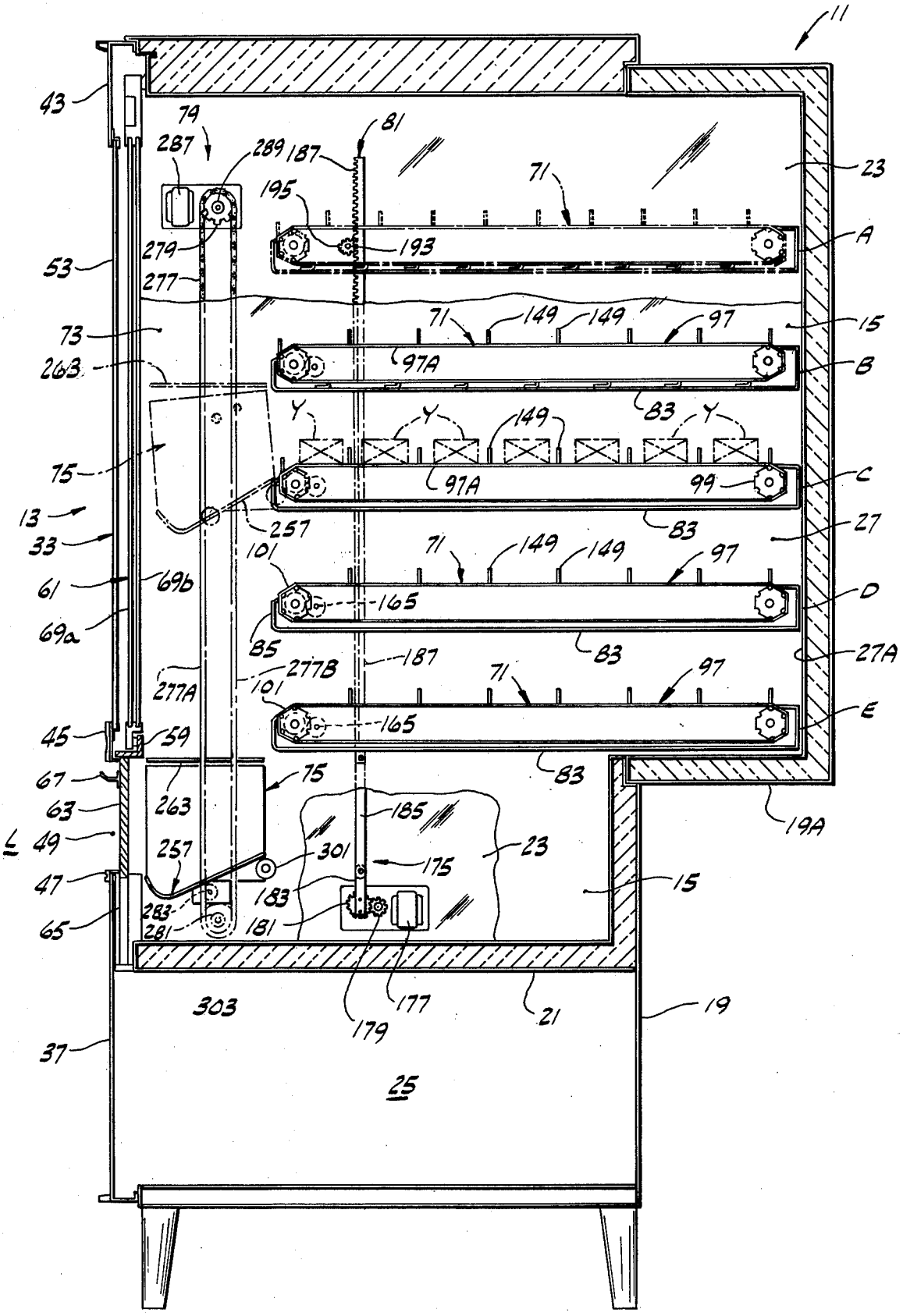
FIG. 4 is a vertical section generally on line 4—4 of FIG. 3, and with parts further broken away, showing the inner and outer doors both closed.
Figure 5:
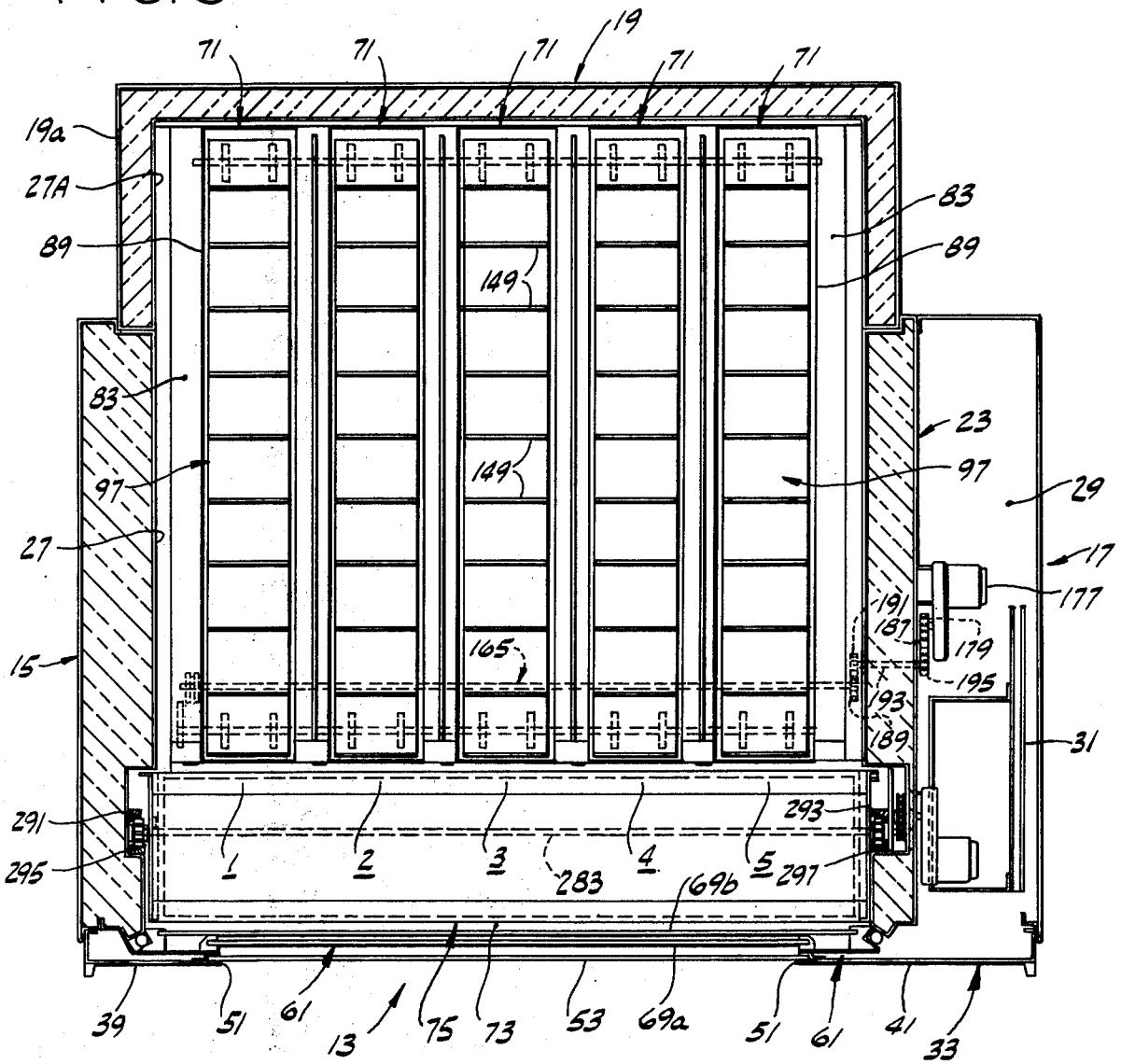
FIG. 5 is a horizontal section on line 5—5 of FIG. 3.
Figure 6:
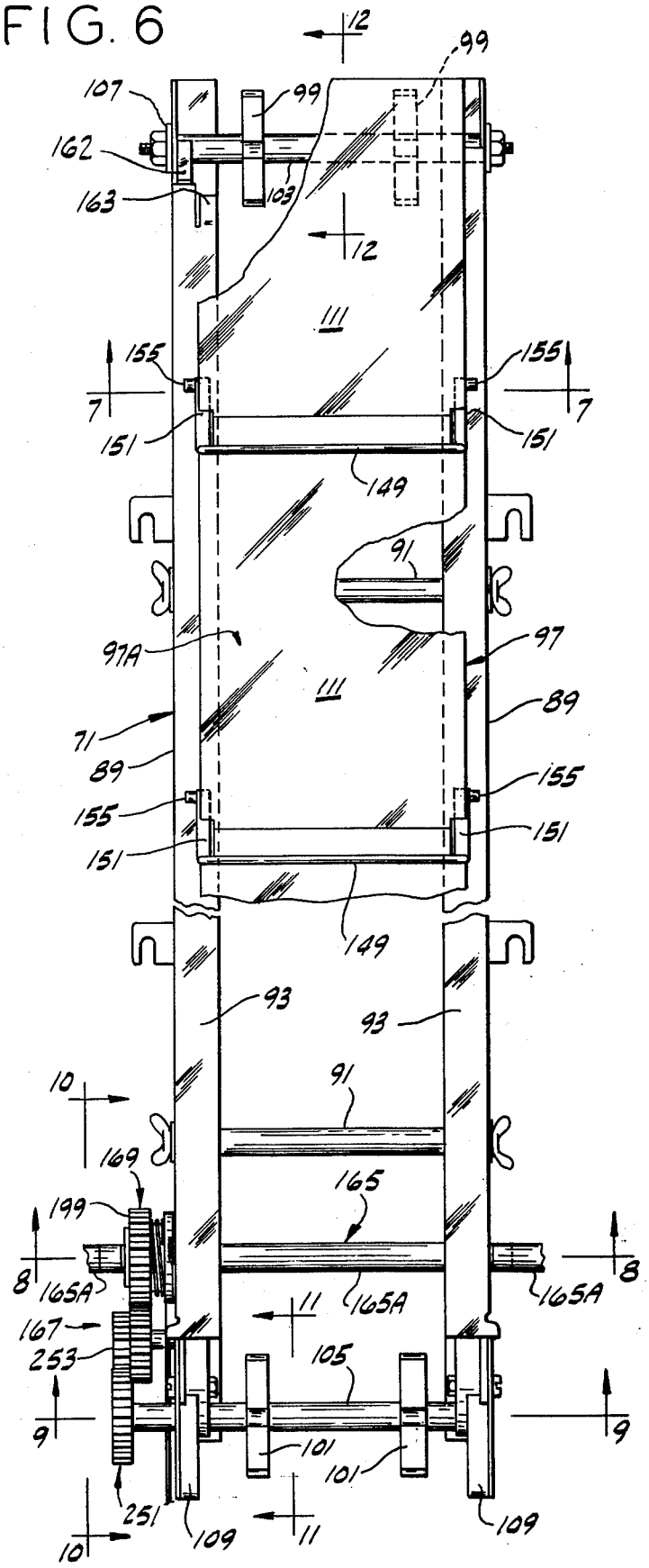
FIG. 6 is an enlarged plan of one of the dispensers of the vendor, with parts broken away to reduce the length of the view and to reveal detail.
Figure 7:
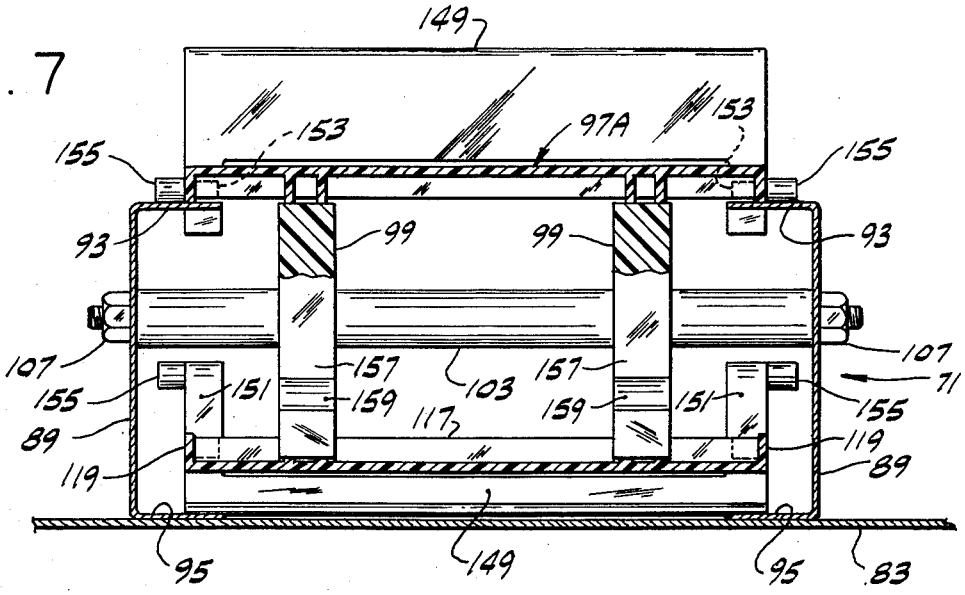
FIGS. 7, 8 and 9 are transverse sections of the dispenser on lines 7—7, 8—8 and 9—9 of FIG. 6.
Figure 8:
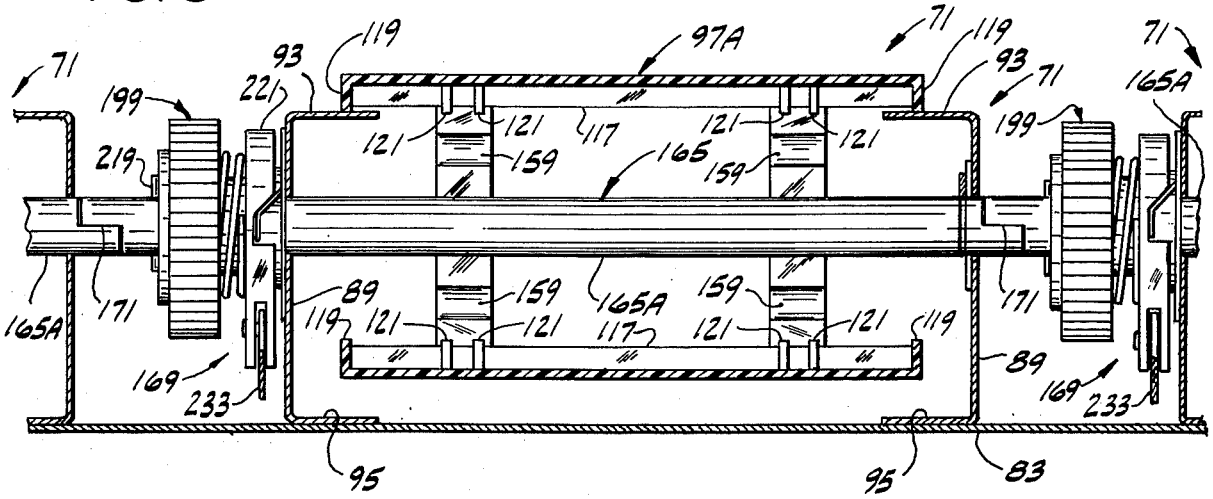
Figure 9:
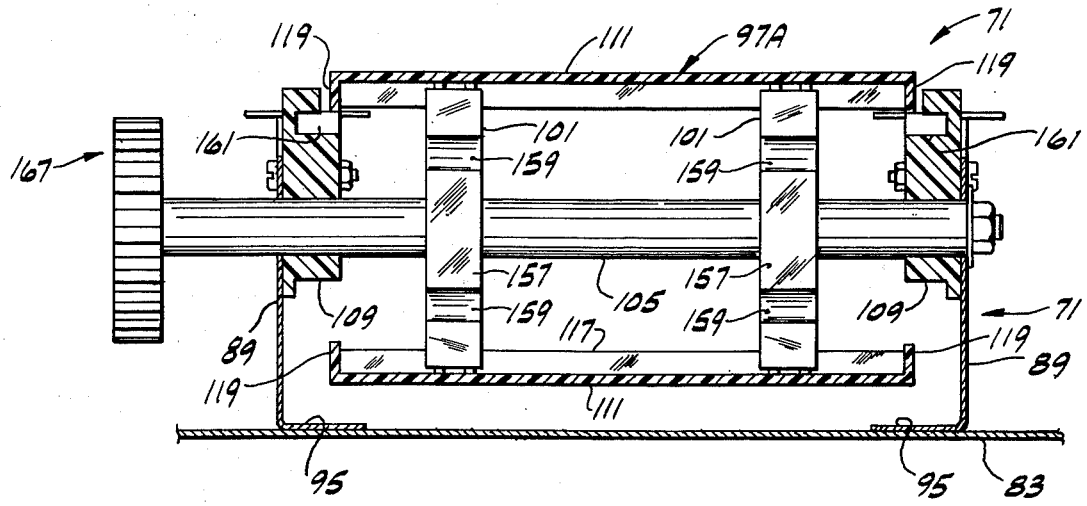

Extending between the left side of the cabinet and the partition 23 at the front of compartment 27 and at the same level as the strip 45 of the outer door 33 is a crossbar 59 constituted by a member of angle shape in section arranged with one leg horizontal and extending forward and its other leg extending up at the rear of the horizontal leg. This constitutes a sill for an inner front door 61 and an upper stop for a delivery door 63 for closing the delivery opening 49 in the outer door 33. The delivery door 63 is mounted for vertical sliding movement in guides such as indicated at 65, being slidable downwardly from the raised closed position in which it is shown in FIG. 4 to an open position opening up the delivery opening 49 in the outer door 33. The delivery door has a handle 67. Means such as shown in the coassigned copending U.S. patent application of James T. Schuller et al., Ser. No. 404,327, filed Oct. 9, 1973 now U.S. Pat. No. 3,901,366, may be provided for automatically completing the opening of the delivery door 63 on a downward push of the handle 67, holding the door 63 open for a suitable delivery interval, and then closing it. The inner door 61 has a double-glazed window coextensive with the window 53, the two panes of glass of this window being indicated at **69*a* and 69*b*. Thus, the front 13 of the cabinet, which comprises the inner door 61 and the outer door 33, is windowed at 53 and 69*a*, *b* for viewing the interior of compartment 27**.

Within the compartment 27 of the cabinet 1 are article dispensers each generally denoted by the reference numeral 71, each adapted to hold a row of articles Y to be vended extending in rear-to-front direction. As herein illustrated, there are 25 such dispensers 71 in the cabinet, all located above the level of the delivery opening 49, this level being referred to as the delivery level and indicated at L in FIG. 4. The forward ends of the dispensers 71 (their ends toward the left in FIG. 4) are spaced rearward from the window **69*a*, *b* of the inner door 61 of the cabinet so that there is a passage 73 between this window and the forward ends of the dispensers. Each dispenser comprises means (to be more particularly described hereinafter) for feeding the articles Y forward and discharging the forward article Y off the forward end of the dispenser. The dispensers are arranged in tiers or horizontal groups one above another and in vertical groups or columns with the dispensers in each tier located in side-by-side relationship and the dispensers in each vertical group or column located one directly above another in a vertical rear-to-front plane of the cabinet. As shown in FIGS. 1 and 3–5, the 25 dispensers are arranged in five such tiers designated A – E from the highest to the lowest, and in five such vertical groups or columns designated 1 – 5 from left to right. The dispensers, thus arranged in a five-by-five matrix, may be referred to by letter and numeral designations; i.e., the dispensers in tier A may be referred to as dispensers A/1 – A/5, the dispensers in tier B may be referred to as dispensers B/1 – B/5, etc. The windows 53, 69***a* and 69*b* cover the full height of the five tiers A – E and the full width of the five columns 1 – 5 of dispensers so that purchasers may readily view at least the forward articles Y on all 25 dispensers.

An elevator 75 is movable vertically in the passage 73. This elevator extends the full width of each of tiers A – E and thus horizontally spans all five columns 1 – 5. It is movable up and down in the passage 73, being adapted to occupy the lowered article delivery position at the delivery level L (in which it is shown in solid lines in FIG. 4) for access by a purchaser to an article on the elevator via delivery opening 49 after opening the delivery door 63, and a position at the level of any one of said tiers A – E for receiving an article Y from a dispenser 71 of that tier. Thus, FIG. 4 shows the elevator in phantom at the level of tier C (the middle tier).

Figure 2:
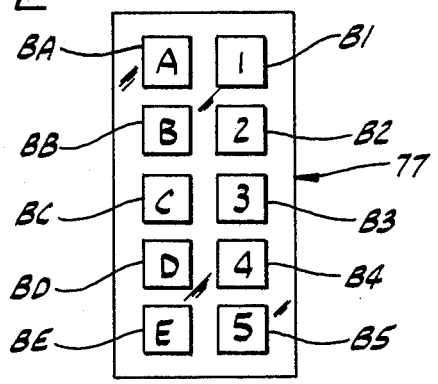
FIG. 2 is an enlarged fragment of FIG. 1 in elevation.

At 77 (see FIGS. 1 and 2) is generally indicated selector means operable by a purchaser for effecting dispensing of the forward article Y on any one of the 25 dispensers 71 by being set according to the tier A – E and vertical group or column 1 – 5 of the selected dispenser. As shown, this selector means comprises an alphanumeric set of push buttons comprising five buttons BA – BE and five buttons B1 – B5. As will appear, selection of one of the 25 dispensers 71 is made by pressing the appropriate alphabetic button and the appropriate numeric button. For example, selection of the third dispenser in tier C (dispenser C/3) is made by pressing buttons BC and B3. Means indicated generally at 79 in FIG. 4 is provided for effecting raising of the elevator to the level of the tier A – E which includes the selected dispenser, and means indicated generally at 81 is provided for effecting operation of the selected dispenser to discharge the forward article Y therefrom on to the elevator when raised to said level, the elevator then being lowered to its article delivery position (in which it is shown in solid lines in FIG. 4) so that the purchaser may obtain the selected article from the elevator via the delivery opening 49. The upper section 19A of the back 19 of the cabinet projects rearward from the cabinet, and is removable for passage of the cabinet through relatively narrow openings. This section 19A extends from just below the lower tier E to the top of the cabinet, and from the left side of the cabinet to the partition 23. The recess in section 19A is designated 27A; it opens forward and receives the rear ends of the dispensers 71.

Each tier A – E comprises a horizontal shelf 83 mounted at its left and right sides on the left side of the cabinet and the partition 23. The shelves are spaced one above another a suitable distance to accommodate items Y between the shelves (and between the uppermost shelf and the top of the cabinet) and are preferably slidable into and out of the cabinet to facilitate loading of items Y on the dispensers. Each shelf has an upwardly extending front flange 85. Each of the dispensers 71 comprises a belt conveyor unit, there being five of these belt conveyor units mounted side-by-side on each shelf 83. Each dispenser or conveyor unit 71 comprises a frame constituted by a pair of channel-section side rails each designated 89 (see FIGS. 6–9) held in parallel spaced-apart relation by suitable spacers 91 extending transversely between the rails. The upper and lower flanges of these rails are designated 93 and 95. Each conveyor unit 71 is mounted on its respective shelf 83 extending from rear-to-front of the shelf, with the five units 71 on each shelf spaced at equal intervals transversely of the shelf. Each conveyor unit further comprises an endless belt conveyor 97 trained around rearward and forward sprockets 99 and 101 on rearward and forward horizontal shafts 103 and 105 at the rear and front ends of the unit. The rearward sprockets 99 idle on the shaft 103, which extends transversely between the rails 89, being secured as indicated at 107. The forward shaft 105 is a power shaft, as will appear, extending transversely between the rails 89 journalled in members 109 secured on the inside of the webs of the rails at the forward ends of the rails.

Figure 14B:
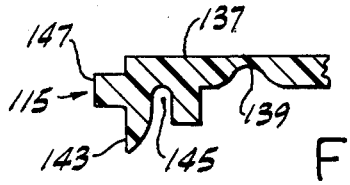
Figure 14C:
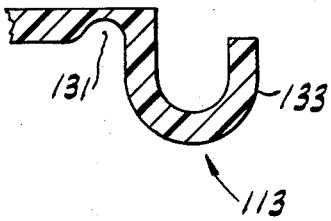
Figure 14D:
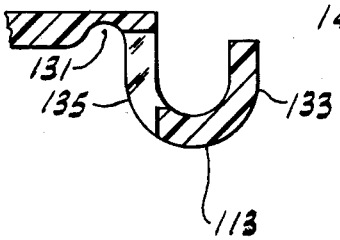
Figure 15:
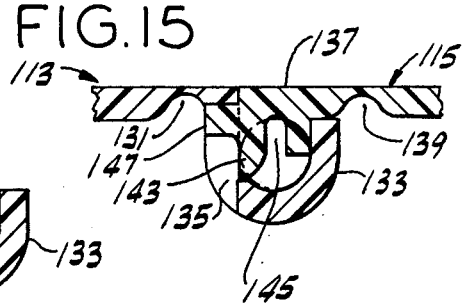
FIG. 15 is an enlarged section showing the interconnection between two of the FIG. 13 links.

The endless belt conveyor 97 is of a special construction of this invention, comprising individual plastic links 111 connected together end-to-end forming an endless relatively flexible belt. Each link, which may be molded of polypropylene or a polyallomer or other such suitable material, comprises a rectangular plate with complementary connecting members 113 and 115 at the ends of the plate somewhat narrower than the plate. One face of the plate, which constitutes its outside face, is flat. On its other (inside) face, the plate has a plurality of integral ribs 117 extending transversely from one side thereof to the other, spaced at equal intervals along the length of the plate. At each end of each of these ribs on the inside face of the plate is an integral tooth formation 119 having an arcuate (semicircular) outer edge. Between each side of the plate and its longitudinal center line and intersecting each rib is a pair of similar integral tooth formations 121. In the inside face of the plate on opposite sides of each rib is a groove 123 extending transversely from one side of the plate to the other. These grooves form integral transverse hinges 125 for the plate at the grooves, subdividing it into separate alternating panels 127 and 129 between the hinges with panels 127 being relatively narrow and panels 129 being relatively wide. The plate, being molded of polypropylene or the like as above noted, is capable of readily flexing at the hinges 125 formed by the grooves. The end hinge member 113 comprises a tongue integral with the plate having a hinge groove 131 in its inside face, and a hook 133 on the tongue, with openings 135 in the hook. The complementary end hinge member 115 comprises a tongue 137 with a hinge groove 139 extending from one side of the tongue to the other in its inside face, a rib 141 outward of the groove extending from adjacent one side of the tongue to adjacent the other, and lugs 143 spaced at intervals across the width of the tongue outward of the rib. These lugs are recessed as indicated at 145 in FIG. 14B and have right-angle projections 147. The rib 141 and lugs 143 are adapted for a snap fit in the hook 133, with the projections 147 fitting in the openings 135, as shown in FIG. 15.

Successive links or plates 111 of the endless belt are pivotally connected together end-to-end by snap fitting the rib 141 and the lugs 143 on the tongue 137 at one end of one plate 111 into the complementary hook 133 on the tongue 113 at the complementary end of the next plate 111, with projections 147 of the one plate received in the openings 135 in the hook 133 of the next plate. A divider or flap 149 is pivoted at the hinge joint between each two successive plates. Each of these flaps has arms 151 at its ends in a plane at right angles to the plane of the flap, with a pair of pivot pins 153 extending inwardly from these arms adjacent the flap and a pair of cam follower pins 155 extending outwardly from these arms at their outer ends. Pins 153 are pivotally received in the ends of the hook 133 and held therein by the tongue 137.

Figure 11:
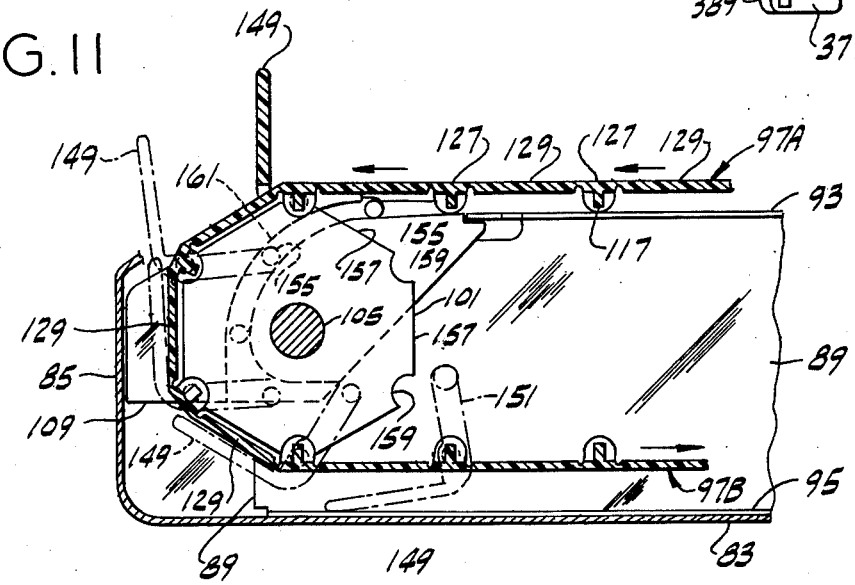
FIGS. 11 and 12 are longitudinal sections on lines 11—11 and 12—12 of FIG. 6, illustrating moved positions of a flap in phantom.
Figure 12:
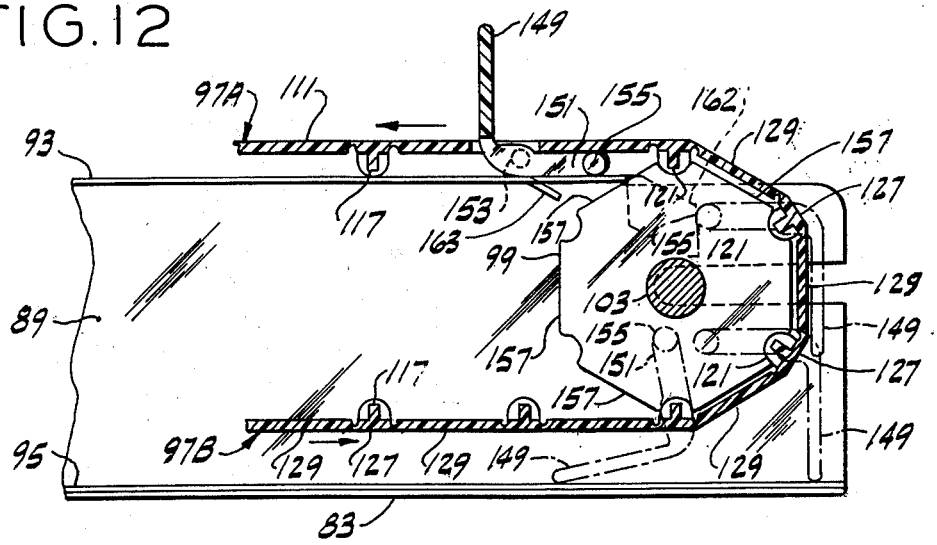

The sprockets 99 and 101, instead of being circular, are of hexagonal shape thereby having six sides each designated 157, with arcuate notches 159 at the intersections of the sides for receiving the teeth 121. Each of the six sides has a length corresponding to the width of a panel 129 of the plate 111 (by the "width" of panel is meant its dimension lengthwise of the belt). Thus, in regard to the wrap of the belt around each sprocket, there are three panels 129 opposite three sides 157 of the sprocket and four sets of the teeth 121 engaged in four of the notches 159 (see FIGS. 11 and 12). As to each conveyor unit 71, the belt 97 has an upper reach 97A adapted to travel forward from the rear sprockets 99 to the forward sprockets 101 with follower pins 155 bearing on the upper flanges 93 of the side rails 89 to support the upper reach, and also to hold the flaps 149 of these dividers along the upper reach in position extending upwardly from the upper reach of the belt. Members 109 at the forward ends of the side rails each have a cam track 161 for the respective follower pin 155 to cam the flaps 149 to a position folded toward the belt for the return to the rear sprockets. The lower return reach 97B of the belt is in a plane slightly above the lower flanges 95 of the side rails 89 and the flaps 149 in the lower return reach bear on the flanges 95 to keep the flaps nearly horizontal along the lower reach (see FIGS. 11 and 12). As the flaps come up and around the rear sprockets 99, pins 155 are tripped by rear cams 162 (FIG. 6) at the rear ends of the upper flanges 93 of the side rails 89 and assume their vertical upstanding position. Teeth 119 ride up ramps 163 (see FIGS. 6 and 12). The upstanding flaps 149 along the upper reach 97A serve to subdivide the upper reach into a series of compartments, each adapted to hold an item Y, dictating to the serviceman the positions on the belt for placement of the items at the proper position and the proper spacing longitudinally of the upper reach for dispensing.

Each of the five tiers A – E is provided with means for selectively driving the belt 97 of any one of the five dispensers 71 of that tier for dispensing the forwardmost item Y on the respective belt 97 and advancing the remaining items on the belt one step forward. As to each of the tiers A – E, this means comprises a drive shaft 165 common to all five of the dispensers 71 of the tier, with a drive train 167 including a clutch 169 for each of the five belts 97 from the drive shaft 165 to the forward sprocket shaft 105 (the power shaft) for the belt. Thus, as to each tier, there are five such clutches 169. While the drive shaft 165 could be a single shaft, it is convenient to provide five individual shaft sections such as indicated at 165A, one in each of the conveyor units 71, with these shaft sections coupled together end-to-end by having interengaging flats 171 at their meeting ends. Each shaft section 165A is journalled in suitable bearings in the side rails 89 of the respective unit 71.

Means indicated generally at 175 in FIG. 4 is provided for driving each of the five drive shafts 165 (each of which is made up of sections 165A) through a cycle for driving a selected one of the 25 conveyor belts 97 through a dispensing stroke in which the upper reach of the belt 97A is indexed one step forward through an interval corresponding to the spacing of the flaps or dividers 149. This means comprises an electric motor 177, more particularly a gearmotor, mounted on partition 23 in compartment 29, having an output shaft 179 geared as indicated at 181 to a crank 183 connected by a link 185 to a vertically reciprocable rack 187 suitably guided for vertical sliding movement on the outside of partition 23 in compartment 29. Motor 177 may be referred to as the vend motor. Each of the five shafts 165 has a gear 189 (see FIGS. 3 and 5) on its right end in compartment 27 meshing with a gear 191 on a shaft 193 extending through partition 23 into compartment 29. Shaft 193 carries a pinion 195 in mesh with the rack. The vend motor 177 is operable through a cycle, as will appear, in which the crank 183 is rotated through a single revolution from the home position in which it is illustrated in FIG. 4 to pull the rack 187 down through a downstroke for rotating each of the five drive shafts 165 for the five tiers A – E through a predetermined operating cycle to index a selected belt forward, and then to drive the rack up through a return stroke. Shafts 165 rotate in return direction during this return stroke of the rack without reverse-driving any of the belts as will appear.

Figure 16:
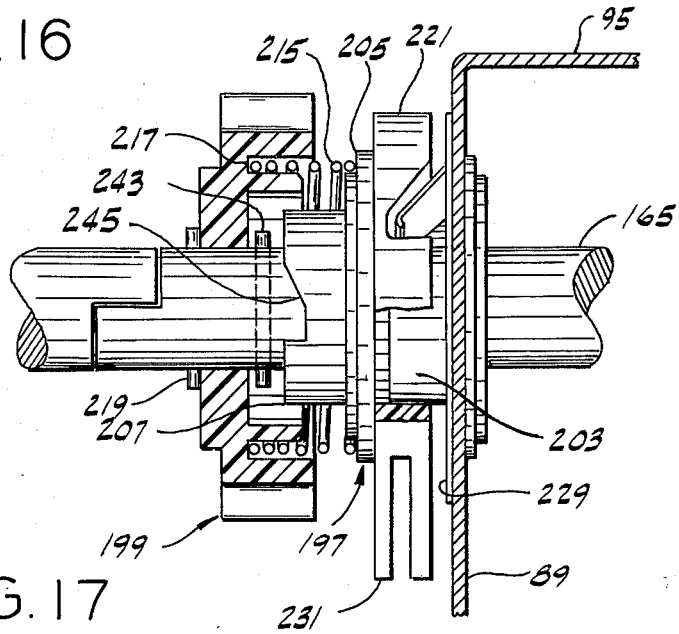
FIG. 16 is an enlarged fragment of FIG. 8, with parts shown in section, showing details of a clutch and brake unit of a dispenser.
Figure 17:
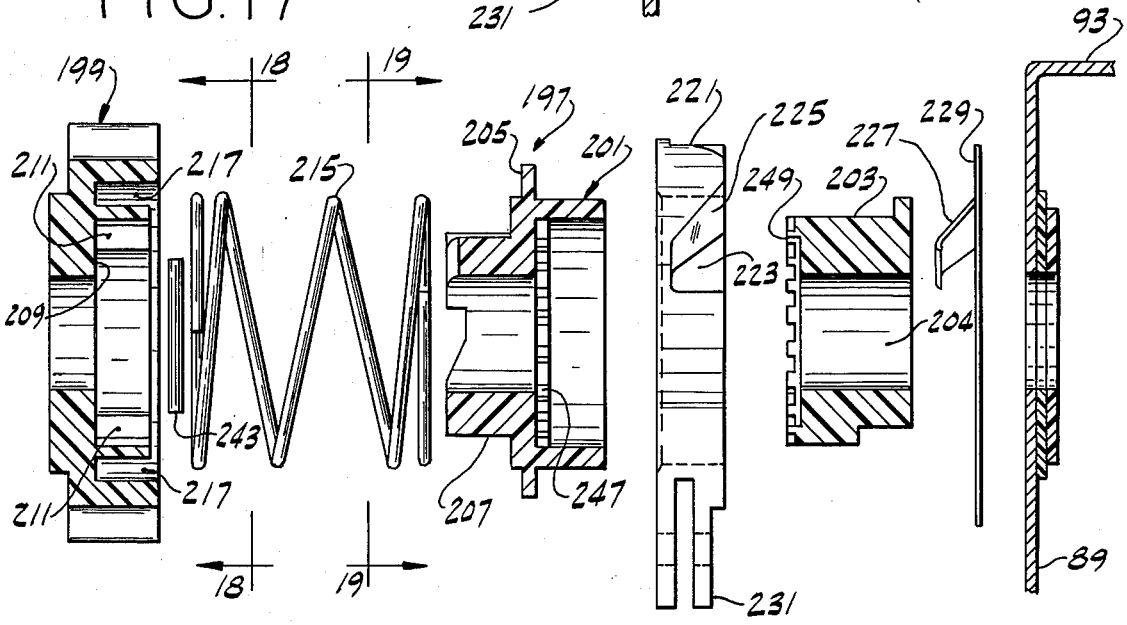
FIG. 17 is an exploded view of the clutch and brake unit shown in FIG. 16.
Figure 18:
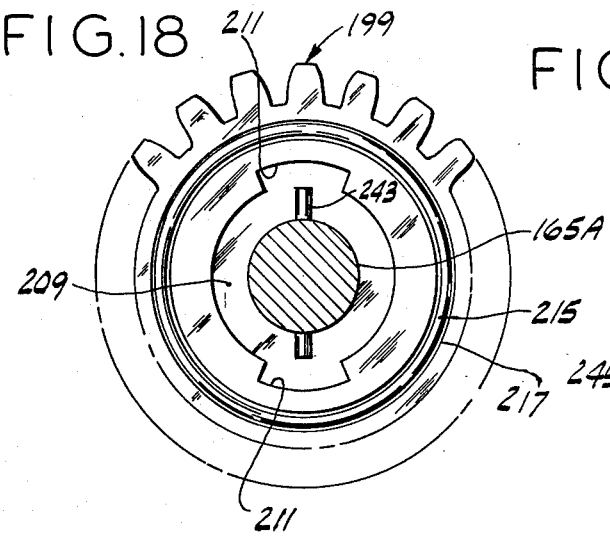
FIGS. 18 and 19 are views in elevation on lines 18—18 and 19—19 of FIG. 17.
Figure 19:
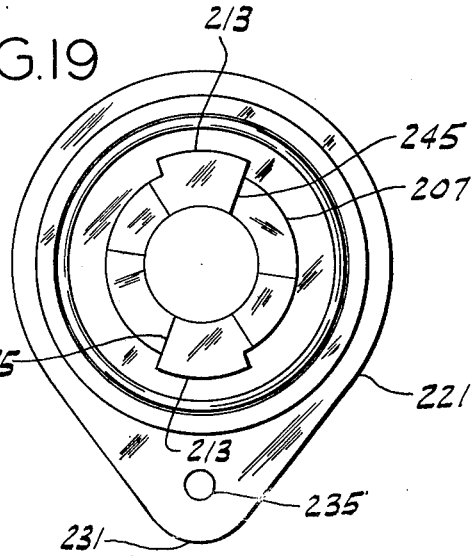

Each of the 25 clutches 169 (see FIGS. 16–19) comprises a driving member 197 and a driven member 199 on the respective shaft section 165A on the outside of the left side rail 89. The driving member 197 has an inner hub 201 rotatable and axially shiftable on a bearing 203 secured to and extending out from the left side wall 89. This bearing has an opening 204 for the shaft section 165A. Member 197 has a flange 205 at the outer end of the inner hub 201, and an outer hub 207 rotatable and axially shiftable directly on the shaft section 165A. The driven member 199 is constituted by a gear rotatable on the shaft section 165A outwardly of the driving member 197, the gear having a recess 209 on the inside thereof adapted slidably to receive the outer hub 207 of the driving member. The driven member or gear 199 further has notches or keyways 211 (see FIG. 18) extending radially outwardly from the recess 209 adapted slidably to receive splines or keys 213 (see FIG. 19) on the outer hub 207 of the driving member 197 when the latter is shifted axially outwardly from the retracted position of clutch disengagement in which it is shown in FIG. 16 to an operative position of clutch engagement. A coil compression spring 215 seated in an annular groove 217 in the inside face of the driven member 199 reacts from the driven member against the flange 205 of the driving member 197 to bias the driving member 197 inwardly away from the driven member 199 to its retracted position of clutch disengagement. The driven member 199 is backed on the shaft section 165A adjacent its left end as indicated at 219. A shifter 221 for the driving member 197 is rotatable on the inner hub 201 of the driving member in engagement with the flange 205. This shifter 221 has radial recesses such as indicated at 223 one side of each of which is formed as an inclined cam surface 225 which is in engagement with an inclined cam finger 227 of a cam member 229 secured on the outside of the left side rail 89 by the bearing 203. There may be three of these recesses and cam fingers. The shifter 221 has a crank arm 231. A rod 233 pinned at 235 to the crank arm extends forward on the outside of the left side rail 89 through a guide 236, being loosely slidable in this guide. The rod has a push button 237 at its forward end accessible from the front of the shelf 83 via an opening 239 in the front flange 85 of the shelf. A spring 241 biases the rod forward and thus tends to rotate the shifter 221 to the retracted position of clutch disengagement in which it is shown in FIG. 16. A pin 243 is secured in a diametrical hole in the shaft section 165A between the driven member 199 and the driving member 197, both ends of this pin projecting from the shaft section. The outer end of the outer hub 207 of the driving member 197 is formed as a crown ratchet with two teeth 245. When the driving member 197 is in its retracted position away from driven member 199, this ratchet end of the driving member is located clear of pin 243 (to the right of this pin). When the rod 233 is pushed in, shifter 221 is rotated on the inner hub 201 of the driving member 197 to cause it to be cammed axially outward away from the left side rail 89 by the camming action of inclined surfaces 225 on the inclined cam fingers 227. The shifter 221, being in engagement with the flange 205 of the driving member 197, shifts it axially outward on the bearing 203 and on the shaft section 165A, to bring the ratchet end of the outer hub 207 of the driving member 197 into position for engagement of pin 243 with the ratchet teeth 245 of the driving member. The driving member 197 is thereby coupled to the shaft section 165A to rotate therewith, and the keys 213 of the driving member are engaged in the keyways 211 of the driven member or gear 199 so that the latter rotates with the driving member. When the rod 233 is released, spring 241 biases it forward to rotate the shifter 221 in reverse direction, whereupon spring 215 is effective to push the driving member 197 and shifter 221 axially inwardly (to the right) back to their retracted position. The driving member 197 is thereby released from the driving pin 243, and locked by the interengagement of crown ratchet teeth 247 at the inner end of the bore of hub 201 with crown ratchet teeth 249 at the outer end of bearing 203. The driven member or gear 199 drives the forward sprocket shaft via a gear train 251 including a change gear 253.

The elevator 75 comprises a frame or carriage 255 in which is pivotally mounted a delivery tray or pan 257. The carriage extends from one side of the passage 73 to the other, comprising left and right side or end plates 259 and 261, an anti-pilfer top panel 263 and a bottom bar 265 extending between the side plates. The tray 257 extends from one end of the carriage to the other, having a bottom section 267 which is inclined downwardly from rear to front, and an upwardly extending front flange 269 generally at right angles to the bottom section. The tray has side or end plates 271 pivoted as indicated at 273 on the inside of the end plates 259 and 261 of the carriage 255 for swinging movement of the tray about a horizontal axis extending transversely of the cabinet 11 above the tray. The elevator 75 is movable vertically upwardly from its lowered article delivery position at the delivery level L (in which it is shown in solid lines in FIG. 4) and downwardly back to its lowered position by the means 79 which includes an endless chain 277 trained around an upper sprocket 279 and a lower sprocket 281 at the right side of the passage 73. These sprockets are so located that the chain has a vertical front reach 277A and a vertical rear reach 277B. A shaft 283 extends horizontally between the end plates 259 and 261 of the elevator carriage 255 underneath the delivery tray 257. This shaft is journalled adjacent its right end in the right end plate 261 and projects to the right from plate 261 through a special link 285 in the front reach 277A of the chain 277, being rotatable in this link. The front reach of the chain is thereby coupled to the elevator so that, on upward movement of the front reach, the elevator is raised and, on downward movement of the front reach, the elevator is lowered. An electric motor 287 (a gearmotor) for driving the chain is mounted on the cabinet at the right side of the passage 73 adjacent the top of the passage, the upper sprocket 279 being mounted on the output shaft 289 of this motor. For maintaining the elevator level as it moves up and down, the shaft 283 carries pinions 291 and 293 in mesh with racks 295 and 297 at the left and right sides of the passage 73.

Figure 20:
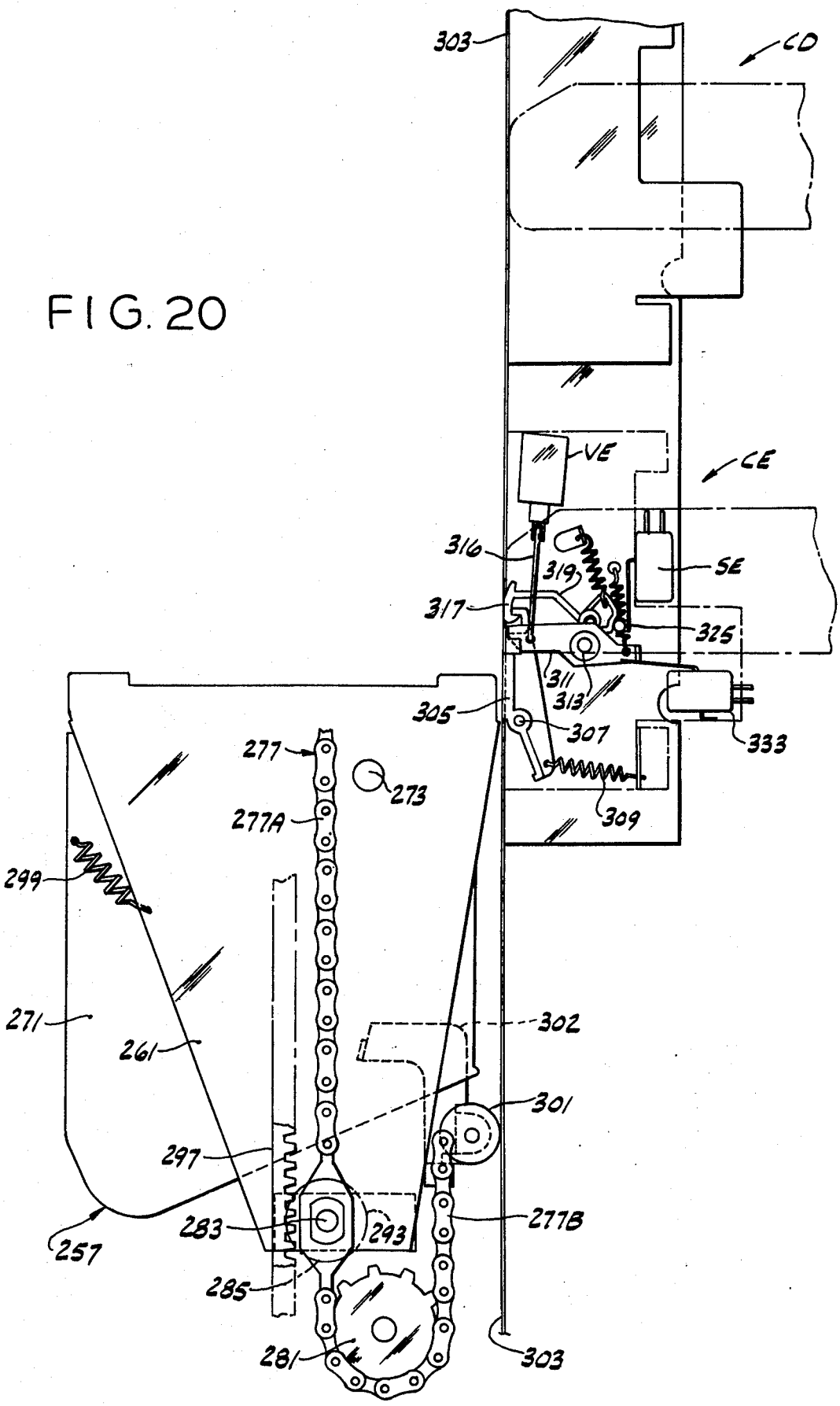
FIG. 20 is an enlarged section on line 20—20 of FIG. 3 showing an elevator and certain controls therefor.

The tray 257 is swingable rearward about its pivotal axis at 273 away from the forward position in which it is shown in solid lines in FIG. 4 and in FIG. 20 to the rearward position in which it is shown in phantom in FIG. 4 and in solid lines in FIG. 23, and back to its forward position. It is biased to swing rearward in the elevator frame by a spring 299 (see FIG. 20, and has a roller 301 mounted on a bracket 302 in the rear at its right end positioned to roll on a vertical rail 303 at the right of passage 73 (see FIGS. 4 and 20–23). With the roller 301 in engagement with the face of the rail 303 (which faces forward), the tray is held forward in its forward position against the bias of spring 299 for up and down movement in the passage 73. The rail has a series of openings, one for each tier, these openings being designated OA – OE (FIG. 3), opening OA being located generally at the level of tier A, etc. For each opening there is a gate 305 constituting an element of a control for stopping the elevator at the tier which includes a selected dispenser. With five tiers A – E and five openings OA – OE, there is a series of five such controls spaced vertically generally at the levels of the tiers. The five controls are designated CA – CE, CA being for tier A, CB for tier B, etc.

The gate of each of the five controls CA – CE is pivoted at 307 on a bracket 308 at the rear of the rail, being swingable rearward on this pivot away from a closed position in the respective opening in the rail to an open position, and forward back to closed position. A spring 309 biases the gate to swing closed, and a latch 311 pivoted at 313 on the bracket 308 is biased by a spring 314 to a latching position (FIG. 20) engageable with the gate at 315 to hold the gate in closed position. The latch is releasable by a solenoid to enable the gate to swing rearward against the closing bias of the spring 309. The solenoids of the five controls CA – CE are referred to as the vertical solenoids V and are respectively designated VA – VE. Each is connected by a link 316 to the respective latch 311. The arrangement is such that, with the gate 305 held in its closed position by the latch 311 (FIG. 20), the roller 301 on the tray 257 will simply roll over the gate and the tray will continue to be held in its forward position of FIG. 20 as the roller rolls over the gate. When the latch 311 is retracted (pulled up) by the solenoid, however, the roller 301 on the tray, rolling up over the gate, swings the gate rearward, the bias of spring 299 on the tray being sufficient to overcome the bias of spring 309 on the gate. The tray thus swings rearward and the roller 301 enters the opening OA – OE, coming under a finger 317 at the end of a switch actuating arm 319 pivoted at 321 on the bracket 308. This arm is formed with a cam 323 engageable with the operating arm 325 of a control switch for actuating this switch when the arm 319 is swung up by the roller 301 as the roller moves up in the openings OA – OE. The control switches of the five controls CA – CE are respectively designated SA – SE. These may be referred to as elevator stop switches. Arm 319 is biased to swing down by a spring 326, and is adapted to be latched down by engagement of a hook 327 on the gate with a hook 329 on the finger 317. The latch 311 has a tail 331 adapted to actuate an auxiliary switch 333 carried by the bracket 308 when the latch is released, this switch functioning in a manner not critical to this invention to effect retention of credit information. Each gate 305 may be referred to as a by-pass means for the respective elevator stop switch, noting that when the gate is latched closed, it in effect occupies a by-pass position for causing roller 301 to by-pass the respective elevator stop switch.

Figure 22:
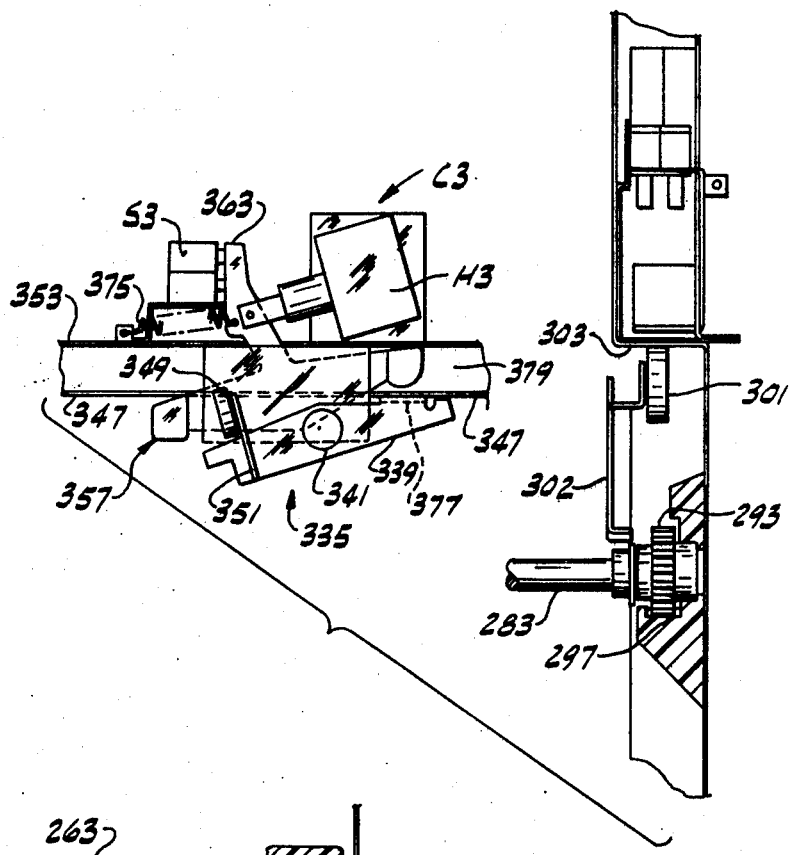
FIG. 22 is a plan of FIG. 21, with parts broken away.
Figure 20A:
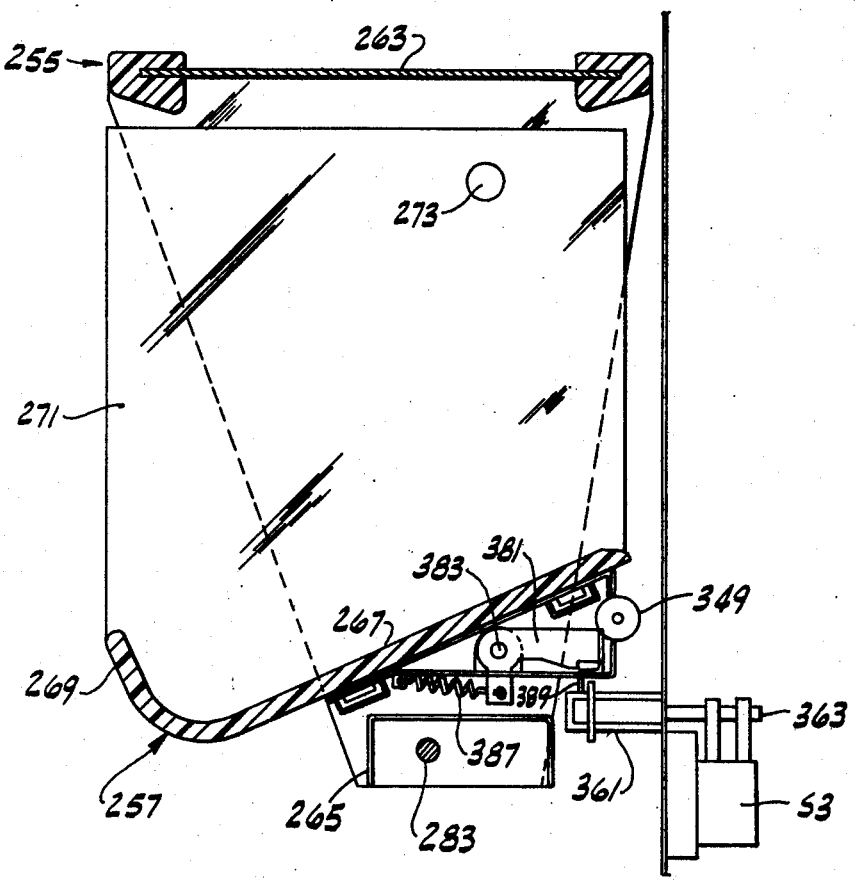
FIG. 20A is a fragment of FIG. 20 with parts broken away and shown in section.
Figure 24:
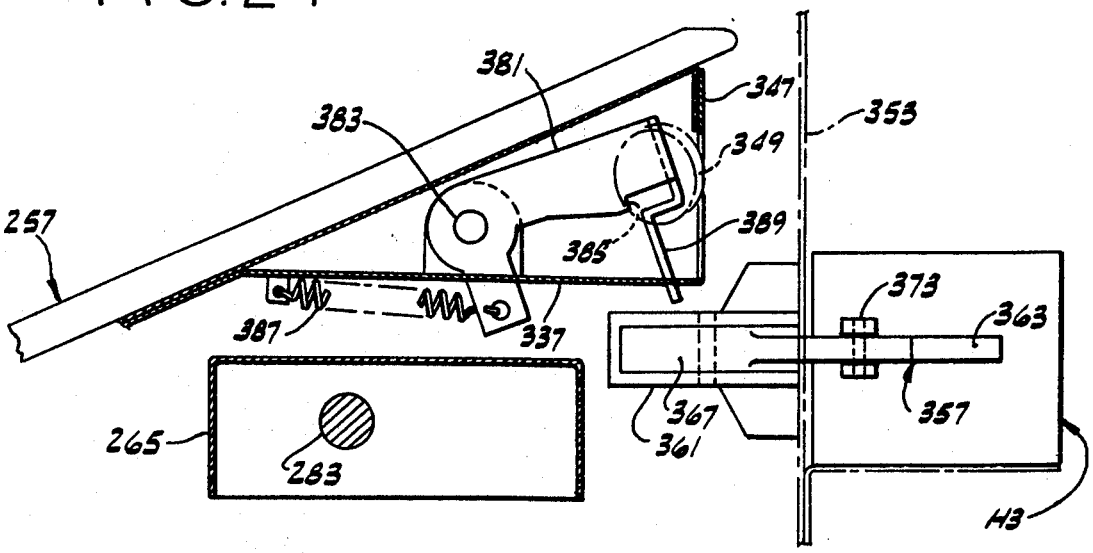
FIG. 24 is an enlarged vertical section showing details of mechanism illustrated in FIG. 22.
Figure 25:
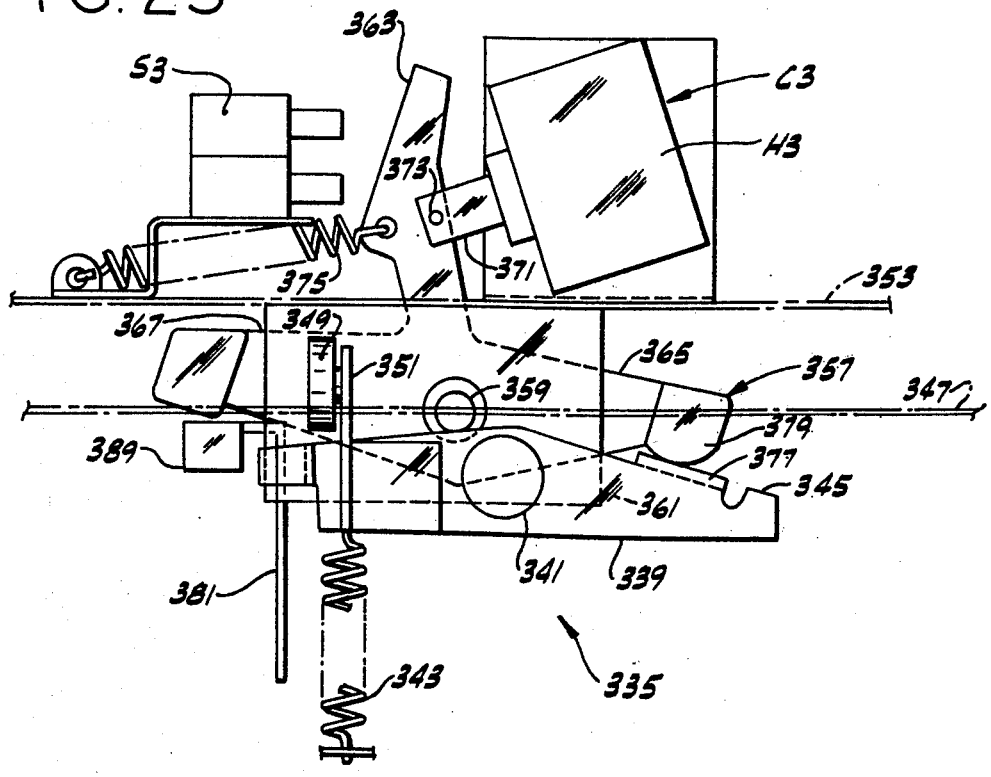
FIG. 25 is an enlarged fragment of FIG. 22 showing parts in a moved position.

The elevator tray 257 carries a series of five dispenser operators, each designated 335, one for each of the five columns 1 – 5 (i.e., one for each of the five clutches 169 of each of the five tiers A – E). Each of these dispenser or clutch operators 335 is adapted to actuate a clutch in the respective column 1–5 by pushing rearward the respective clutch push button 237. The five clutch operators 335 are mounted on a bracket 337 on the bottom of the tray 257 toward the rear of the tray. Each clutch operator comprises a lever 339 pivoted at 341 on the bracket 337 for swinging movement on a generally vertical axis between the retracted position in which it is shown in FIG. 22 and the operative position in which it is shown in FIG. 25. The lever 339 is biased by a spring 343 to swing counterclockwise as viewed in FIG. 22 to its retracted position, which is determined by the engagement of the end of the lever indicated at 345 with an upstanding rear flange 347 of the bracket 337. A roller 349 is mounted as indicated at 351 on the lever 339. When the lever 339 is retracted, the roller 349 occupies the retracted position generally in front of flange 347 in which it appears in FIGS. 22 and 24. When the lever swings to its operative position, as illustrated in FIG. 25, roller 349 projects rearward of the flange 347, which is suitably slotted for passage of the roller.

Mounted on a fixed panel 353 in the cabinet is a series of five controls, one for each of the five levers 339 for the five columns 1 – 5, each adapted to swing the respective lever to its operative position. These controls for the five columns 1 – 5 are respectively designated C1 – C5. Each control C1 – C5 comprises a rocker 357 pivoted at 359 for swinging movement about a vertical axis on a bracket 361 on the panel 353, this rocker having three arms 363, 365 and 367. The rocker is swingable from the retracted position in which it is illustrated in FIG. 22 to the actuated position in which it is illustrated in FIG. 25 by means of a solenoid having its plunger 371 pin-connected at 373 to the arm 363 of the rocker. The solenoids for the five controls C1 – C5 are respectively designated H1 – H5. A spring 375 connected to the arm 363 biases the rocker 357 to its retracted position. Each control C1 – C5 has a switch operable by the arm 363 when the rocker 357 is swung counterclockwise as viewed in FIG. 22 away from its retracted position, these switches for the five controls C1 – C5 being respectively designated S1 – S5. The lever 339 has a downwardly extending finger 377 positioned for engagement by the free end 379 of arm 365 of the rocker when the elevator is down in its lowered article delivery position. The arrangement is such that with the elevator down, on energization of the solenoid H1 – H5 of one of the five controls C1 – C5, the respective rocker 357 is swung clockwise as viewed in FIG. 22 to swing the respective lever 339 clockwise to its operative position of FIG. 25 via engagement of the free end 379 of arm 365 of the rocker with the finger 377 on the lever.

Figure 10:
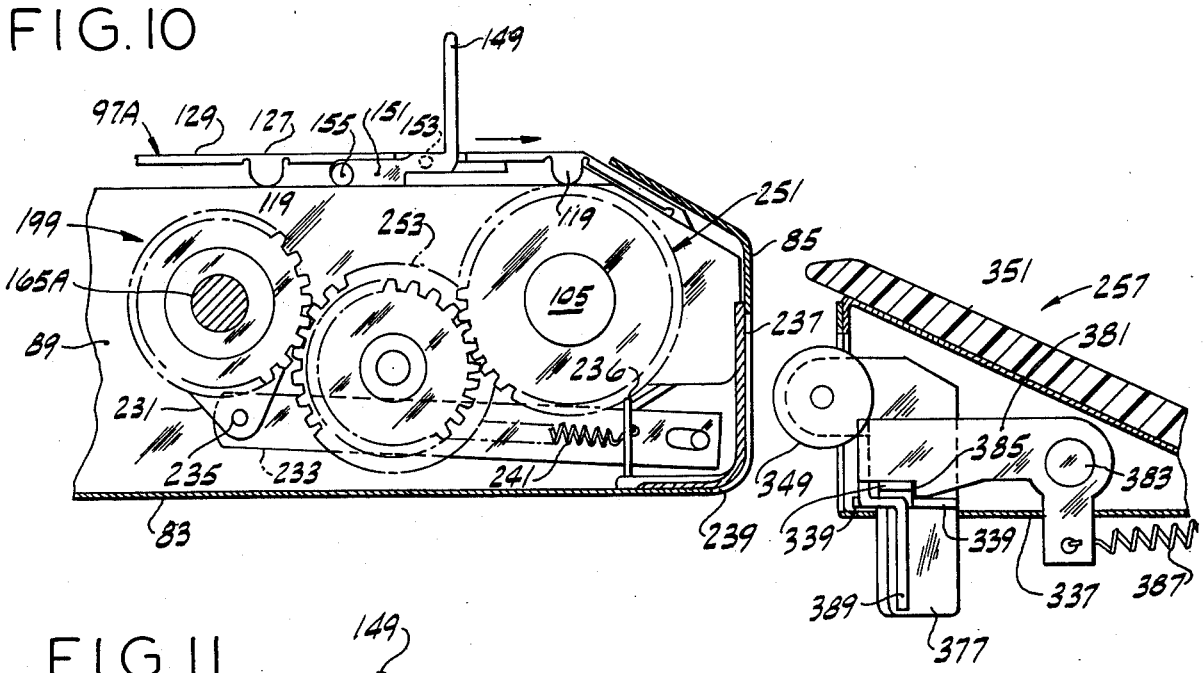
FIG. 10 is a view in elevation on line 10—10 of FIG. 6, also showing part of the elevator of the vendor.

Associated with each lever 339 is a latch 381 for latching the lever in its operative position when the lever is swung to this position by the respective rocker 357. Each latch 381 is pivoted as indicated at 383 on the bracket 337 for swinging movement on a horizontal axis from a raised retracted position in which it is clear of the respective lever 339 to a lowered operative position engaging the top of the lever with the lever behind a shoulder 385 on the latch. The latch is biased to swing down to its operative position by a spring 387, and is adapted to be retained in its raised retracted position by engagement of a leg 389 extending down from the latch with the third arm 367 of the rocker 357 (the latter being in its retracted position). The latch 381 is also adapted to be reset in its retracted position via engagement of leg 389 with the arm 367 of rocker 357 when the latter is in its retracted position upon lowering of the elevator tray to its lowered position. The rollers 349 of the five clutch operators 335 are located generally in the vertical planes of the five clutch-shifter push buttons 237 for the five columns 1 – 5, the arrangement being such that with any one of the five levers 339 latched in its operative position holding the respective roller 349 in its clutch-operating projecting position of FIGS. 10 and 25, when the tray 257 swings rearward at the tier including the selected dispenser, the roller engages the respective push button 237 to shift the respective clutch.

Figure 26A:
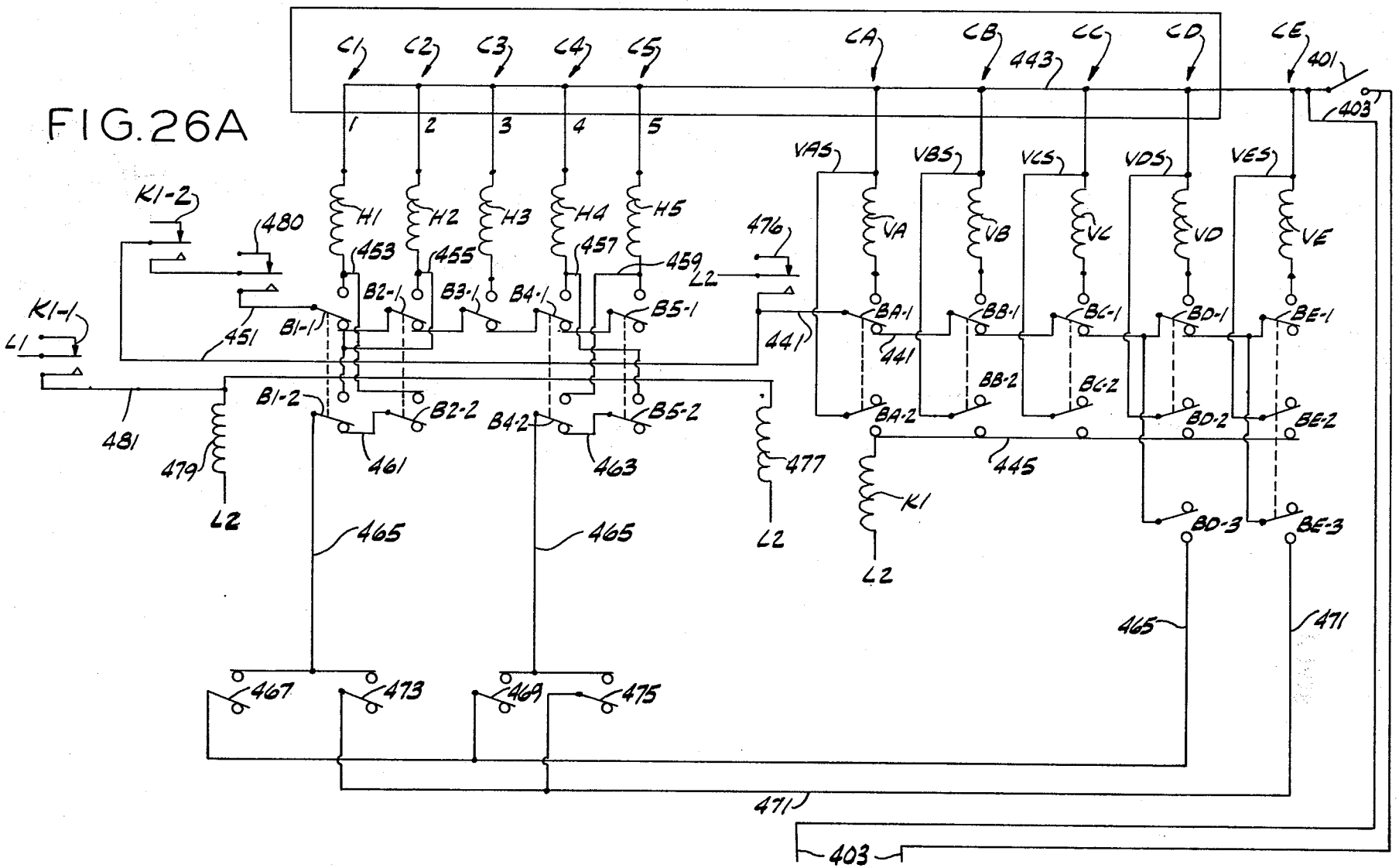
FIGS. 26A and 26B together constitute a wiring diagram.

Referring to FIGS. 26A and B showing the circuitry of the vendor, there is indicated at 401 a switch which constitutes the means for controlling the vending operation in the coin-handling unit 31 connected in a circuit 403 between power lines L1 and L2 including the normally closed contacts K3—3 of a relay K3, switches S1 – S5 which are controlled by the solenoids H1 – H5, and the coil of a relay K4. Switch 401 is momentarily closed upon deposit of coin in sufficient amount for a purchase. Switches S1 – S5 are double-throw switches normally closed on their upper contacts as shown to enable completion of the 403 circuit. When any one of these switches closes on its lower contact on actuation of the respective solenoid H1 – H5, circuit 403 is broken and a circuit 405 which includes normally open contacts K1-3 of a relay K1, switches SA – SE, a top limit switch 407 and elevator motor 287 is enabled from line L1 via contacts K3—3 to line L2 for driving the elevator motor in the direction to raise the elevator. The elevator motor is a reversible motor, and is reversed for lowering the elevator as will appear. The top limit switch 407 is a safety switch mounted in the cabinet in position for actuation by the elevator to break the elevator raise circuit 405 if the elevator should overtravel in its upward movement. The top limit switch is a double-throw switch normally closed on its left contact as illustrated. Switches SA – SE are double-throw switches normally closed on their upper contacts as shown to enable the elevator motor circuit 405. When any one of these switches closes on its lower contact, the elevator raising circuit 405 is broken and a circuit 409 which includes the vend motor 177 is enabled to line L2. The coil of relay K4 is also connected between lines L1 and L2 in a circuit 411 including a cam-actuated switch SWB and normally open contacts K4-1 of relay K4. Switch SWB is controlled by a cam 413 driven by the vend motor 177, this cam being illustrated as a disk having a notch 415 therein. A cam follower 417 rides on the disk and functions to open switch SWB when it drops into the notch, otherwise holding switch SWB closed. The vend motor 177 is also connected between lines L1 and L2 in a circuit 419 including a switch SWA controlled by the cam 413, a cam follower 421 riding on the cam and functioning to open switch SWA when in the notch 415, otherwise closing it. The elevator motor 287 is also connected between lines L1 and L2 in a reversing or elevator lowering circuit 423 including a switch 425 controlled by the cam 413. A cam follower 426 engages cam 413 about 180° around from follower 421 and functions normally to hold switch 425 open. When follower 426 drops into the notch 415 at the point where cam 413 has rotated through half a revolution, corresponding to completion of a downstroke of the rack and hence completion of indexing of a belt 97, switch 425 closes to enable the elevator lowering circuit 423. This circuit also includes a bottom limit switch 427 mounted in the cabinet in position to be opened by the elevator when the elevator descends to its bottom limit at level L. When the elevator rises, switch 427 closes to enable the circuit 423, which is completed when the vend motor 177 rotates cam 413 through half a revolution and switch 425 closes. The coil of relay K3 is connected between circuit 423 and line L2 to be energized when circuit 423 is energized. Relay K3 has normally open contacts K3-1 connected between line L1 and circuit 423 in a line 429 including another bottom limit switch 431 mounted on the cabinet in position to be opened by the elevator when the elevator descends to its bottom limit. When the elevator rises, switch 431 closes to energize line 429 from line L1. When follower 426 drops into the notch 415 of cam 413 of a half revolution of the cam, corresponding to the termination of the forward indexing of a belt 97 to deliver an article to the elevator, switch 425 closes and circuit 423 is completed via switch 425 to reverse the motor 287 and start lowering the elevator (switch 427 being closed). Relay K3 is energized and its contacts K3-1 close to energize line 429 from line L1 via switch 431 being closed. Line 429 holds circuit 423 (and relay K3) energized to operate motor 287 to continue lowering the elevator even though switch 425 opens when follower 426 rides out of the notch 415 of cam 413, and this continues until the elevator reaches its bottom limit and opens switches 427 and 431, whereupon the motor 287 and relay K3 are deenergized. Switch 431 is connected as indicated at 433 to control a coin chute blockout solenoid 435. The right-hand contact of the top limit switch 407 is connected as indicated at 437 to circuit 423 to lower the elevator if it should run up high enough to trip the top limit switch.

The push buttons BA – BE and B1 – B5 of the selector means 77 actuate ten sets of switches shown in FIG. 26A. Push buttom BA actuates two switches BA1 and BA2; BB actuates two switches BB1 and BB2; BC actuates two switches BC1 and BC2; BD actuates three switches BD1, BD2, BD3; and BE actuates three switches BE1, BE2, BE3. Switches BA1 – BE1 are double-throw switches normally closed on their lower contacts as shown in FIG. 26A in series in a line 441. Solenoids VA – VE are connected between the upper contacts of the respective switches BA1 – BE1 and a line 443. Switches BA2 – BE2 are normally open single-throw switches each having a fixed contact connected in a line 445 in series with the coil of relay K1, and a movable contactor to which is connected a line VAS – VES around the respective solenoid VA – VE. Switches BD3 and BE3 are normally open single-throw switches.

Push button B1 actuates two switches B1-1 and B1-2; B2 actuates two switches B2-1 and B2-2; B3 actuates a single switch B3-1; B4 actuates two switches B4-1 and B4-2; and B5 actuates two switches B5-1 and B5-2. Switches B1-1 to B5-1 are double-throw switches normally closed on their lower contacts as shown in FIG. 26A in series in a line 451. Switches B1-2, B2-2, B4-2 and B5-2 are double-throw switches normally closed on their lower contacts as shown in FIG. 26A. Solenoids H1 – H5 are connected between the upper contacts of switches B1-1 to B5-1 and line 443. Solenoid H1 is also connected as indicated at 453 between the upper contact of switch B2-2 and line 443. Solenoid H2 is also connected as indicated at 455 between the upper contact of switch B1-2 and line 443. Solenoid H4 is also connected as indicated at 457 between the upper contact of switch B5-2 and line 443. Solenoid H5 is also connected as indicated at 459 between the upper contact of switch B4-2 and line 443. The lower contact of switch B1-2 is connected to the movable contactor of switch B2-2 by a line 461. The lower contact of switch B4-2 is connected to the movable contactor of switch B5-2 by a line 463. A circuit 465 including normally open switch BD3 and normally open so-called coupling switches 467 and 469 interconnects line 441 between switches BC1 and BD1 and the movable contactors of switches B1-2 and B4-2. A circuit 471 including normally open switches BE3 and normally open coupling switches 473 and 475 interconnects line 441 between switches BD1 and BE1 and the movable contactor of switches B1-2 and B4-2 via connection to 465. Line 443 is connected to the 403 circuit to enable energization of any one of the solenoids H1 – H5, VA – VE when the 403 circuit is completed. With the 403 circuit completed, energization of any one of solenoids VA – VE occurs from line 443 via the respective switch BA1 – BE1 closing on its upper contact and via line 441 and a so-called full stroke switch 476 to line L2. This full stroke switch is a normally open switch which is closed when any one of push buttons BA – BE is pushed in through a full stroke and solenoids 477 and 479 are energized. With the 403 circuit completed, energization of any one of solenoids H1 – H5 occurs from line 443 via the respective switch B1-1 to B5-1 closing on its upper contact and via line 451 including another full stroke switch 480, normally open contacts K1-2 of relay K1 and full stroke switch 473. Full stroke switch 480 is a normally open switch which is closed when any one of push buttons B1 – B5 is pushed in through a full stroke and solenoids 477 and 479 are energized. Solenoid 477 is a latch solenoid for latching in any one of push buttons BA – BE and solenoid 479 is a latch solenoid for latching in any one of push bottons B1 – B5. These latch solenoids 477 and 479 are connected between lines L1 and L2 in a circuit 481 including normally open contacts K1-1 of relay K1. They actuate suitable conventional latches (not shown) for latching in the push buttons when the push buttons are pushed in.

Figure 3:
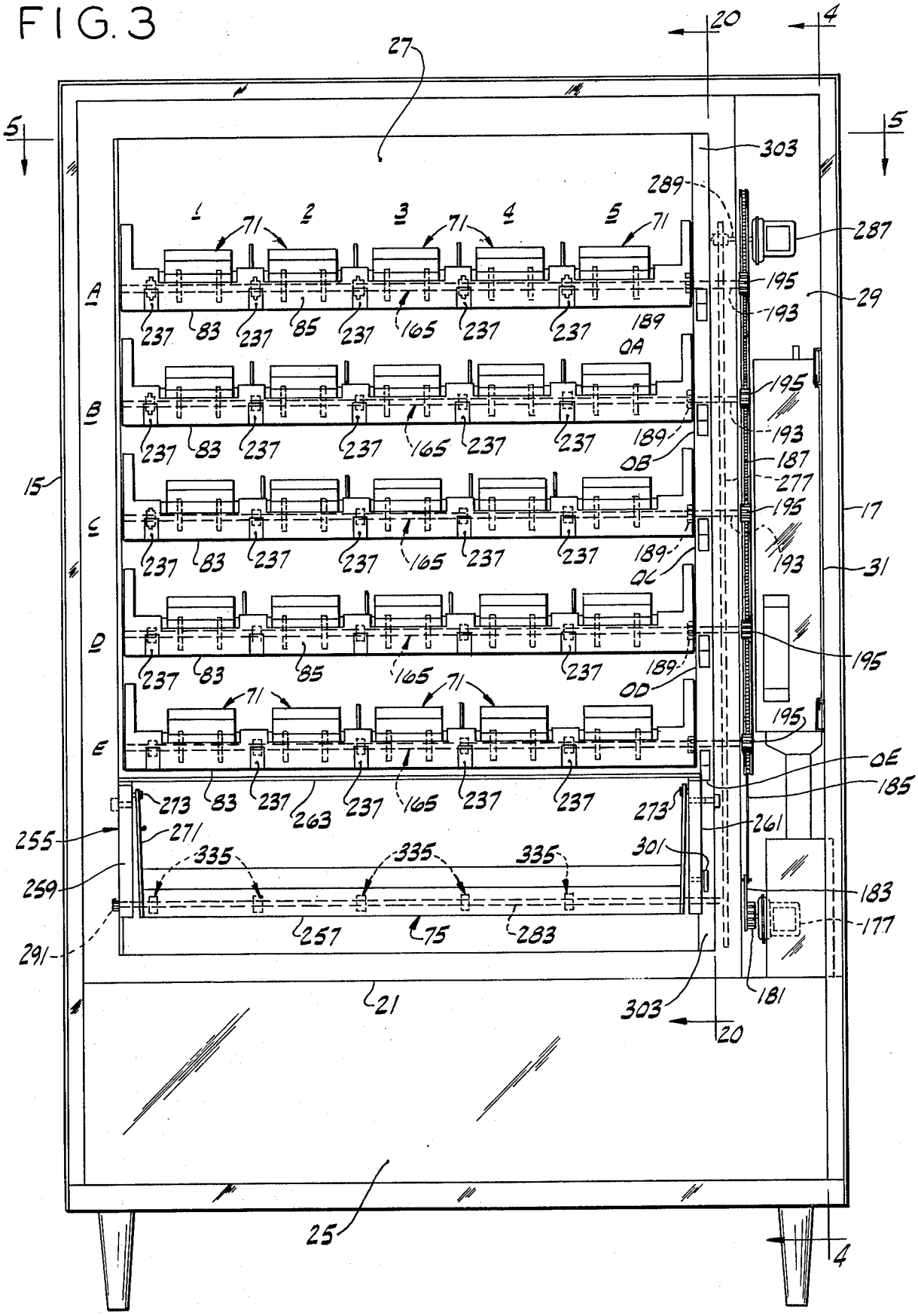
FIG. 3 is a front elevation of the vendor with an outer door and an inner door both open to show interior detail.
Figure 26B:
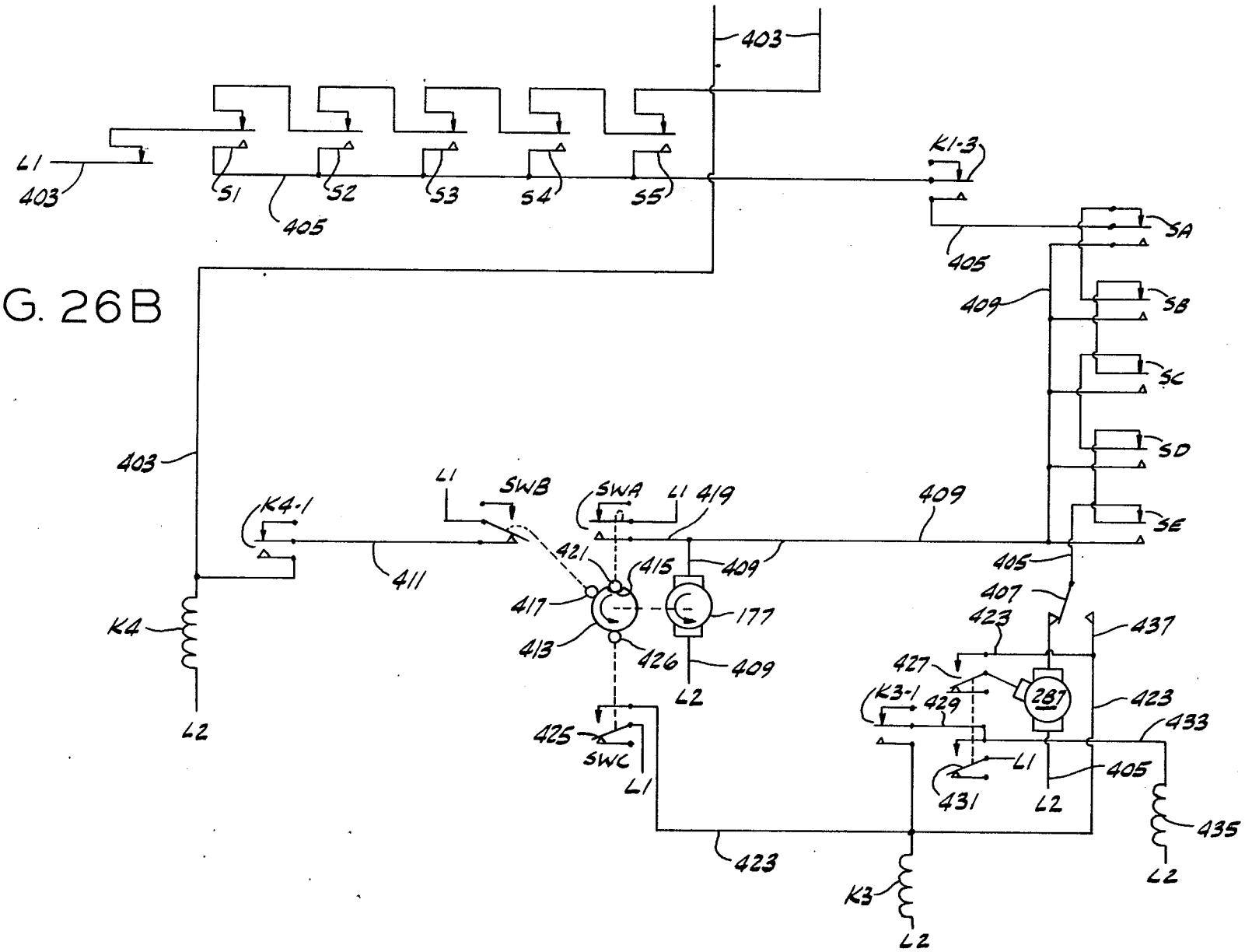

Operation is as follows:

The elevator 75 is normally down in its lowered position of FIGS. 3, 4 and 20, in which it holds the two bottom limit switches 427 and 431 (FIG. 26B) open. The cam 413 normally occupies its home position of FIG. 26B in which switch SWA is open, switch SWB is closed, and switch 425 is open. Operation is initiated by the customer depositing coin in the coin slot 57 in appropriate amount and making a selection by pushing in the appropriate one of buttons BA – BE and the appropriate one of buttons B1 – B5 corresponding to the tier and column holding the item which he has selected for purchase via viewing through the window 53 and 69*a*, *b* in the front door of the cabinet. It will be assumed that coupling switches 467, 469, 473 and 475 are all open.

On deposit of coin in the requisite amount, the coin-handling unit 31 functions to effect a momentary closure of the coin switch 401 (FIG. 26A). This completes the circuit 403 from line L1 through switches S1 – S5 (all closed on their upper contacts) through the coil of relay K4 to line L2, thereby to energize this relay. Contacts K4-1 of relay K4 thereupon close to complete circuit 411 via switch SWB, which is closed, and contacts K4-1, thereby holding relay K4 energized and also enabling circuit 403 to energize line 443 (FIG. 26A) from line L1 via circuit 411.

Now, assuming for purposes of illustration that the customer has selected for purchase the item he sees at the forward end of the C/3 dispenser (i.e., the dispenser in tier C and column 3), he will push in buttons BC (for tier C) and B3 (for column 3). On pushing in button BC, switch BC1 closes on its upper contact and BC2 closes on its lower contact. On closure of switch BC2 on its lower contact, relay K1 is energized from line 443 via line VCS and line 445 to line L2. This closes contacts K1-1, thereby completing a circuit for the latching solenoids 477 and 479 from L1 via line 481 to L2. With the latching solenoid 477 energized, the full stroke switch 476 is allowed to close, thereby completing a circuit for solenoid VC (for tier C) from line 443 via line 441 and switch 476 to L2. Solenoid 477 latches in button BC. On pushing in button B3, switch B3-1 closes on its upper contact and solenoid H3 (for column 3) is energized from line 443 via line 451, including the full stroke switch 480 (which is allowed to close with solenoid 479 energized) and contacts K1-2 (now closed) of relay K1. Solenoid 479 latches in button B3.

On energization of solenoid VC for tier C, the latch 311 of control CC for tier C is pulled up to release the gate 305 of this control and prepare it for the arrival of the elevator at the tier C level. On energization of solenoid H3 for column 3, rocker 357 of the control C3 for column 3 is swung away from its retracted position of FIG. 22 to its FIG. 25 operative position. This swings the respective clutch operating lever 339 to its operative position, and the lever is latched in this position by the respective latch 381. Also, arm 363 of the rocker 357 actuates the switch S3 to close on its lower contact, thereby to energize the elevator motor 287 to operate in the direction for raising the elevator via circuit 405 (contacts K1-3 and K3-3 having been closed as above described). The motor 287 operates to drive the chain 277 in the direction for raising the elevator and the elevator moves up in the passage 73 between the forward ends of the shelves 83 and the inner door 61 at the front of the cabinet. The tray 257 of the elevator is biased by spring 299 to swing rearward and roller 301 carried by the tray is biased into engagement with and rolls up on the rail 303. When roller 301, rolling up on the rail 303, reaches the gate 305 of the control CC (for tier C) as shown in FIG. 23, the rearward bias of spring 299 on the tray causes the tray to swing rearward, the roller swinging the gate rearward (spring 299 being stronger than the gate spring 309) and entering the opening OC (for tier C). The roller 301 continues to roll up on the gate (which is inclined rearwardly in upward direction as viewed in FIG. 23) and engages the switch-actuating arm 319 of control CC to actuate the switch SC of control CC, i.e., to open switch SC off its upper contact and close it on its lower contact as viewed in FIG. 26B.

The opening of switch SC off its upper contact breaks the elevator motor lift circuit 405 and the elevator stops at the tier C level, with the tray 257 swung rearward and with its rear edge closely adjacent the forward end of the upper reaches 97A of the endless belt conveyors 97 in tier C; more precisely, closely adjacent the forward ends of the segments of the belts which are inclined downwardly in forward direction on the sprockets 101. The bottom section 267 of the tray generally lines up with these segments of the belts. On the rearward swing of the tray, the roller 349 on the clutch operating lever 339 for column 3 (this roller being in its operative position projecting rearward of the flange 347) pushes the clutch shifter push button 237 of the tier 3 column 3 dispenser rearward (see FIG. 10) and acts through rod 233 to actuate the respective clutch shifter 221 to engage the respective clutch 169.

Upon the closing of switch SC on its lower contact, the vend motor 177 is energized via circuit 409 (see FIG. 26B) to drive the rack 187 (see FIG. 4) through a cycle involving a downstroke and a return upstroke of the rack. As the rack moves down, it acts through pinion 195, shaft 193 and gears 189 and 191 of tier C to rotate the drive shaft 165 of tier C in the direction (clockwise as viewed in FIG. 10) for driving a conveyor belt 97 of tier C forward. With the clutch 169 of the dispenser C/3 (tier C, column 3) engaged as above noted, on the downstroke of the rack 187, the belt of the C/3 dispenser is indexed forward one interval, with resultant dispensing of the forward article therefrom on to the elevator tray 257 and indexing forward one interval of each succeeding article on the belt. The article slides relatively gently down the inclined forward segment of the belt 97 and down the inclined bottom 267 of the tray toward the front 269 of the tray. The vend motor 177 is held energized for the downstroke-upstroke cycle of the rack 187 by the action of cam 413 (FIG. 26B), which rotates through one revolution for said cycle. Thus, as the cam 413 starts its single-revolution cycle, switch SWA closes to establish a holding circuit for the vend motor 177 via line 419 and part of circuit 409 to L2, and opens when cam 413 has rotated through a revolution to break this holding circuit to deenergize the vend motor. The belt 97 of the C/3 dispenser is indexed forward one step corresponding to the spacing of its flaps or dividers 149 on the downstroke of the rack 187, which is in effect the forward stroke of the rack, and remains stationary during the upstroke (the return stroke) of the rack even though shaft 165 then rotates in reverse direction. This is because the elevator starts down momentarily after shaft 165 reverses, and the pressure on the clutch shifter push button 237 is thereby released, allowing spring 215 to disengage the clutch and engage the braking teeth 247 and 249. As a back-up, the crown ratchet formation with the teeth 245 at the outer end of the hub 207 of the driving member 197 functions as a one-way clutch member, being cammed inwardly on the shaft 165 by the pin 243 for disengagement of the driving member 197 from the driven member 199, and locking of the driving member 197 via interengagement of teeth 247 and 249.

Shortly after the start of the single-revolution cycle of the cam 413, switch SWB is opened via follower 417 dropping into the cam notch 415. This breaks circuit 411 to deenergize the relay K4, resulting in opening of contacts K4-1 of relay K4 and deenergization of circuits 411, 403 and 443. Upon deenergization of circuit 443, solenoids VC and H3 are deenergized, thereby resetting the latch 311 of the control CC, and the rocker 357 of the control C3. While this rocker is reset at this time, the clutch operating lever 339 for column 3 remains latched in its operative position by the respective latch 381. Relay K1 is deenergized, with accompanying opening of its contacts K1-1 to K1-3, and the latch solenoids 477 and 479 are deenergized to unlatch the push buttons BA - BE and B1 - B5, allowing them to return to their out position.

When the cam 413 has rotated through half its single-revolution cycle, the belt 97 of the C/3 dispenser stops, having completed the delivery of the forwardmost article on the belt to the elevator tray 257 and the forward indexing of the remainder of the articles on the belt. The belt stops since, at this point in the cycle, the rack 187 has reached the end of its downstroke and is starting back up through its return stroke. Also, at this point in the cycle, switch 425 is closed via follower 426 dropping into notch 415 in cam 413 to complete the elevator lowering circuit 423 (the bottom limit switch 427 being closed since the elevator has been raised). Relay K3 is energized from circuit 423 with accompanying closing of its contacts K3-1 and opening of its contacts K3-3. The elevator motor 287 is energized to operate in reverse direction via circuit 423 and drives the chain 277 in the direction for lowering the elevator. The elevator moves down in the passage 73 until it reaches its bottom limit at the delivery level L and opens the bottom limit switches 427 and 431, thereby deenergizing the motor 287 to stop the elevator at its lowered article delivery position at level L for access by the purchaser to the article in the elevator tray 257 via delivery opening 49 after opening the delivery door 63. As the elevator starts to move down, roller 301 rolls down off the gate 305 of the control CC, and the gate closes and is relatched in its closed position by the latch 311 of this control. As the elevator approaches its lowered article delivery position, the latch 381 associated with the control C3 is reset in its retracted position via engagement of its leg 389 with the arm 367 of rocker 357 associated with control C3, this rocker having been returned to its retracted position by the deenergization of solenoid H3.

Figure 13:
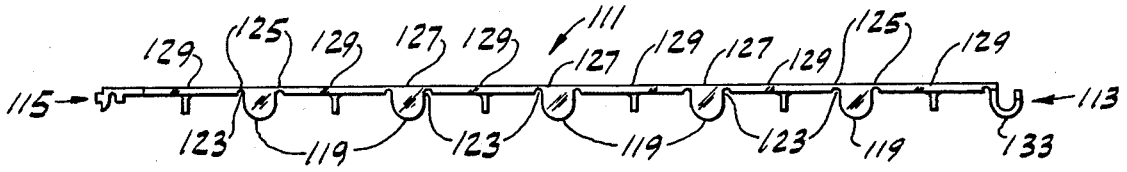
FIG. 13 is a side elevation of one link of an endless conveyor belt of a dispenser.
Figure 14:
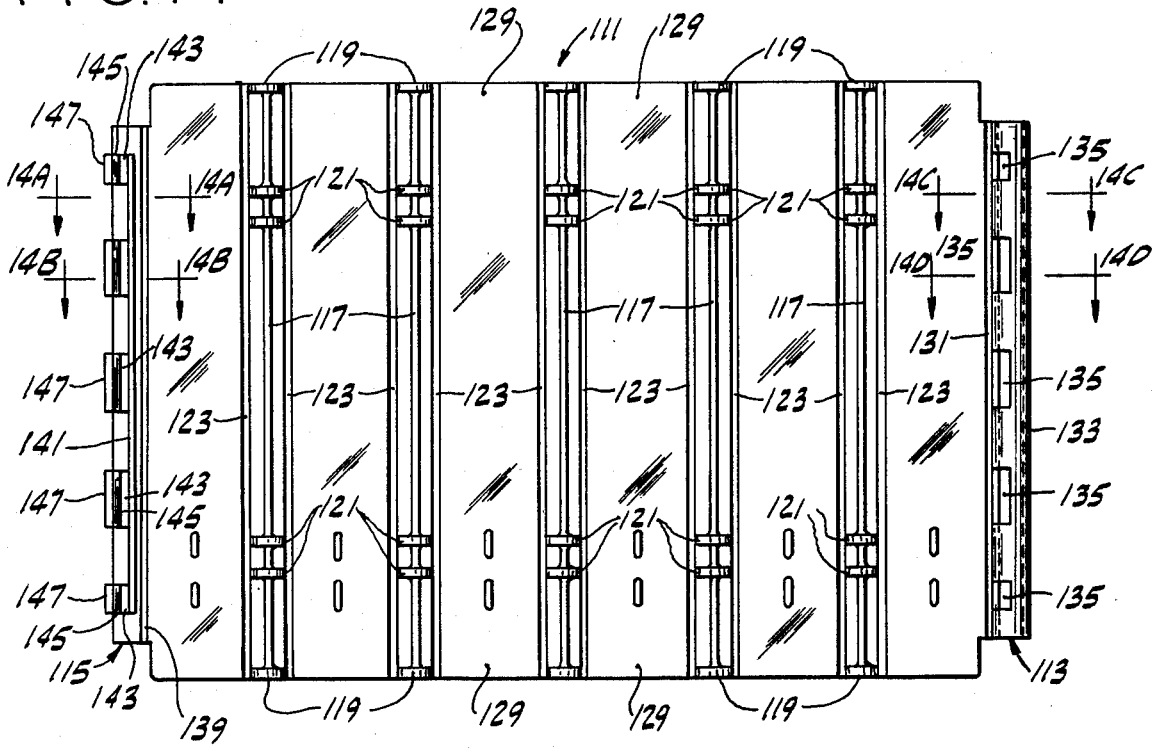
FIG. 14 is a bottom plan of the FIG. 13 link.
Figure 14A:
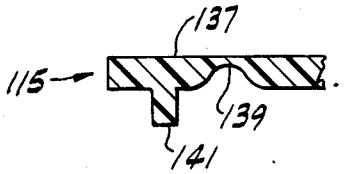
FIGS. 14A–D are detail sections on lines 14A–D of FIG. 14.

The belt 97 of any one of the 25 dispensers 71 may be readily removed and replaced with a belt having a different distance between the dividers or flaps 149 (i.e., a different index distance) to handle articles of different size. Thus, the belt 97 of any dispenser may be readily removed from the sprockets 99 and 101 of that dispenser by disengaging the rib 141 and the lugs 143 on the tongue 137 at the end of one link or plate 111 of the belt from the hook 133 on the tongue 113 at the complementary end of the next link or plate 111. And another belt made of links or plates 111 of a different length corresponding to the desired spacing for the dividers or flaps 149 may be readily applied to the sprockets by following the reverse procedure. The link or plate 111 shown in FIGS. 13 and 14 has six of the panels 129 (and five of the panels 127). A replacement belt made up of a set of links having a different number of panels 129 may be used; the dimensions of panels 129 and 127 lengthwise of the belt would be constant in all the belts to fit the sprockets 99 and 101. In a specific embodiment of the invention, a total belt length of 60 inches is used as standard, and a belt composed of 10 links such as shown in FIGS. 13 and 14 with six panels 129 is used. This may be replaced by a belt with 12 links having five panels 129, or a belt with 15 links having four panels 129, or a belt with 20 links having three panels 129. This avoids any necessity for changing the distance between the axes of the rearward and forward sprockets 99 and 101. When a belt having links 111 of a different length is installed on a dispenser 71, the change gear 253 is replaced with a gear of appropriate ratio for indexing the belt forward one link length (i.e., the one-compartment distance between the dividers or flaps 149) on a downstroke of the rack 187.

On pushing in button BC and any one of buttons B1, B2, B4 or B5, the operation is similar to that above described except that the horizontal control C1, C2, C4 or C5 will be actuated for operating the dispenser C/1, C/2, C/4 or C/5, as the case may be, when the elevator rises up to tier C. On pushing in one of the buttons BA, BB, BD or BE and any one of the buttons B1 - B5, the operation is similar to that above described except that the vertical control CA - CE and the respective horizontal control C1 - C5 are actuated, the elevator rises to the respective tier A, B, D or E, and dispenser A/1 - A/5 is actuated.

With the coupling switches 467, 469, 473 and 475 and the associated circuitry shown in FIG. 26A, the Nos. 1 and 2 dispensers and/or the Nos. 4 and 5 dispensers of either or both of the tiers D or E may be coupled together for operation in unison to vend relatively large items such as lunch platters which are too wide for one dispenser. Thus, by closing the coupling switch 467, dispensers D/1 and D/2 are operated in unison; by closing the coupling switch 469, dispensers D/4 and D/5 are operated in unison; by closing the coupling switch 473, dispensers E/1 and E/2 are operated in unison; and by closing the coupling switch 475, dispensers E/4 and E/5 are operated in unison.

With switch 467 closed, when the purchaser pushes in button BD and either of buttons B1 or B2, the effect is to energize solenoid VD of the vertical control VD for raising the elevator to tier D, and to energize solenoids H1 and H2 of the horizontal controls C1 and C2. If he pushes a button B1, solenoid H1 is energized in normal manner from line 443 via switch B1-1 and line 451 to L2, and solenoid H2 is energized from line 443 via line 455, switch B1-2, line 465 including the closed switches 467 and BD-3 and line 441 to L2. If he pushes button B2 instead of B1, solenoid H2 is energized in normal manner from line 443 via switch B2-1 and line 451 to L2, and solenoid H1 is energized from line 443 via line 453, switch B2-2, line 461, switch B1-2, line 465 including the closed switches 467 and BD3 and line 441 to L2. With solenoids H1 and H2 energized, the D/1 and D/2 dispensers are simultaneously operated when the elevator reaches the level of tier D.

With switch 473 closed, when the purchaser pushes in button BE and either of buttons B1 or B2, the effect is to energize solenoid VE of the vertical control CE for raising the elevator to tier E, and to energize solenoids H1 and H2 of the horizontal controls C1 and C2. If he pushes a button B1, solenoid H1 is energized in normal manner from line 443 via switch B1-1 and line 451 to L2, and solenoid H2 is energized from line 443 via line 455, switch B1-2, line 465, line 471 including the closed switches 473 and BE3 and line 441 to L2. If he pushes button B2 instead of B1, solenoid H2 is energized in normal manner from line 443 via switch B2-1 and line 451 to L2, and solenoid H1 is energized from line 443 via line 453, switch B2-2, line 461, switch B1-2, line 465, line 471 including the closed switches 473 and BE3 and line 441 to L2. With solenoids H1 and H2 energized, the E/1 and E/2 dispensers are simultaneously operated when the elevator reaches the level of tier E.

With switch 469 closed, when the purchaser pushes in button BD and either of buttons B4 or B5, the effect is to energize solenoid VD of the vertical control CD for raising the elevator to tier D, and to energize solenoids H4 and H5 of the horizontal controls C4 and C5. If he pushes a button B4, solenoid H4 is energized in normal manner from line 443 via switch B4-1 and line 451 to L2, and solenoid H5 is energized from line 443 via line 459, switch B4-2, line 465 including the closed switches 469 and BD3 and line 441 to L2. If he pushes button B5 instead of B4, solenoid H5 is energized in normal manner from line 443 via switch B5-1 and line 451 to L2, and solenoid H4 is energized from line 443 via line 457, switch B5-2, line 463, switch B4-2, line 465 including the closed switches 469 and BD3 and line 441 to L2. With solenoids H4 and H5 energized, the D/4 and D/5 dispensers are simultaneously operated when the elevator reaches the level of tier D.

With switch 475 closed, when the purchaser pushes in button BE and either of buttons B4 or B5, the effect is to energize solenoid VE of the vertical control CE for raising the elevator to tier E, and to energize solenoids H4 and H5 of the horizontal controls C4 and C5. If he pushes a button B4, solenoid H4 is energized in normal manner from line 443 via switch B4-1 and line 451 to L2, and solenoid H5 is energized from line 443 via line 459, switch B4-2, line 465, line 471 including the closed switches 475 and BE3 and line 441 to L2. If he pushes button B5 instead of B4, solenoid H5 is energized in normal manner from line 443 via switch B5-1 and line 451 to L2, and solenoid H4 is energized from line 443 via line 457, switch B5-2, line 463, switch B4-2, line 465, line 471 including the closed switches 475 and BE3 and line 441 to L2. With solenoids H4 and H5 energized, the E/4 and E/5 dispensers are simultaneously operated when the elevator reaches the level of tier E.

Figure 27:
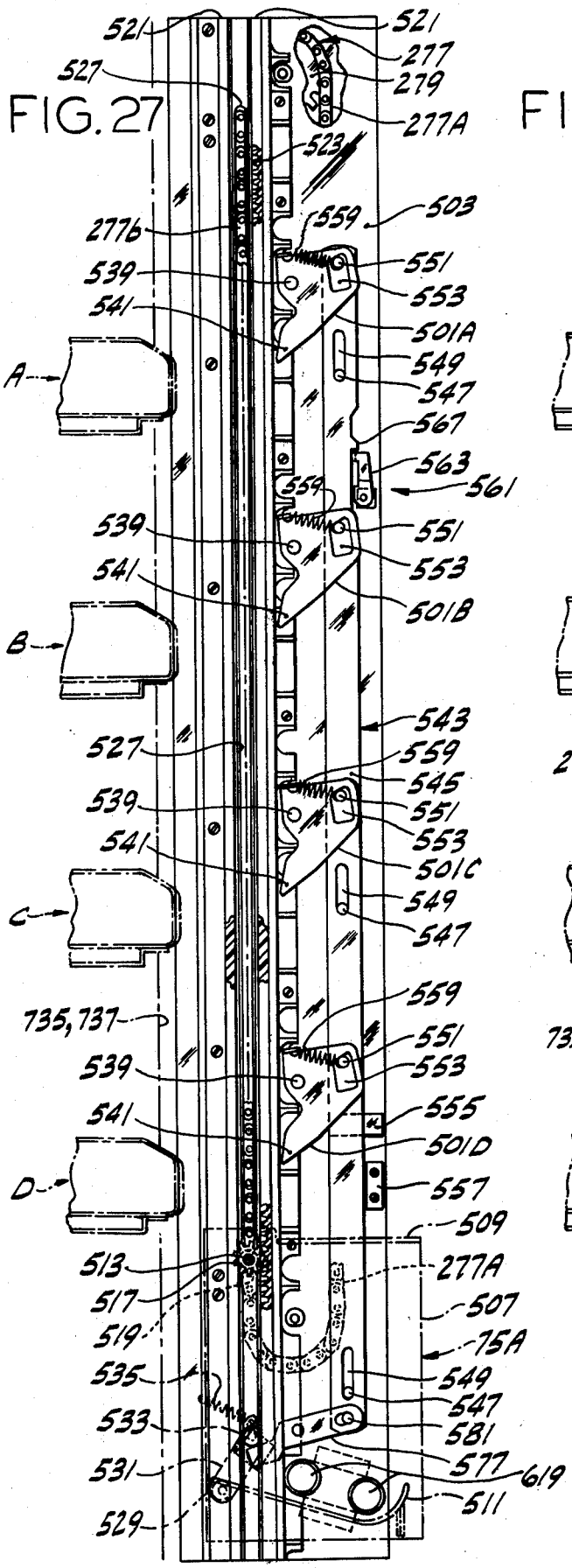
FIG. 27 is a view generally in section on line 27—27 of FIG. 29 showing a vertical series of elevator stops of a second embodiment of the vendor of this invention, the stops being shown in a retracted position.

As above described, the stopping of the elevator 75 at the level of the tier which includes a selected dispenser and the inward swing of the tray 257 for effecting operation of the selected dispenser are effected by means of the controls CA - CE, each including a gate 305, a solenoid VA - VE for releasing the gate to allow it to sswing in, and a stop switch SA - SE for deenergizing the elevator motor 287. FIGS. 27 - 37A and B show a second embodiment of the vendor having a second embodiment of the elevator control means for more consistently accurate stopping of the elevator at the level of the tier including the selected dispenser. This embodiment comprises a vertical series of elevator stops spaced vertically at intervals corresponding to the vertical spacing of the tiers, each of these stops being movable from a retracted position clear of the elevator, for movement of the elevator to a tier including a selected dispenser, to a stop position wherein it is engageable by the elevator positively to stop the elevator at the level of the respective tier. As illustrated in FIG. 27, said second embodiment has four tiers, designated A, B, C and D (instead of five as in the first embodiment), tier A being the highest and D the lowest. For these four tiers A - D there are four stops, each generally bearing the reference numeral 501 and specifically designated 501A - 501D to relate each stop to its respective tier.

The four stops 501A - 501D are mounted on a mechanism plate 503 extending vertically in the cabinet 11 at the right side of the passage for the elevator of the second embodiment. This passage is again designated 73 as in the first embodiment; the elevator of the second embodiment is somewhat different from the elevator of the first embodiment and is therefore designated 75A. More particularly, the elevator 75A comprises left and right side or end plates or panels 505 and 507, an anti-pilfer top panel 509 (similar to panel 263), and a tray 511 which extends between the end plates 505 and 507 adjacent the bottom of these plates and which is suitably secured at its ends to the end plates (instead of being pivoted relatively to the elevator). A shaft 513 extends across the elevator adjacent the top of the elevator, being journalled adjacent its ends in bearings 515 in the elevator end plates with the arrangement such that the entire elevator may swing about the axis of the shaft. Pinions 517 are secured on the shaft on the outside of the left and right-hand end plates 505 and 507 of the elevator, and rollers 519 are provided at the left and right ends of the shaft on the outside of the pinions. The rollers 519 roll in tracks 521 at the left and right sides of the elevator passage 73, and the pinions 517 mesh with and roll on racks 523 alongside the track. The right-hand track and rack are mounted on the mechanism plate 503, and the left-hand track and rack are mounted on a similar plate 525 at the left side of passage 73.

The elevator is movable up and down by an endless chain indicated at 277 corresponding to the chain 277 of the first embodiment trained around an upper sprocket 279 and a lower sprocket 281 on the right-hand side of the plate 503 (right-hand as viewed from the front of the vendor). At the right end of the elevator, the shaft 513 extends through an elongate vertical slot 527 in the plate 503 and is pivotally received in a special link 285 in the rear reach 277B of the chain. With this arrangement, the entire elevator 75A is swingable about the horizontal axis of the shaft 513. The tray 511 is shaped like the tray 257, and carries on its bottom dispenser operators corresponding to the dispenser operators 335 of the first embodiment, one for each of the columns of the four tiers A - D. As herein described, there are six such columns in the second embodiment, instead of five as in the first embodiment, the columns being designated 1 - 6 (see FIGS. 27 and 37A). The dispensers and the dispenser operators of the second embodiment are essentially the same as those of the first embodiment, and hence are omitted in FIGS. 27-30, 32 and 33.

Figure 32:
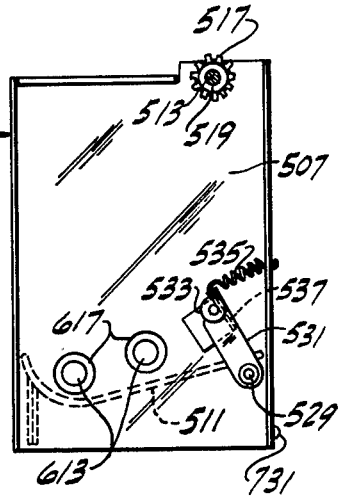
FIG. 32 is a view in elevation of the right end of the elevator.
Figure 33:
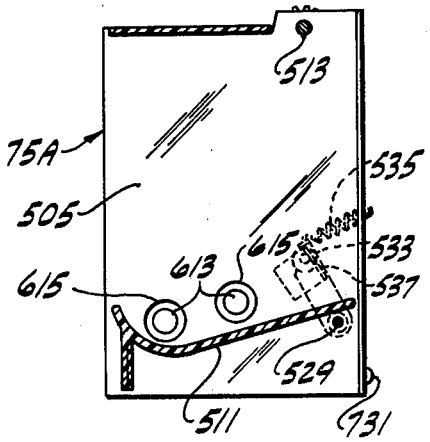
FIG. 33 is a section of the elevator on line 33—33 of FIG. 29.
Figure 34:
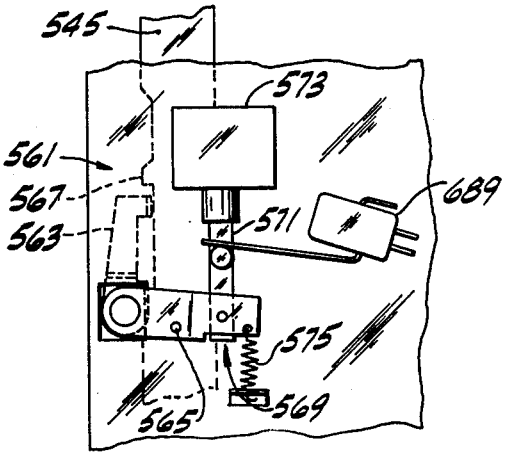
FIG. 34 is a view on line 34—34 of FIG. 31.
Figure 35:
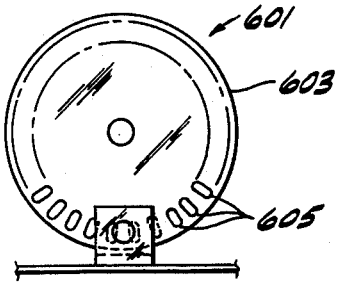
FIG. 35 is a section on line 35—35 of FIG. 31.
Figure 36:
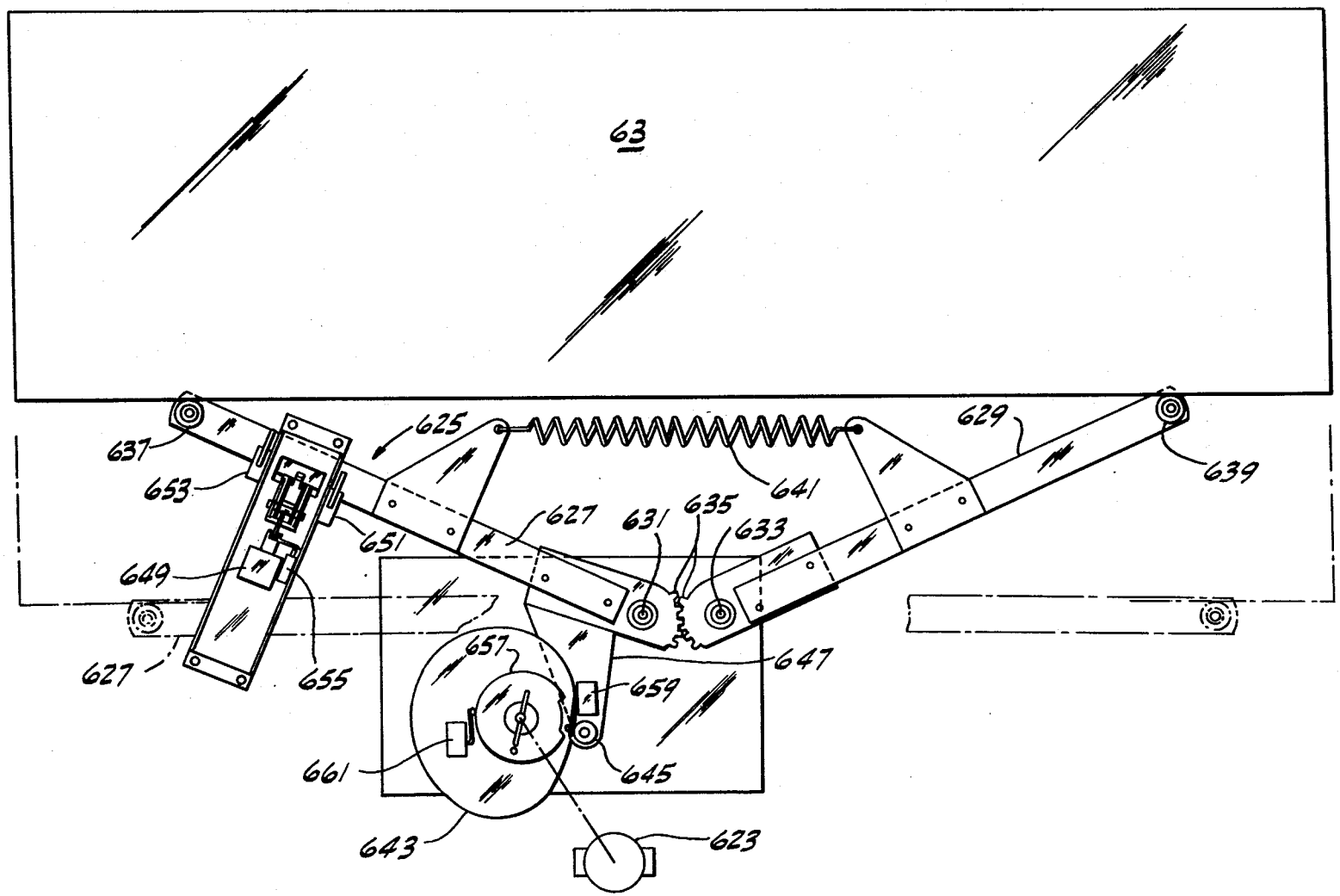
FIG. 36 is a view showing means for opening and closing the delivery door of the second embodiment.

A shaft 529 extends lengthwise of the elevator 75A underneath the tray 511, being journalled adjacent its ends in the elevator end plates 505 and 507. Secured on the right end of this shaft (on the outside of the plate 507) is a crank arm 531 carrying a roller 533 constituting a stop-engaging member at its free end. The crank arm is biased by a spring 535 to the retracted position against a stop 537 on the elevator end plate 507 in which it is shown in FIG. 32, wherein the crank arm extends upwardly from the axis of shaft 529 inclined toward the front of the vendor. In this retracted position of the arm 531, the roller 533 is generally vertically in line with the shaft 513 at the right end of the elevator. The roller 533, in moving up and down with the elevator, rolls in the track 521 on the plate 503. A similar crank arm and roller is provided on the left end of the shaft on the outside of the end plate 505 at the left end of the elevator, with this left-end roller rolling on the track 521 on the plate 525 at the left side of the passage 73.

Figure 28:
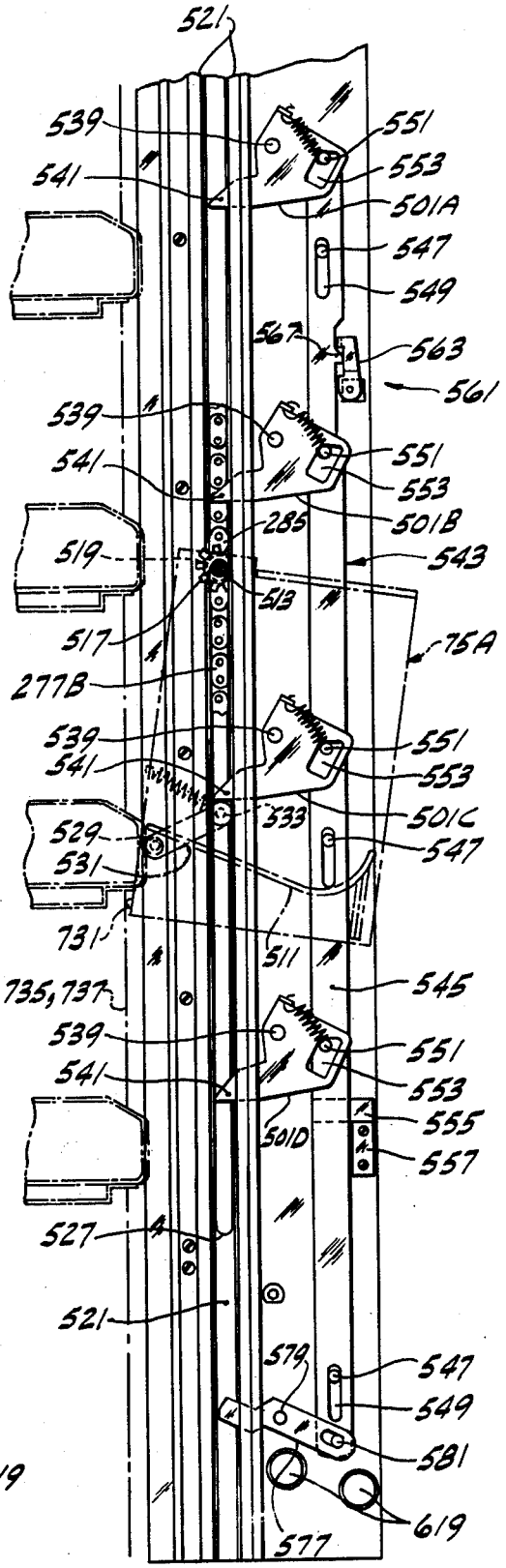
FIG. 28 is a view similar to FIG. 27 showing the stops in their stop position.
Figure 29:
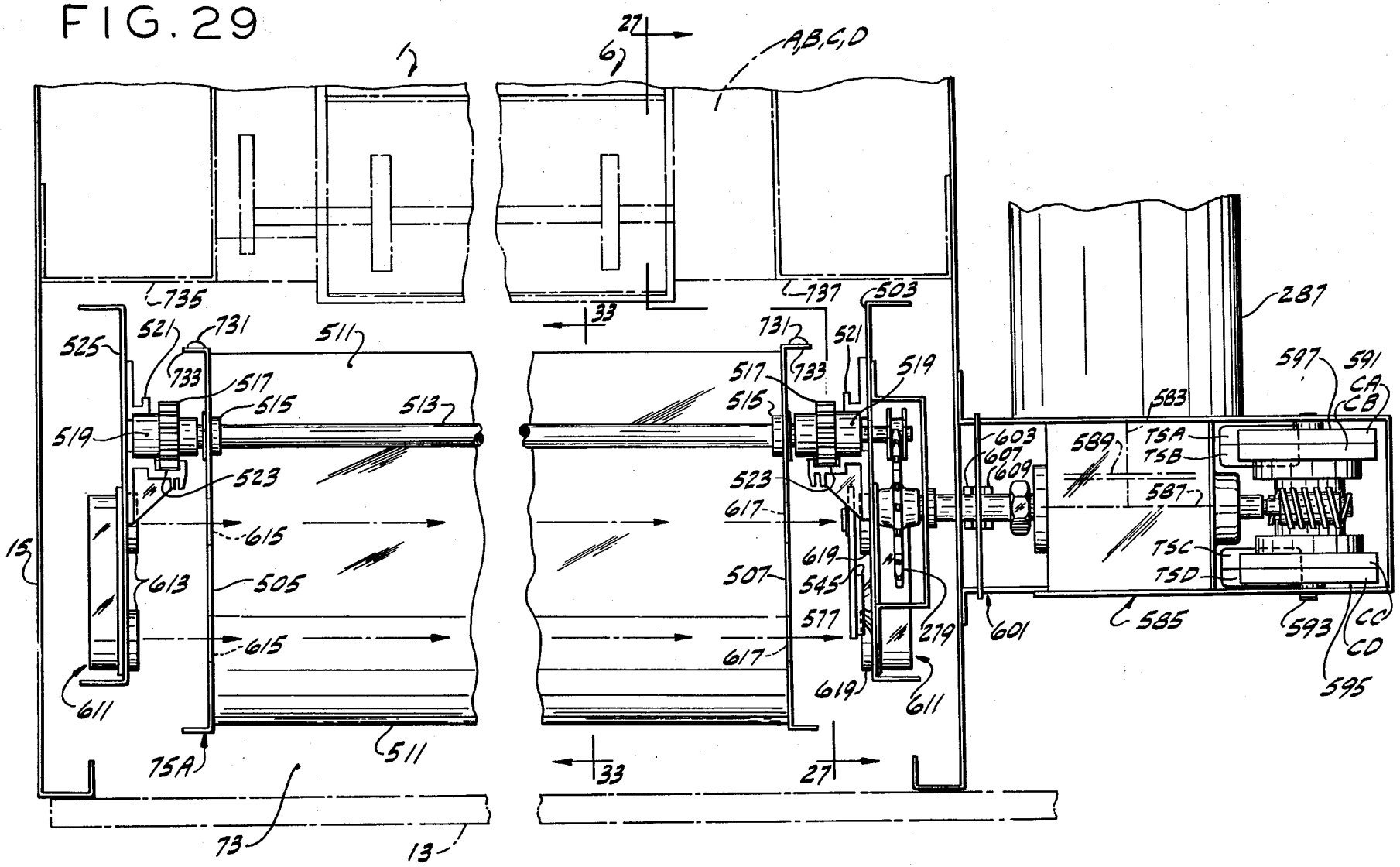
FIG. 29 is a view in plan of the elevator and associated mechanism of the second embodiment, with the top of the elevator broken away.
Figure 30:
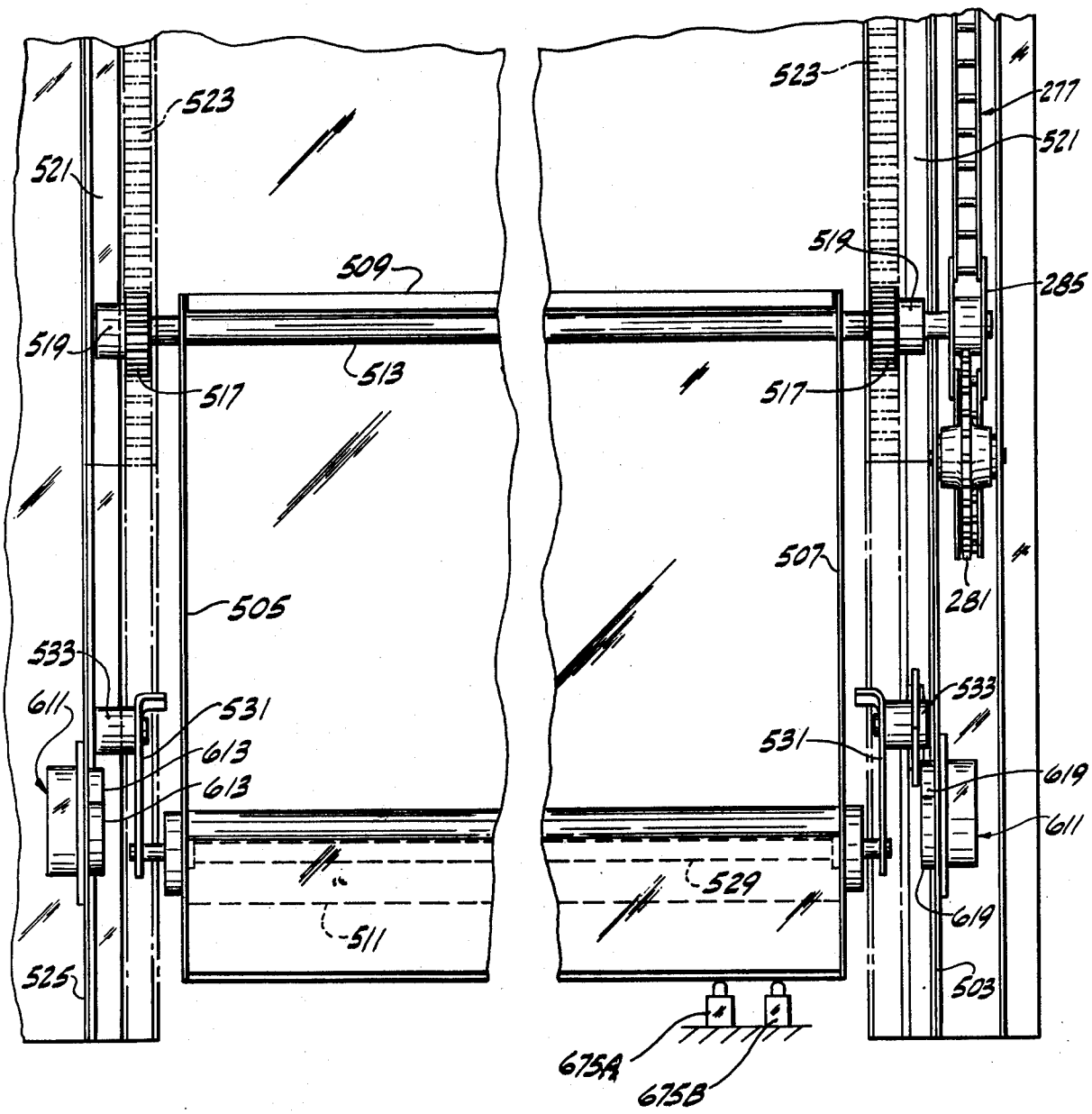
FIG. 30 is a view in front elevation of the elevator.
Figure 31:
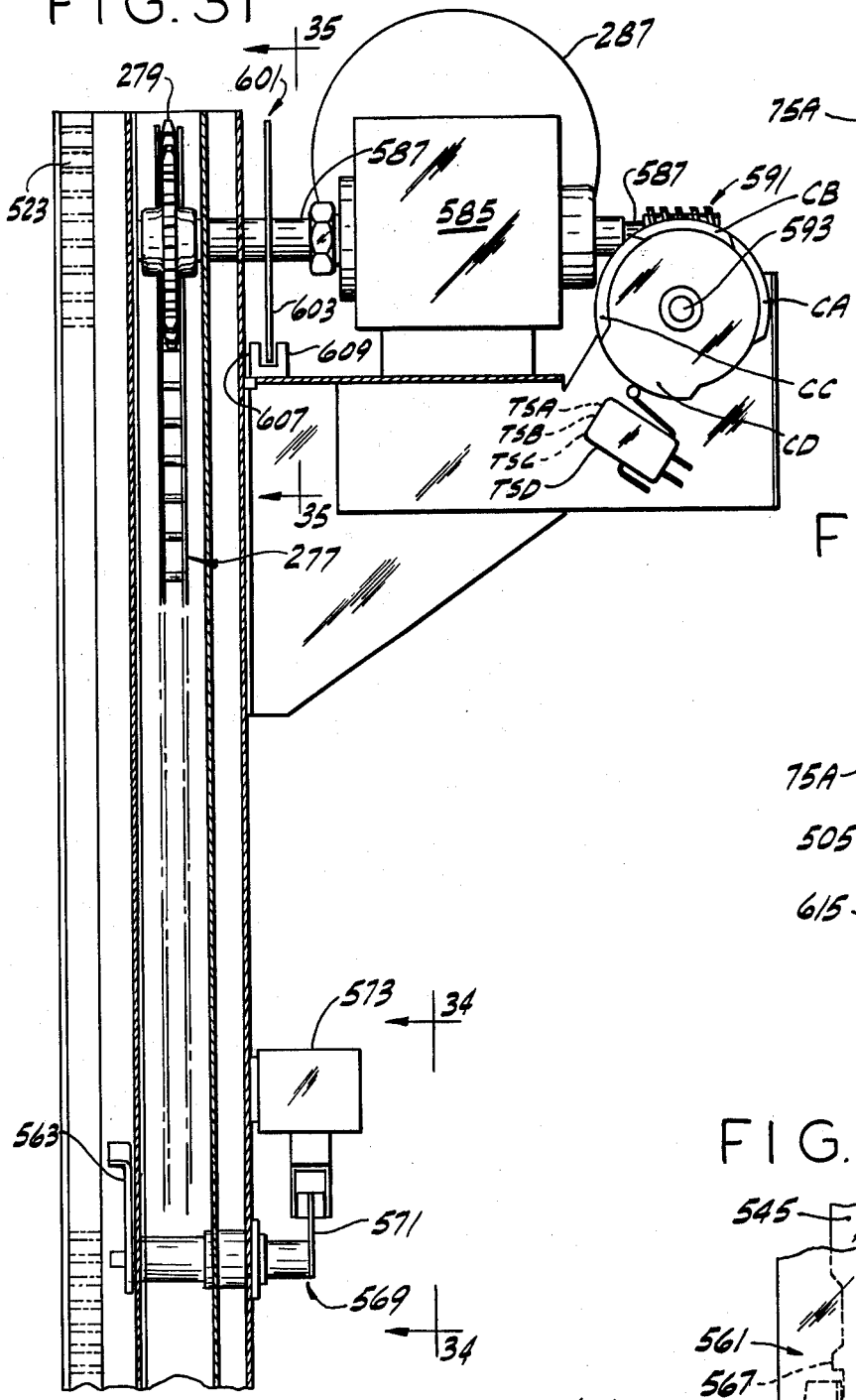
FIG. 31 is a view in front elevation of the upper part of FIG. 27 showing the motor for driving the elevator of the second embodiment and the solenoid of a latch for latching the stops of the second embodiment in their retracted position.

Each of the four elevator stops 501A – D is constituted by a lever formed of sheet metal pivoted as indicated at 539 on the inside of plate 503 ("inside" meaning the side toward the passage 73) for swinging movement between its retracted position, wherein the rearward end 541 of the stop is clear of the path of the roller 533 (FIG. 27), and its stop position wherein the rearward end 541 of the stop is directly in the path of the roller 533 (FIG. 28). Means indicated generally at 543 is provided for retaining the stops in their retracted position (FIG. 27) and for effecting movement of the stops (all of them) to their stop position (FIG. 28) as the elevator 75A (more particularly the tray 511) approaches the level of a tier including a selected dispenser, whereby the stop corresponding to that tier will stop the elevator at the level of that tier (more particularly, with the tray at the level of that tier). More particularly, means 543 is operable to effect movement of the stops to their stop position after the roller 519 at the right end of shaft 513 has travelled up past the level of the stop for the tier including a selected dispenser and before the stop-engaging roller 533 reaches the level of that tier and after roller 533 has passed the level of the stop for any tier below the level of that tier. Thus, assuming a dispenser in tier C has been selected, means 543 functions, as will appear, to effect movement of all the stops to their stop position when roller 519 on the right end of shaft 513, moving upwardly with the elevator, travels up past the level of stop 501C and when roller 533, also moving upwardly with the elevator, has passed the level of stop 501D but before roller 533 reaches the level of stop 501C.

The means 543 comprises a vertical shift bar 545 guided for up and down movement on the inside of plate 503 by means of pins 547 in vertical slots 549 in the bar and having pins 551 received in slots 553 in the stops 501A – D. The shift bar is biased downwardly by its own weight to its lower limit of travel, determined by engagement of a lug 555 on the bar with a stop 557 on plate 503, and in moving down to its lowered position swings the stops 501A – D to their stop position. It is adapted to be raised from its lowered position to the raised position in which it appears in FIG. 27 for retraction of the stops 501A – D, each of which is individually biased by a spring 559 to swing counterclockwise to its stop position (FIG. 28). Means indicated generally at 561 is provided for releasably latching the shift bar 545 in its raised position to hold the stops 501A – D in their retracted position, comprising a latch 563 pivoted at 565 on the plate 503 engageable with a lug 567 on the shift bar, and connected as indicated at 569 to the plunger 571 of a solenoid 573 mounted on the outside of plate 503. The latch is biased by a spring 575 to its latching position and is swung to its retracted position for releasing the shift bar to fall down on energization of the solenoid. The shift bar is also under control of the elevator via a lever 577 pivoted intermediate its ends at 579 on plate 503 having a pin and slot connection at one end as indicated at 581 with the lower end of the shift bar and engageable at its other end by the roller 533 at the right end of the elevator 75A when the elevator descends to its lowered home position to swing the lever 577 counterclockwise as viewed in FIG. 27 and raise the shift bar to its raised retracted position wherein it becomes latched by the latch 573 to hold the stops 501A – D in their retracted position.

When the stops 501A – D are in their stop position of FIG. 28, each stop is adapted individually to swing counterclockwise toward its retracted position against the bias of the respective spring 559, as permitted by the respective slot 553, thereby enabling lowering of the elevator while the shift bar 545 is down in its FIG. 28 position. Thus, as the elevator is lowered, rollers 533 and 519, moving down with the elevator, may swing aside the stops and thus pass by the stops, which click back to their stop position, and which ultimately move to their retracted position when roller 533 swings lever 577 back to its FIG. 27 position and raises the shift bar.

In the second embodiment of the invention, the elevator motor 287 (which is reversible to run the elevator up and down) has its shaft connected as indicated at 583 to the input of a combination speed-reducing gear box and slip clutch unit 585, which is a conventional commercially available unit. The motor and box 585 are sold commercially as a unit. The upper sprocket 279 for the elevator drive chain 277 is secured on output shaft 587 of the box 585. The slip clutch, which is diagrammatically indicated at 589, is between the input and the output shaft. Thus, the chain is driven via the slip clutch. The output shaft 587, via a worm and worm-gear drive indicated at 591, also drives a cam shaft 593 carrying two cam members 595 and 597 which provide four cams, one for each of the four tiers 501A – 501D, these cams being designated CA – CD. These cams control four switches, one for each of the four tiers A – D, these switches being designated TSA – TSD. Cam CD is developed and phased to close switch TSD as the roller 533 on the elevator, in travelling upward, approaches the level of stop 501D (for the lowest tier D). Cam CC is developed and phased to close switch TSC when the roller 533 has travelled up past the level of stop 501D and as it approaches the level of stop 501C. Cam CB is developed and phased to close switch TSB when the roller 533 has travelled up past the level of stop 501C and as it approaches the level of stop 501B. Cam CA is developed and phased to close switch TSA when the roller 533 has travelled up past the level of stop 501B and as it approaches the level of stop 501A.

Means indicated generally at 601 is provided for sensing the speed of the output shaft 587 of the box 585. This comprises a disk 603 on the output shaft 587 between the box 585 and the sprocket 279 having a circular series of perforations 605 spaced at equal intervals around the disk adjacent its periphery. The disk extends between a light source 607 and photocell 609 of a sensor unit 611 for interception of the light from the source by the portions of the disk between the perforations and passage of the light from the source to the photocell through the perforations, the frequency of the resultant light pulses on the photocell being a function of the speed of the disk and the output shaft. This speed-sensing means is utilized to sense when the elevator has been stopped at the level of any tier by the stop 501 for that tier, and when the elevator motor 287 has come up to speed, as will appear.

The second embodiment of the vendor of this invention includes means 611 for sensing the presence of an article (a product) on the elevator tray 511 when the elevator is in its article delivery position at the delivery station (i.e., at the delivery level L), and means for disabling the elevator in response to the sensing means 611 sensing the presence of an article (a product) on the elevator tray at the delivery station, whereby the elevator is prevented from being moved up to any tier for receiving another article as long as a product remains on the elevator tray. This avoids the possibility of a product being delivered by a dispenser against a product on the elevator tray, as would be highly undesirable. The product sensing means comprises a pair of infrared lamps each designated 613 which are mounted at the left side of the passage 73 in position to direct two beams of infrared radiation through holes 615 in the left end panel 505 of the elevator and across the elevator just above the tray 511 through a pair of holes 617 in the right end panel 507 of the elevator to a pair of infrared sensors each designated 619 mounted in the cabinet at the right side of the passage 73. Thus, when the elevator descends to its delivery level at the delivery station behind the delivery door 63, two beams of infrared radiation are directed horizontally across the elevator from one end thereof to the other just above the tray 511, so as to detect whether or not there is a product on the tray. If there is, one or the other or both of the beams is intercepted, and one or the other or both of the infrared sensors 619 is deactivated. The means for disabling the elevator in response to this deactivation comprises what is termed a product sensor relay P (see FIG. 37B) adapted, on deactivation of either sensor 619, to be energized via a suitable control unit 621. Relay P has a set of normally closed contacts P1 which open on energization of the relay P to prevent a subsequent operation of the elevator, as will appear, until the product is removed from the elevator tray 511.

In the second embodiment of the invention, the delivery door 63 is adapted automatically to be opened under control of the relay P when the elevator 75A brings a product which has been dispensed from one of the dispensers onto the elevator down to the delivery level. For this purpose, a delivery door motor 623 (see FIGS. 36 and 37B) is provided, operable via suitable mechanism indicated generally at 625 (FIG. 36) for lowering the delivery door to open it and for raising it to close it. As will appear, the delivery door is automatically unlocked and opened when the elevator is lowered to its home position at the delivery station so that the purchaser may reach in via the delivery opening and obtain the article delivered by the elevator to the delivery station. As will also appear, the delivery door is automatically closed and locked in response to the article being removed, as distinguished from remaining open for a predetermined time interval and then being closed whether or not the product has been removed. The door 63 is slidable down from its closed position to its open position, and back up to its closed position. The mechanism 625 is operable to allow the door to slide down to its open position under the weight of the door, and to lift the door back up to its closed position. The precise detail of this mechanism is not critical; as illustrated generally in FIG. 36 it may comprises a pair of pivoted lift arms 627 and 629 adapted to swing up to lift the door and down to allow the door to slide down under its own weight. Arm 627 is pivoted at 631 adjacent one end referred to as its inner end; arm 629 is similarly pivoted at 633 adjacent its inner end. A gear segment 635 on the inner end of arm 627 meshes with a gear segment on the inner end of arm 629 to interconnect the arms for conjoint movement. The arms have rollers 637 and 639 at their outer ends supporting the door, the bottom of the door bearing down on these rollers. The arms are biased to swing up by a spring 641, and are adapted to be swung down for lowering the door by a cam 643 driven by motor 623 engaging a cam follower roller 645 on a bracket 647 on arm 627.

The cam 643 is so developed as to swing the arms 627 and 629 down for lowering the door to open it as the cam rotates through the first half of a one-revolution cycle, and to swing the arms up for raising the door to close it as the cam rotates through the second half of the one-revolution cycle. A solenoid operated latch is indicated at 649 for latching the arms in their raised position thereby to latch the door closed. A switch 651 is actuated by arm 627 just before the arm reaches its uppermost position and before latch 649 locks the door, and a switch 653 is actuated by arm 627 when it reaches its uppermost position and slightly after the latch 649 locks the door. A switch 655 is controlled by the latch to open when the latch is released, and to close when the latch is on (i.e., when the solenoid of the latch is energized). An auxiliary cam 657 rotatable with cam 643 controls switches 659 and 661, acting to throw the movable contactor of switch 659 down as shown in FIG. 37B when the delivery door motor starts, and to throw the movable contactor of switch 661 up when the cam has rotated through half a revolution. Switch 661 is ultimately reset to its FIG. 37B status when the cam rotates on beyond one-half a revolution and switch 659 is reset to its FIG. 37B status when the cam completes a revolution.

Figure 37A:
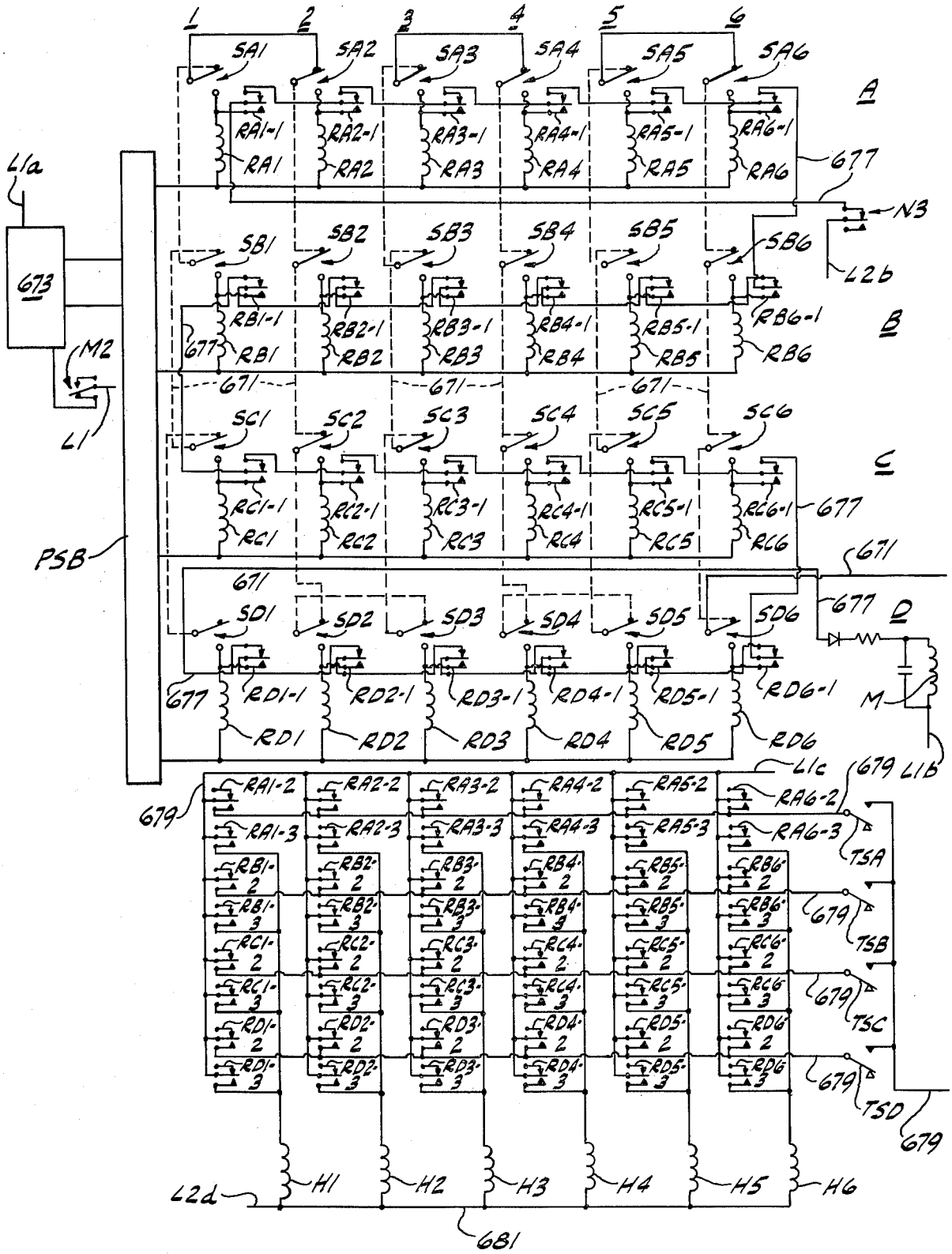
FIGS. 37A and B together constitute a diagram of the electrical circuitry of the second embodiment.
Figure 37B:
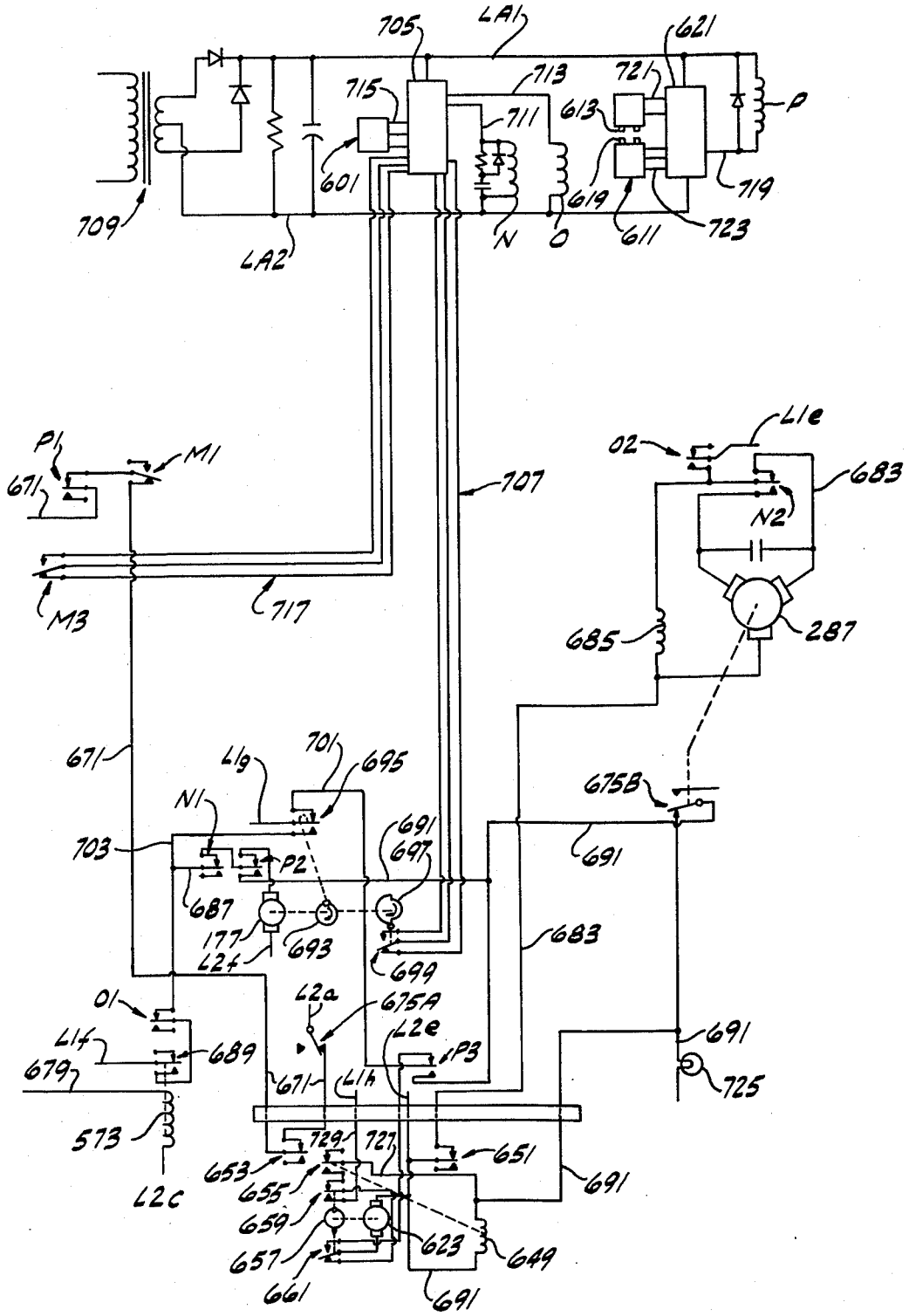

Now referring to FIGS. 37A and B showing the electrical circuitry of the second embodiment, 24 selection switches are shown for 24 dispensers arranged in a four-by-six matrix (four tiers A – D with six dispensers, 1 – 6, in each tier). These selection switches are designated SA1 – SA6 for the six dispensers in tier A, SB1 – SB6 for the six dispensers in tier B, SC1 – SC6 for the six dispensers in tier C, and SD1 – SD6 for the six dispensers in tier D. These selection switches are interconnected in a circuit indicated at 671 including, as shown in FIG. 37A, 24 selection relays, one for each of the selection switches, designated RA1 – RA6, RB1 – RB6, RC1 – RC6 and RD1 – RD6, and a coin control unit 673, and as shown in FIG. 37B contacts P1 of the product sensor relay P, contacts M1 of a relay M, a switch 653, and a switch 675A. Switch 675A is one that is closed when the elevator is down in its home position at the delivery station. At 657B is indicated a second elevator home switch which is closed when the elevator is down in its home position.

The circuit 671 is so wired that, when any one of the 24 selection switches SA1 etc. is actuated by a purchaser, the respective selection relay (e.g., RA1) is energized, provided that the appropriate amount in coin has been inserted (as determined by coin control unit 673), and further provided that contacts P1, M1, and switches 653 and 675A are all closed, Thus, if selection switch SC3, for example, is actuated, the appropriate amount in coin has been inserted, and P1, M1, 653 and 675A are all closed, a circuit is completed from a power line L1 at **L1*a* through the coin control unit 673, the coil of the selection relay RC3, selection switches SC3, SB3, SA3, SA4 – SD4, SD5 –SA5, SA6 – SD6, closed contacts P1 and M1 and closed switches 653 and 675A to a power line L2 at L2*a***.

Each of the 24 selection relays (RA1 etc.) has a No. 1 set of contacts designated RA1-1 etc. interconnected with the selection relays and with relay M in such manner in a circuit 677 that when all the selection relays are deenergized relay M is energized, and when any one of the selection relays is energized relay M is deenergized and a holding circuit is set up for the energized relay. The energization of relay M is from line L1 at L1*b* through all the upper contacts and movable contactors of the No. 1 sets of contacts of the selection relays (the movable contactors are normally closed on the upper contacts as shown in FIG. 37A) to line L2 at L2*b* including normally closed contacts N3 of a relay N. The latter controls the direction of movement of the elevator 75A (up or down) as will appear, and may be referred to as the elevator up/down relay. The holding circuit for any of the selection relays is from line L1 at L1*a* via the coin unit 673 and the lower contact and movable contactor of that selection relay and contacts N3 to line L2 at L2*b*. On deenergization of relay M, its contacts M1 open to break the selection switch circuit 671 for electrically locking out the selection switches from a second operation of the vendor for the same coin deposit.

Each of the 24 selection relays also has a No. 2 set of contacts, designated RA1-2, RA2-2, etc., connected between line L1 at L1*c* and line L2 at L2*c* with the cam-controlled tier switches TSA - TSD and the latch solenoid 573 (which may be referred to as the elevator stop solenoid) in a circuit 679. The interconnection here is such that when any one of the selection switches is actuated and the respective selection relay is thereby energized, and when the tier switch TSA - TSD for the respective tier is closed by the respective cam CA - CD, circuit 679 is completed from L1*c* to L2*c* through solenoid 573 to release the latch 563 for the shift bar 545, whereupon the elevator stops 501A - D all swing to their stop position (see FIG. 28). Thus, for example, when selection switch SC3 is actuated, and when tier switch TSC is closed by its cam CC, circuit 679 is completed via contacts RC3-2 to energize the solenoid 573 to bring about the movement of all four of the elevator stops 501A - 501D to their FIG. 28 stop position. By reason of the particular phasing of the cams CA - CD, this occurs when the roller 519 at the right end of shaft 513 has travelled up past the level of stop 501C and the roller 533 has travelled up past the level of stop 501D and before the roller 533 reaches the level of stop 501C.

Each of the 24 selection relays also has a No. 3 set of contacts, designated RA1-3, RA2-3, etc., connected between line L1 at L1*c* and line L2 at L2*d* with solenoids H1 - H6 corresponding to the solenoids H of the first embodiment in a circuit 681. The interconnection here is such that when any one of the selection switches is actuated and the respective selection relay is thereby energized, the respective H solenoid is energized to set up the control on the elevator 75A for the respective column 1 - 6 to actuate the respective dispenser when the elevator reaches the level of the tier including this dispenser. Thus, for example, when selection switch SC3 is energized, relay contacts RC3-3 close to energize solenoid H3 for column 3.

As shown in FIG. 37B, the elevator motor 287 (shown as a reversible permanent-split capacitor single-phase a.c. motor) is connected between power line L1 at L1*e* and line L2 at L2*e* in a circuit 683 including normally open contacts 02 of relay 0, the set of contacts N2 of relay N, and switch 651 (which is closed when the delivery door is closed and locked). The set N2 is a set of double-throw contacts which, when its movable contactor is normally up as shown (when relay N is deenergized), sets up circuit 683 for operating the elevator motor in a direction for driving the elevator up (forward direction) and which, when relay N is energized and the movable contactor of N2 is down, sets up circuit 683 for operating the elevator motor in the reverse direction for driving the elevator down. The elevator motor is of a type having a solenoid-operated brake, the solenoid for this being indicated at 685. Relay 0 controls the starting and stopping of the elevator motor for running in either direction, and may be referred to as the elevator run relay.

In the second embodiment, the motor for operating the 24 dispensers is the same as in the first embodiment, and is again designated 177. It is connected between line L1 at L1*f* and line L2 at L2*f* in a circuit 687 including a normally open switch 689 which is closed by the elevator stop solenoid 573 when the latter is energized, normally closed contacts 01 of relay 0, normally closed contacts N1 of relay N, and a double-throw set of contacts P2 of relay P. The movable contactor of set P2 is normally up as shown in FIG. 37B in circuit 687, and closes downward when relay P is energized to connect into a circuit 691. The vend motor 177 drives a first cam 693 controlling a switch 695 and a second cam 697 controlling a switch 699.

Switch 695 is a double-throw switch having its movable contactor interconnected with line L1 at L1*g*, closed upward when cam 693 is in its home position to deliver power from line L1 to a circuit 701, and closed downward when cam 693 rotates forward from its home position to deliver power from line L1 at L1*g* via a line 703 to line 687 to power the vend motor via contacts N1 and P2. This provides a holding circuit for motor 177 when the contacts of switch 689 and contacts 01 open. Switch 699 is a double-throw switch interconnected with an electronic control unit 705 as indicated at 707. The movable contactor of switch 699 is down when cam 697 is in its home position, moves up when cam 697 rotates forward from its home position, moves down again when cam 697 has rotated through half of a one-revolution cycle and stays down for the second half of the one-revolution cycle.

The electronic control unit 705 is connected across lines LA1 and LA2 of a power circuit supplied from the secondary of a transformer 709. It controls relays N and O, N being interconnected between the control unit and line LA2 as indicated at 711, and O being interconnected between the control unit and line LA2 as indicated at 713. The control unit is itself controlled by the elevator speed-sensing means 601 with which it is interconnected as indicated at 715, by switch 699, and by double-throw contacts M3 of relay M with which it is interconnected as indicated at 717. The circuitry is such that when relay M is deenergized (on making a selection), contacts M3 are thrown to transmit a signal to the control unit 705 which actuates the control unit to energize relay O for a brief interval, e.g., about ½ second. Contacts O2 of relay O thereupon close to energize the elevator motor 287 which, with relay N deenergized and the movable contactor of its contacts N2 up as shown in FIG. 37B, runs in forward direction to start the elevator 75A moving up. Assuming the motor 287, in the normal course of events, comes up to speed within the stated ½ second interval, sensor 601 functions via control 705 to maintain relay O energized to continue energization of the elevator motor 287 after the ½ second interval so that the elevator continues its upward travel until arrested by one of the stops 501A – D.

The circuitry is also such that when the movable contactor of switch 699 is moved down by cam 697 when the latter has rotated through half a revolution from its home position, it transmits a signal to the control 705 which actuates the control to energize both relays N and O for a brief interval, e.g., about ½ second. With relay N energized, the movable contactor of contacts N2 is thrown down for reversing the elevator motor 287, and with relay O energized, the motor is energized to start the elevator 75A moving down. Assuming the motor, in the normal course of events, comes up to speed within the stated ½ second interval, sensor 601 functions via control 705 to maintain relays N and O both energized after the ½ second interval so that the elevator continues to travel on down to its home position (its article delivery position at the delivery level). When the elevator stops in its home position, disk 603 of the motion sensor 601 stops and the motion sensor thereupon acts via control 705 to deenergize relays N and O.

It will be observed that when switch 699 is actuated by cam 697 when this cam has rotated through one-half a cycle, and relay N is thereupon energized, contacts N1 open to deenergize the vend motor 177. The dispensing of an article occurs during this first half of a revolution of cam 697, i.e., during the first half of the vend motor cycle. The vend motor stops at one-half its cycle for an interval during which the elevator comes down, and then completes its cycle after the elevator has stopped. The reason for this is to have only one motor, the vend motor or the elevator motor, running and drawing power at one time.

The control 621 for the product sensor relay P is connected across lines L1A and L2A. Relay P is connected between line L1A and the control is indicated at 719, and infrared lamps 613 and sensors 619 are interconnected with control 621 as indicated at 721 and 723. When the elevator 75A comes down to its home position with an article in the tray 511, one or the other or both of sensors 619 is deactivated (by reason of one or both of the infrared beams being cut off by the article on the tray) and control 621 thereupon functions to energize the relay P. On energization of relay P, contacts P1 open to disable the selection circuit and indirectly the elevator until the article is removed from the tray, contacts P2 are thrown (downwardly) to energize circuit 691, and a third set of contacts P3 of relay P are also thrown (downwardly as illustrated in FIG. 37B).

Circuit 691 includes the elevator home switch 675B and a lamp 725 referred to as the "Remove Product" light (which lights up when the elevator comes down with an article on the tray 511 to signal the purchaser to remove the article). Circuit 691 also includes the delivery door latch solenoid 649, the arrangement being such that when the elevator comes down with an article in the tray 511, whereby relay P is energized and contacts P2 are actuated (downwardly), solenoid 649 is energized from line L1 at L1*g* via 703, contacts N1 (which are now closed), contacts P2 (which are closed downward) and circuit 691 to line L2 at L2*e*.

The delivery door motor 623 is connected in a circuit 727 between circuit 691 and line L2 at L2*e* including switches 655, 659 and 661 with the arrangement such that when circuit 691 is energized with attendant energization of solenoid 649 and closure of switch 655, circuit 727 is completed to start the door motor 623 running to open the delivery door 63. As soon as the motor starts, cam 657 throws switches 659 and 661 to complete a holding circuit 729 from line L1 at L1*h* for motor 623 to hold it in operation for a half revolution of cam 643 to open the delivery door. This results from the movable contactor of switch 659 being actuated downwardly when cam 657 starts rotating from its home position. Then, when it has rotated through half a revolution, it throws the movable contactor of switch 661 upwardly to break the holding circuit. Circuit 701, powered from line L1 at L1*g* when the movable contactor of switch 695 is up, includes contacts P3 of relay P, switch 661 and motor 623 and leads to line L2 at L2*e*, with the arrangement such that motor 623 is energized when switch 695, contacts P3 and switch 661 are all closed up.

Operation of the second embodiment of the vendor of this invention is as follows:

As in the first embodiment, the elevator 75A is normally down in its lowered position at the delivery level (at the delivery station) behind the delivery door 63, which is in its raised, closed position, and latched in its closed position by the solenoid-actuated delivery door latch 649. Operation is initiated by the customer depositing coin in the coin slot 57 in appropriate amount, and making a selection by actuating the selection switch (SA1 etc.) corresponding to the tier (A – D) and column (1 – 6) holding the product he has selected for purchase via viewing through the window in the front door of the cabinet.

Assuming for purposes of illustration that the customer has selected for purchase the item he sees at the forward end of the No. 3 dispenser in tier C (i.e., the C/3 dispenser), he will actuate the selection switch SC3. Now, assuming that all the conditions for operation subsist (i.e., deposit of coin in appropriate amount, contacts P1 and M1 and switches 653 and 675A closed), actuation of selection switch SC3 results in energization of the associated selection relay RC3, from line L1 at L1*a* via the coin control unit 673, the movable contactor of the selection switch SC3 closed down on the lower contact of SC3, switches SB3, SA3, SA4 – SD4, SD5 – SA5, SA6 – SD6 and line 671 via closed contacts P1 and M1 and closed switches 653 and 675A to line L2 at L2*a*. On energization of the selection relay RC3, its contacts RC3-1, RC3-2 and RC3-3 are actuated. On action of contacts RC3-1, relay M is deenergized to open its contacts M1 and M2 (the latter functioning to drop out coin return electromagnets in the coin control unit 673), and to actuate its contacts M3, and a holding circuit is set up for the selection relay SC3 via closed contacts N3. On closure of contacts RC3-2, power is supplied from line L1 at L1*c* via circuit 679 to the switch TSC for tier C in readiness for this switch to close. On actuation of contacts RC3-3, the horizontal solenoid H3 is energized to set up the clutch actuator for column 3 on the elevator 75A in the same manner as in the first embodiment.

On opening of relay contacts M1, circuit 671 is broken to cut off power to all the selection switches. On actuation of relay contacts M3, an elevator start signal is transmitted to the control 705. The latter thereupon functions to energize relay O for the above-noted interval of about ½ second. Contacts 02 of relay O close and, with the movable contactor of the set of contacts N2 of relay N (which is deenergized at this time) up as shown in FIG. 37B, the elevator motor 287 is energized via circuit 683 to run in its forward direction for raising the elevator.

The elevator motor 287, via the slip clutch 589 and shaft 587, drives the upper sprocket 279 for the chain 277 in clockwise direction as viewed in FIG. 27) to run the rearward reach 277B of the chain up to raise the elevator. Disk 603 rotates with the shaft 587, and the photocell 609 thereupon transmits pulses to the control 705 at a frequency which is a function of the speed of the shaft 587. The control 705 includes conventional commercially available means responsive to the pulses received from the photocell for sensing whether or not the shaft 587 and hence the elevator motor 287 have come up to speed within the control interval of about ½ second (which is within the time that it takes the elevator to travel up to the level of the lowermost tier, i.e. tier D) and, if it has, control 705 acts to maintain the relay O energized so that its contacts 02 remain closed, the elevator motor 287 thereby remaining in operation to drive the elevator up.

As the shaft 587 rotates and the elevator travels up, cams CA – CD rotate in phase with the elevator. Cam CD is developed and phased to close the tier switch TSD for tier D, i.e., the lowermost tier, after the right-hand roller 519 travels up past the level of the stop 501D (the lowermost stop) but before the right-hand roller 533 reaches the level of the stop 501D. However, since there is no power on switch TSD, this closure of switch TSD is simply incidental. Cam CC is developed and phased to close the tier switch TSC for tier C after the right-hand roller 519 has travelled up past the level of the stop 501C and after the right-hand roller 533 has travelled up past the level of the stop 501D but before it reaches the level of stop 501C. Since there is power on switch TSC (due to contacts RC3-2 being closed), when switch TSC closes solenoid 573 is energized to withdraw the latch 563 from the lug 567 on the shift bar 545, and the latter immediately drops down to swing all four of the stops 501A – D to their stop position on FIG. 28. This occurs after the right-hand roller 519, moving up with the elevator 75A, has travelled up past stop 501C and after the right-hand roller 533, also moving up with the elevator, has travelled up past stop 501D but before it reaches stop 501C. The result is that the right-hand roller 533 engages stop 501C (see FIG. 28) to stop this roller 533 from moving up any farther.

After the roller 533 is arrested by engagement with stop 501C, the elevator motor 287 continues in operation for an interval to continue to drive the rearward reach 277B of the chain 277 and the shaft 513 upwardly. As the shaft 513 continues to move upwardly, with upward movement of the right-hand roller 533 arrested by stop 501C, the arms 531 rock in clockwise direction from their normal position of FIG. 27 and the elevator is swung in clockwise direction as viewed in FIG. 28 about the axis of shaft 513 against the return bias of springs 535 on the arms 531 to the rearward position illustrated in FIG. 28 determined by the engagement of buttons 731 on rear flanges 733 of the elevator end plates 505 and 507 with forward-facing vertical surfaces 735 and 737 on the left side of the cabinet (corresponding to the left side 15 of the cabinet shown in FIG. 5) and the vertical partition in the cabinet (corresponding to the vertical partition 23 shown in FIG. 5).

The rearward swing of the elevator 75A corresponds to the rearward swing of the tray 257 of the first embodiment of the invention; when it swings rearward, the clutch operating roller 349 carried by the tray 511 for column 3 (corresponding to that on tray 257) which is in its operative position as a result of energization of solenoid H3 operates the clutch 169 for dispenser C/3 (as in the first embodiment). The rearward edge of the tray 511 is closely adjacent the forward end of the upper reaches 97A of the endless belt conveyors 97 in tier C. The elevator is positively jammed in its proper stopped and tilted position for tier C by reason of the engagement of the right-hand roller 533 with the stop 501C for tier C and the engagement, on tilting of the elevator, of the buttons 731 on the elevator with the surfaces 735 and 737. When the elevator jams, the elevator motor 287 may continue to run (for a brief interval) as permitted by the slip clutch 589 so as to protect the motor from burning out. The motor 287, however, is promptly deenergized when the elevator jams, this being effected by the stopping of the motion sensor disk 603 acting via the control 705 to deenergize relay O, thereby opening contacts 02 and cutting off power for the motor.

Now, with the elevator motor 287 deenergized the elevator 75A remains at the tier C level for the dispensing of the forward product from the C/3 dispenser on to the tray 511 of the elevator. Operation of the C/3 dispenser results from the engagement of the clutch for this dispenser (as previously described) and the energization of the vend motor 177 from line L1 at L1*f* via switch 689, and contacts O1, N1 and P2 to start the vend motor running. Switch 689 is closed on account of the elevator stop solenoid 573 having been energized, and contacts O1 and N1 are closed and the movable contactor of contacts P2 is up since relays O, N and P are all deenergized at this time. When the vend motor has started, cam 693 actuates switch 695 to complete the holding circuit for the vend motor from line L1 at L1*g* via 703 and 687 including contacts N1 and P2. Also, cam 697 actuates switch 699, but this has no effect at this time. However, when cam 697 completes a half-revolution, it deactuates switch 699 and this results in a signal being transmitted to the control 705 which thereupon functions to energize both of relays N and O for a brief interval (e.g., ½ second).

As a result of energizing relay N, its contacts N1 open to break the holding circuit 703 – 687, thereby deenergizing the vend motor to stop it at one-half cycle, within which delivery of the forward product from dispenser C/3 on to the tray 511 is completed. The reason for stopping the vend motor at this point is to avoid having it run while the elevator motor 287 runs to lower the elevator as will appear. Also as a result of energizing relay N, the movable contactor of contacts N2 is pulled down for elevator motor reversal and, with contacts O2 closing upon energization of relay O, the elevator motor 287 is energized to start elevator 75A moving down. Once again, the motion sensor disk 603 rotates, and if the elevator motor comes up to speed within the control interval of about ½ second, control 705 functions to maintain both of relays N and O energized so that the elevator continues on down to its article delivery (home) position at the delivery station behind the delivery door 63. When the elevator stops in its home position (it may bottom out against fixed structure in the cabinet), disk 603 stops and this signals control 705 to deenergize relays N and O, thereby stopping the elevator motor 287. As soon as the elevator starts down, it is released from its tilted jammed position, and swings forward about the axis of shaft 513 back to its normal vertical position for travel in the passage 73. As the elevator comes down, the right-hand rollers 533 and 519 click past the stops 501C and 501D. Also as a result of energization of relay N, its contacts N3 open to deenergize the selection relay SC3 which had been energized, resulting in deactuation of the selection relay contacts SC3-1, SC3-2 and SC3-3. Deactuation of SC3-2 deenergizes the elevator stop solenoid 573 to allow re-latching of the shift bar 545 when it is ultimately raised to retract stops 501A – D (as will appear), and deactuation of SC3-3 deenergizes the solenoid H3.

When the elevator 75A, in moving down, reaches the article delivery position, it closes the two elevator home switches 675A and B. The right-hand roller 533 engages lever 577, swings it counterclockwise, and shifts the shift bar 545 up to reset the stops 501A – D, the bar being latched in its raised position by the latch 563. Also, when the elevator reaches its article delivery position, and assuming there is a product in the tray 511, one or both of the infrared beams from lamps 613 are intercepted by the product, with the result that the infrared sensors 619 signal the control 621 that there is a product in the tray 511 and control 621 thereupon functions to energize the product sensor relay P. On energization of relay P, its contacts P1 open, and the movable contactor of its contacts P2 is pulled down to energize the circuit 691 (switch 675B being closed), thereby energizing the lamp 725 to signal the purchaser to remove the product on the tray 511 and energizing the delivery door solenoid latch 649 to release the latter for the opening of the delivery door 63. When latch 649 is energized and released, it closes switch 655 thereby to start the operation of the delivery door motor 623 to open the delivery door. The initial energization of the delivery door motor 623 is through circuit 727 including switch 655 (closed), switch 659 having its movable contactor up and switch 661 having its movable contactor down. When motor 623 starts, cam 657 moves the movable contactor of switch 659 down and this sets up a holding circuit for motor 623 via 729 including the movable contactor of 659 down and the movable contactor of 661 down. Motor 623 continues in operation for a half-revolution cycle of cam 643 to open the delivery door, and is deenergized and stops when the door is opened via cam 657, having rotated through the first half of its one-revolution cycle, moving the movable contactor of switch 661 up.

With motor 623 deenergized and stopped at half-cycle, the delivery door 63 remains down in its open position for the removal of the product on the tray 511 by the purchaser. When the product is removed, both infrared beams from lamps 613 impinge on the infrared sensors 619, and the latter signal control 621 to deenergize the product sensor relay P. The movable contactor of contacts P2 thereupon returns up to complete circuit 703 – 687 (via switch 695, which is closed at the half-cycle of cam 693) for the vend motor 177. This runs to complete the second half of its cycle, being deenergized when cam 693 rotates through the second half of its one-revolution cycle and drives the movable contactor of switch 695 back up to its FIG. 37B position. When the movable contactor of contacts P2 returns up for the operation of the vend motor, it breaks circuit 691, thereby deenergizing the lamp 691 and the solenoid latch 649.

When the movable contactor of switch 695 is returned up, circuit 701 is energized from L1g and delivers power via contacts P3 (the movable contactor of which is now up since relay P is deenergized due to the removal of the product from the tray 511), and via switch 661 (the movable contact of which is now up) to the delivery door motor 623. This restarts motor 623 to close the delivery door 63. The motor 623 is then maintained in operation for the second half of the cycle to rotate the delivery door cam 643 through the second half of its cycle for closing the door by reason of cam 657 acting to move the movable contactor of switch 661 back down on to its lower contact to complete circuit 729 for the motor via switch 659 (the movable contactor of which is down) and switch 661. Then, when cam 657 completes its cycle, the movable contactor of switch 659 is moved back up to open the circuit and deenergize the motor 623 with the delivery door 63 back in its closed position.

As the delivery door 63 returns to its closed position, switch 651 is returned to its normal open position just before the door is latched closed by the solenoid latch 649. Then, slightly after the latch has acted to latch the door in its closed position, switch 653 is returned to its closed position. This completes the reset of the apparatus for the next operation.

The operation of the second embodiment of the invention on operation of any one of the selection switches other than SC3 is similar to and will be readily understood from the above. Thus, when any of selection switches SD1 – SD6 is actuated, the operation is similar except that power is directed to the respective horizontal solenoid and to the tier switch TSD, and when switch TSD is closed by cam CD after the right-hand roller 519 has travelled up past the level of stop 501D and before the right-hand roller 533 reaches the level of stop 501D, the shift bar 545 is released for movement of the stops 501A – D to their stop position, whereupon stop 501D stops the elevator at tier D and the selected dispenser in tier D is actuated. When any selection switch for tier C other than SC3 is actuated, the operation is similar except that power is directed to the respective horizontal solenoid H1, H2, H4, H5 or H6, and when the elevator is stopped at the C level by stop 501C, the selected dispenser in tier C is actuated. When any of selection switches SB1 – SB6 is actuated, the operation is similar except that power is directed to the respective horizontal solenoid and to the tier switch TSB, and when switch TSB is actuated by cam CB after the aforesaid roller 519 has travelled up past the level of stop 501B and after the aforesaid roller 533 has passed the level of stop 501C but before it reaches the level of stop 501B, the shift bar 545 is released for movement of the stops to their stop position, whereupon stop 501B stops the elevator at tier B and the selected dispenser in tier B is actuated. When any of selection switches SA1 – SA6 is actuated, the operation is similar except that power is directed to the respective horizontal solenoid and to the tier switch TSA, and when switch TSA is actuated by cam CA after the aforesaid roller 519 has travelled up past the level of stop 501A and after the aforesaid roller 533 has passed the level of stop 501B but before it reaches the level of stop 501A, the shift bar 545 is released for movement of the stops to their stop position, whereupon stop 501A stops the elevator at tier A and the selected dispenser in tier A is actuated.

It will be observed that the elevator 75A of the second embodiment may be regarded as an article transfer means movable in the passage 73 for receiving an article from any one of the dispensers and thence to a position at the delivery station for delivery of the article to a purchaser, and that the sensing means 611 functions to sense the presence of an article on said article transfer means at the delivery station and to disable said transfer means in response to sensing means 611 sensing the presence of an article on said transfer means at the delivery station, whereby said transfer means is prevented from being moved to a position for receiving another article as long as an article remains on said transfer means. This results from relay P being energized when the article transfer means (the elevator) comes down to the delivery station with an article thereon (in the tray 511) and hence having its contacts P1 open. When the article is removed, relay P is deenergized, and its contacts P1 close so that a selection relay (RA1 etc.) may be energized when a selection switch (SA1 etc.) is actuated. In addition to controlling the operation of the elevator 75A to hold it out of operation as long as an article remains in the tray 511 at the delivery station, the sensing means 611 also functions to control the operation of the delivery door 63 for unlatching and opening of the door in response to arrival of the elevator at the delivery station with an article in the tray 511, and for closing and latching of the door in response to removal of the article from the tray. Thus, the door remains open until the article is removed (as distinguished from being held open for a predetermined time interval, and then closing whether or not the article has been removed).

It will also be observed that, in each of the two disclosed embodiments of the invention, the dispensers are arranged in columns located in side-by-side relationship and with the dispensers in each column located one above another, whereby each dispenser in effect has a vertical co-ordinate and a horizontal co-ordinate. Thus, in the first embodiment, the dispensers 71 are arranged in five columns 1 – 5 located side-by-side, with the dispensers in each column located one above another at the A – E levels. In the second embodiment, the dispensers are arranged in six columns 1 – 6 located side-by-side, with the dispensers in each column located one above another tat the A – D levels. The vertical co-ordinates of the dispensers are A, B, C, etc., and the horizontal co-ordinates are 1, 2, 3, etc. In each instance, the elevator (75 or 75A) extends throughout the width of the columns for receiving an article from any dispenser when the elevator is in the position corresponding to the vertical co-ordinate of said dispenser, the article coming on to the elevator at a position along the length of the elevator corresponding to the horizontal co-ordinate of said dispenser and in a vertical plane between the ends of the delivery opening 49. The elevator holds the article without moving it laterally relative to the cabinet, and carries it down in the said vertical plane to the delivery level at the delivery opening with the article visible through the windowed front of the cabinet in the course of its downward movement. In the first embodiment, the controls CA – CE constitute the vertical co-ordinate control means controlled by the switch means 77 for controlling operation of the elevator 75 to move the elevator to the vertical co-ordinate (A, B, etc.) of a selected dispenser. The controls C1 – C5 constitute horizontal co-ordinate control means controlled by the selector means for controlling operation of the drive means for the dispensers. In the second embodiment, the switches TSA – TSD and associated components constitute the vertical co-ordinate control means, and the horizontal co-ordinate control means comprises solenoids H1 – H6 and associated components.

It will be understood that the second embodiment is adapted to vend items at different prices. A price selection board is indicated at PSB, and there will be a plurality of lines corresponding to a predetermined number of price settings between the coin control unit 673 and this board, and a corresponding number of lines between the board and each tier of relays, as will be readily understood in the art.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An article vendor comprising:

a cabinet having a front, rear and sides with a delivery opening in the front at a delivery level;

a plurality of article dispensers in the cabinet above the delivery level each adapted to hold a row of articles to be vended extending in rear-to-front direction;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

said dispensers being arranged in tiers one above another with the dispensers in each tier located in side-by-side relationship;

the front of the cabinet being windowed for viewing at least the forward articles on the dispensers;

an elevator movable up and down in said passage, said elevator being adapted to occupy a lowered article delivery position at said delivery level for access by a purchaser to an article on the elevator via said delivery opening and being movable to a position at the level of any of said tiers for receiving an article from a dispenser of that tier;

selector means operable by a purchaser for selecting any one of the dispensers for dispensing the forward article therefrom;

means controlled by said selector means for moving the elevator to the level of the tier which includes the selected dispenser;

and means controlled by the selector means for operating the selected dispenser to discharge the forward article therefrom on to the elevator when the elevator is moved to the level of the tier which includes the selected dispenser;

the elevator then being lowered to its article delivery position so that the purchaser may obtain the selected article from the elevator via said delivery opening;

the elevator comprising a tray for receiving the article discharged from a dispenser, the tray being movable up and down in said passage, and also movable rearward in said passage under control of said selector means from a forward position for up and down movement in said passage to a rearward position on reaching the level of the tier including the selected dispenser for receiving the article discharged from the selected dispenser.

2. An article vendor as set forth in claim 1 wherein said elevator moving means comprises means for raising the elevator from its article delivery position to the level of the tier which includes the selected dispenser and wherein said vendor has a series of controls for said elevator moving means, one for each tier, spaced vertically at intervals corresponding to the vertical spacing of the tiers and operable by said tray.

3. An article vendor as set forth in claim 2 wherein each of said controls comprises an elevator stop switch, and wherein the tray carries means for actuating the stop switch of a selected control when the tray is in its rearward position.

4. An article vendor as set forth in claim 3 wherein each of said controls comprises means for maintaining the tray in its forward position for causing the stop switch actuating means on the tray to by-pass the control without actuating the stop switch of the control, said selector means being operable to disable the by-pass means of the control for the tier which includes the selected dispenser to enable movement of the tray to its rearward position for actuation of the stop switch of that control as the elevator reaches that tier.

5. An article vendor as set forth in claim 4 wherein each by-pass means comprises a gate, each control comprises means for latching the gate in a by-pass position, and said switch-actuating means on the tray is movable over the gates.

6. An article vendor as set forth in claim 5 wherein each of said controls includes a solenoid for releasing the latching means, and the selector means is operable to actuate the solenoid of the control for the tier which includes the selected dispenser to release the gate of that control to enable movement of the tray to its rearward position for actuation of the stop switch of that control as the elevator reaches that tier.

7. An article vendor as set forth in claim 2 wherein the means for effecting operation of the selected dispenser comprises a series of dispenser operators on the tray, one for each column, and means operable by said selector means upon making a selection for actuating the dispenser operator for that column which includes the selected dispenser, said dispenser operator being operable to start the selected dispenser when the elevator is raised to the level of the tier which includes the selected dispenser and the tray moves to its rearward position.

8. An article vendor as set forth in claim 7 wherein the means for actuating the dispenser operators comprises a series of controls, one for each operator, mounted in the cabinet in stationary relationship with respect to the elevator, each control including a solenoid, the selector means being operable to actuate the control solenoid corresponding to the column including the selected dispenser.

9. An article vendor as set forth in claim 8 wherein each dispenser operator is carried by the tray for movement relative to the tray between a retracted position and an operative position, each dispenser operator, when in its operative position, being adapted to operate a selected dispenser upon rearward movement of the tray.

10. An article vendor as set forth in claim 9 having a drive for each dispenser including a clutch for each dispenser, each dispenser operator being operable when in its operative position to effect engagement of the clutch of the selected dispenser upon rearward movement of the tray.

11. An article vendor comprising:

a cabinet having a front, rear and sides with a delivery opening in the front at a delivery level;

a plurality of article dispensers in the cabinet above the delivery level each adapted to hold a row of articles to be vended extending in rear-to-front direction;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

said dispensers being arranged in tiers one above another with the dispensers in each tier located in side-by-side relationship;

the front of the cabinet being windowed for viewing at least the forward articles on the dispensers;

an elevator movable up and down in said passage, said elevator being adapted to occupy a lowered article delivery position at said delivery level for access by a purchaser to an article on the elevator via said delivery opening and being movable to a position at the level of any of said tiers for receiving an article from a dispenser of that tier;

selector means operable by a purchaser for selecting any one of the dispensers for dispensing the forward article therefrom;

means controlled by said selector means for moving the elevator to the level of the tier which includes the selected dispenser;

and means controlled by the selector means for operating the selected dispenser to discharge the forward article therefrom on to the elevator when the elevator is moved to the level of the tier which includes the selected dispenser;

the elevator then being lowered to its article delivery position so that the purchaser may obtain the selected article from the elevator via said delivery opening;

each dispenser comprising an endless conveyor having a generally horizontal upper reach carrying said row of articles spaced at intervals along its length, and means for driving each conveyor to index its said upper reach forward through an interval corresponding to the spacing of the articles for discharging the forward article on to the elevator and advancing the remainder of the articles one interval;

the elevator comprising a tray for receiving the article discharged from a selected conveyor, the tray being movable up and down in said passage and also movable rearward in said passage under control of said selector means from a forward position for up and down movement in said passage to a rearward position on reaching the level of the tier including the selected conveyor for receiving the article discharged from the upper reach of the selected conveyor.

12. An article vendor comprising:

a cabinet having a front, rear and sides with a delivery opening in the front at a delivery level;

a plurality of article dispensers in the cabinet each adapted to hold a row of articles to be vended extending in rear-to-front direction;

said dispensers being arranged in tiers one above another with a plurality of dispensers in each tier located in side-by-side relationship in the tier;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

a plurality of drive means in each tier, one for each dispenser in each tier, each drive means being connected to the feeding means of the respective dispenser;

the front of the cabinet being windowed for viewing at least the forward articles on the dispensers;

an elevator movable up and down in said passage, said elevator being adapted to occupy an article delivery position at said delivery level for access by a purchaser to an article on the elevator via said delivery opening and being movable to a position at the level of any of said tiers for receiving an article from a dispenser of that tier;

said elevator extending throughout the width of the tiers for receiving an article from any dispenser of any tier when at the level of that tier;

selector means operable by a purchaser for selecting any one of the dispensers for dispensing the forward article therefrom;

means controlled by said selector means for moving the elevator to the level of the tier which includes the selected dispenser;

means controlled by the selector means for operating the drive means of the selected dispenser to drive the feeding means of the selected dispenser to discharge the forward article therefrom on to the elevator when the elevator is moved to the level of the tier which includes the selected dispenser;

the elevator then being moved to its article delivery position so that the purchaser may obtain the selected article from the elevator via said delivery opening;

the delivery opening being below the lowermost tier and the elevator moving means comprising means for raising the elevator from its article delivery position at the level of the delivery opening below the lowermost tier to the level of the tier which includes the selected dispenser;

said vendor having a series of controls for said elevator moving means, one for each tier, spaced vertically at intervals corresponding to the vertical spacing of the tiers and operable by the elevator;

each of said controls comprising an elevator stop switch, the elevator carrying means for actuating the stop switch of the control for the tier which includes the selected dispenser;

wherein each of said controls comprises means for causing the stop switch actuating means on the elevator to by-pass the control without actuating the stop switch of the control, said selector means being operable to disable the by-pass means of the control for the tier which includes the selected dispenser, whereby the stop switch actuating means actuates the stop switch of that control as the elevator reaches that tier.

13. An article vendor as set forth in claim 12 wherein the elevator comprises a member movable rearward from a forward position under control of the by-pass means to a switch-actuating position.

14. An article vendor as set forth in claim 13 wherein each by-pass means comprises a gate, each control comprises means for latching the gate in a by-pass position, and said member carries means movable over the gates.

15. An article vendor as set forth in claim 14 wherein each of said controls includes a solenoid for releasing the latching means, and the selector means is operable to actuate the solenoid of the control for the tier which includes the selected dispenser.

16. An article vendor comprising:

a cabinet having a front, rear and sides with a delivery opening in the front at a delivery level;

a plurality of article dispensers in the cabinet above the delivery level each adapted to hold a row of articles to be vended extending in rear-to-front direction;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

said dispensers being arranged in tiers one above another with the dispensers in each tier located in side-by-side relationship;

the front of the cabinet being windowed for viewing at least the forward articles on the dispensers;

an elevator movable up and down in said passage, said elevator being adapted to occupy a lowered article delivery position at said delivery level for access by a purchaser to an article on the elevator via said delivery opening and being movable to a position at the level of any of said tiers for receiving an article from a dispenser of that tier;

selector means operable by a purchaser for selecting any one of the dispensers for dispensing the forward article therefrom;

means controlled by said selector means for moving the elevator to the level of the tier which includes the selected dispenser;

and means controlled by the selector means for operating the selected dispenser to discharge the forward article therefrom on to the elevator when the elevator is moved to the level of the tier which includes the selected dispenser;

the elevator then being lowered to its article delivery position so that the purchaser may obtain the selected article from the elevator via said delivery opening;

the means for effecting operation of the selected dispenser comprising a series of dispenser operators on the elevator, one for each column, and means operable by said selector means upon making a selection for actuating the dispenser operator for that column which includes the selected dispenser, said dispenser operator being operable to start the selected dispenser when the elevator is raised to the level of the tier which includes the selected dispenser;

the means for activating the dispenser operators comprising a series of controls, one for each operator, mounted in the cabinet in stationary relationship with respect to the elevator;

the elevator comprising a member movable rearward from a forward position under control of the selector means, and said dispenser operators being carried by said member and movable relative to said member between a retracted position and an operative position, each dispenser operator, when in its operative position, being adapted to operate a selected dispenser upon rearward movement of said member.

17. An article vendor as set forth in claim 16 having a drive for the dispensers including a clutch for each dispenser, each dispenser operator being operable when in its operative position to engage the clutch of the selected dispenser.

18. An article vendor comprising:

a cabinet having a front, rear and sides with a delivery opening in the front at a delivery level;

a plurality of article dispensers in the cabinet each adapted to hold a row of articles to be vended extending in rear-to-front direction;

said dispensers being arranged in tiers one above another with a plurality of dispensers in each tier located in side-by-side relationship in the tier;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

a plurality of drive means in each tier, one for each dispenser in each tier, each drive means being connected to the feeding means of the respective dispenser;

the front of the cabinet being windowed for viewing at least the forward articles on the dispenser;

an elevator movable up and down in said passage, said elevator being adapted to occupy an article delivery position at said delivery level for access by a purchaser to an article on the elevator via said delivery opening and being movable to a position at the level of any of said tiers for receiving an article from a dispenser of that tier;

said elevator extending through the width of the tiers for receiving an article from any dispenser of any tier when at the level of that tier;

selector means operable by a purchaser for selecting any one of the dispensers for dispensing the forward article therefrom;

means controlled by said selector means for moving the elevator to the level of the tier which includes the selected dispenser;

and means controlled by the selector means for operating the drive means of the selected dispenser to drive the feeding means of the selected dispenser to discharge the forward article therefrom on to the elevator when the elevator is moved to the level of the tier which includes the selected dispenser;

the elevator then being moved to its article delivery position so that the purchaser may obtain the selected article from the elevator via said delivery opening;

each dispenser comprising an endless conveyor having an upper reach carrying said row of articles spaced at intervals along its length, each of said drive means being connected to drive a respective conveyor and being adapted to index the upper reach of said conveyor forward through an interval corresponding to the spacing of the articles for discharging the forward article on to the elevator and advancing the remainder of the articles one interval;

said conveyor having dividers spaced at said intervals on the outside thereof all along its length, said drive means indexing the conveyor forward a distance equal to the spacing of the dividers; and means for maintaining the dividers in position extending up from the upper reach of the conveyor as they travel forward with the upper reach, and for holding them toward the conveyor as they return rearward.

19. An article vendor comprising:

a cabinet having a front, rear and sides with a delivery opening in the front at a delivery level;

a plurality of article dispensers in the cabinet each adapted to hold a row of articles to be vended extending in rear-to-front direction;

said dispensers being arranged in tiers one above another with a plurality of dispensers in each tier located in side-by-side relationship in the tier;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

a plurality of drive means in each tier, one for each dispenser in each tier, each drive means being connected to the feeding means of the respective dispenser;

the front of the cabinet being windowed for viewing at least the forward articles on the dispensers;

an elevator movable up and down in said passage, said elevator being adapted to occupy an article delivery position at said delivery level for access by a purchaser to an article on the elevator via said delivery opening and being movable to a position at the level of any of said tiers for receiving an article from a dispenser of that tier;

said elevator extending throughout the width of the tiers for receiving an article from any dispenser of any tier when at the level of that tier;

selector means operable by a purchaser for selecting any one of the dispensers for dispensing the forward article therefrom;

means controlled by said selector means for moving the elevator to the level of the tier which includes the selected dispenser;

and means controlled by the selector means for operating the drive means of the selected dispenser to drive the feeding means of the selected dispenser to discharge the forward article therefrom on to the elevator when the elevator is moved to the level of the tier which includes the selected dispenser;

the elevator then being moved to its article delivery position so that the purchaser may obtain the selected article from the elevator via said delivery opening;

each dispenser comprising an endless conveyor having an upper reach carrying said row of articles spaced at intervals along its length, each of said drive means being connected to drive a respective conveyor and being adapted to index the upper reach of said conveyor forward through an interval corresponding to the spacing of the articles for discharging the forward article on to the elevator and advancing the remainder of the articles one interval;

each conveyor comprising a series of plates connected together end-to-end to form an endless belt, each plate being formed of plastic and having grooves extending transversely thereof from one side to the other forming integral transverse hinges at the grooves and subdividing the plate into panels between the hinges with the plate adapted to flex at the hinges, each plate having complementary end members formed for interconnection of one end of each plate with the complementary end of the next plate in the series.

20. An article vendor as set forth in claim 19 wherein the complementary members are formed for a snap fit of one end of each plate with the complementary end of the next plate.

21. An article vendor as set forth in claim 19 wherein each conveyor has sprockets around which the endless belt is trained, said sprockets having grooves spaced at equal intervals therearound, and the plates having integral formations on the inside faces thereof spaced at equal intervals along the length thereof and engageable in the grooves of the sprockets.

22. An article vendor as set forth in claim 19 wherein each conveyor has dividers at the interconnected ends of the plates.

23. An article vendor comprising:

a cabinet having a front, rear and sides with a delivery opening in the front at a delivery level;

a plurality of article dispensers in the cabinet each adapted to hold a row of articles to be vended extending in rear-to-front direction;

said dispensers being arranged in tiers one above another with a plurality of dispensers in each tier located in side-by-side relationship in the tier, each dispenser in each tier being individually operable independently of the other dispensers in the tier;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

a plurality of drive means in each tier, one for each dispenser in each tier, each drive means being connected to the feeding means of the respective dispenser;

the front of the cabinet being windowed for viewing at least the forward articles on the dispensers;

an elevator movable up and down in said passage, said elevator being adapted to occupy an article delivery position at said delivery level for access by a purchaser to an article on the elevator via said delivery opening and being movable to a position at the level of any of said tiers for receiving an article from a dispenser of that tier;

said elevator extending throughout the width of the tiers for receiving an article from any dispenser of any tier when at the level of that tier;

selector means operable by a purchaser for selecting any one of the dispensers for dispensing the forward article therefrom;

first means conditioned by said selector means for controlling the movement of the elevator to effect movement of the elevator to the level of the tier which includes the selected dispenser;

and second means conditioned by the selector means for controlling operation of the drive means for the dispensers to start the drive means of the selected dispenser driving the feeding means of the selected dispenser forward to discharge the forward article therefrom on to the elevator when the elevator reaches a position in proximity to the tier which includes the selected dispenser;

the elevator then being moved to its article delivery position so that the purchaser may obtain the selected article from the elevator via said delivery opening.

24. An article vendor as set forth in claim 23 wherein each dispenser comprises an endless conveyor having an upper reach carrying said row of articles spaced at intervals along its length, each of said drive means being connected to drive a respective conveyor and being adapted to index the upper reach of said conveyor forward through an interval corresponding to the spacing of the articles for discharging the forward article on to the elevator and advancing the remainder of the articles one interval.

25. An article vendor as set forth in claim 24 wherein said conveyor has dividers spaced at said intervals on the outside thereof all along its length, said drive means indexing the conveyor forward a distance equal to the spacing of the dividers.

26. An article vendor as set forth in claim 25 wherein the drive means comprises a gear train including change gear means for establishing the conveyor index distance as the distance between dividers.

27. An article vendor as set forth in claim 23 wherein the delivery opening is below the lowermost tier and the elevator moving means comprises means for raising the elevator from its article delivery position at the level of the delivery opening below the lowermost tier to the level of the tier which includes the selected dispenser and wherein said vendor has a series of controls for said elevator moving means, one for each tier, spaced vertically at intervals corresponding to the vertical spacing of the tiers and operable by the elevator.

28. A vendor as set forth in claim 23 having means for effecting operation in unison of the drive means for at least one pair of two side-by-side dispensers in at least one tier.

29. A vendor as set forth in claim 23 having means for setting the apparatus for operation in unison of the drive means for at least one pair of two side-by-side dispensers in at least one tier in response to operation of the selector means for either dispenser of said pair, so that articles wider than one dispenser may be vended via said pair.

30. An article vendor comprising:

a cabinet having a front, rear and sides with a delivery opening in the front at a delivery level;

a plurality of article dispensers in the cabinet each adapted to hold a row of articles to be vended extending in rear-to-front direction;

said dispensers being arranged in tiers one above another with a plurality of dispensers in each tier located in side-by-side relationship in the tier;

the forward ends of the dispensers being spaced rearward from the front of the cabinet so that there is a passage between the front of the cabinet and the forward ends of the dispensers;

each dispenser comprising means for feeding the respective row of articles forward and discharging the forward article off the forward end of the dispenser;

a plurality of drive means in each tier, one for each dispenser in each tier, each drive means being connected to the feeding means of the respective dispenser;

the front of the cabinet being windowed for viewing at least the forward articles on the dispensers;

an elevator movable up and down in said passage, said elevator being adapted to occupy an article delivery position at said delivery level for access by a purchaser to an article on the elevator via said delivery opening and being movable to a position at the level of any of said tiers for receiving an article from a dispenser of that tier;

said elevator extending throughout the width of the tiers for receiving an article from any dispenser of any tier when at the level of that tier;

selector means operable by a purchaser for selecting any one of the dispensers for dispensing the forward article therefrom;

means controlled by said selector means for moving the elevator to the level of the tier which includes the selected dispenser;

and means controlled by the selector means for operating the drive means of the selected dispenser to drive the feeding means of the selected dispenser to discharge the forward article therefrom on to the elevator when the elevator is moved to the level of the tier which includes the selected dispenser;

the elevator then being moved to its article delivery position so that the purchaser may obtain the selected article from the elevator via said delivery opening;

said dispensers being further arranged in vertical columns with the dispensers in each column located one above another, the means for operating the drive means of the selected dispenser to drive the feeding means of the selected dispenser comprising a series of operators on the elevator, one for each column, and means operable by said selector means upon making a selection for actuating the operator for that column which includes the selected dispenser, each operator being operable to operate the drive means of the selected dispenser when the elevator is moved to the level of the tier which includes the selected dispenser.

31. An article vendor as set forth in claim 30 wherein the means for activating the said operators comprises a series of controls, one for each operator, mounted in the cabinet in stationary relationship with respect to the elevator.

32. An article vendor comprising:

an enclosure having a front with a delivery opening in the front at a delivery level;

a plurality of article dispensers in the enclosure each adapted to hold a row of articles to be dispensed extending in rear-to-front direction;

said dispensers being arranged in tiers one above another with a plurality of the dispensers in each tier located in side-by-side relationship in the tier, each dispenser in each tier being individually operable independently of the other dispensers in the tier;

the forward ends of the dispensers being spaced rearward from the front of the enclosure so that there is a passage between the front and the forward ends of the dispensers;

each dispenser comprising means for feeding the respective row of articles forward and discharging the forward article off the forward end of the dispenser;

a plurality of drive means in each tier, one for each dispenser in each tier, each drive means being connected to the feeding means of the respective dispenser;

an elevator movable up and down in said passage, said elevator being adapted to occupy an article delivery position at said delivery level for access to an article on the elevator via said delivery opening and being movable to a position at the level of any of said tiers for receiving an article from a dispenser of that tier;

said elevator extending throughout the width of the tiers for receiving an article from any dispenser of any tier when at the level of that tier;

selector means for selecting any one of the dispensers for dispensing the forward article therefrom;

first means conditioned by said selector means for controlling the movement of the elevator to effect movement of the elevator to the level of the tier which includes the selected dispenser;

and second means conditioned by the selector means for controlling operation of the drive means for the dispensers to start the drive means of the selected dispenser driving the feeding means of the selected dispenser forward to discharge the forward article therefrom on to the elevator when the elevator reaches a position in proximity to the tier which includes the selected dispenser;

the elevator then being moved to its article delivery position so that the selected article may be obtained from the elevator via said delivery opening.

33. An article vendor comprising:

an enclosure having a front with a delivery opening in the front at a delivery station;

a plurality of article dispensers in the enclosure each adapted to hold a row of articles to be vended extending to rear-to-front direction;

said dispensers being arranged in tiers one above another with the dispensers in each tier located in side-by-side relationship in the tier, each dispenser in each tier being individually operable independently of the other dispensers in the tier;

the forward ends of the dispensers being spaced rearward from the front of the enclosure so that there is a passage between the front and the forward ends of the dispensers;

each dispenser comprising means for feeding the respective row of articles forward and discharging the forward article off the forward end of the dispenser;

an elevator movable up and down in said passage, said elevator being movable to a position at the level of any of said tiers for receiving an article from any dispenser of that tier and then movable to a position for delivery of the article to a purchaser via said delivery opening;

said elevator extending throughout the width of the tiers for receiving an article from any dispenser of any tier when at the level of that tier;

selector means operable by a purchaser for selecting any one of the dispensers for dispensing the forward article therefrom;

first means controlled by said selector means for moving the elevator to the level of the tier which includes the selected dispenser comprising a vertical series of stops, one for each tier, spaced vertically at intervals corresponding to the vertical spacing of the tiers, each stop being movable from a retracted position clear of the elevator, for movement of the elevator to a tier including a selected dispenser, to a stop position wherein it is engageable by the elevator to bring the elevator to a stop at the level of the respective tier, and means for moving the stops to their stop position as the elevator approaches the level of a tier including a selected dispenser whereby the stop corresponding to that tier will bring the elevator to a stop at the level of that tier;

second means controlled by said selector means for operating the selected dispenser to discharge the forward article therefrom on to the elevator when the elevator is moved to the level of the tier which includes the selected dispenser;

the elevator then being moved to its article delivery position for delivery of the article to the purchaser;

the elevator having means for engaging a stop to bring the elevator to a stop, and said first means controlled by the selector means controlling said means for moving the stops to move them to their stop position before said stop-engaging means on the elevator reaches the level of the stop for the tier including a selected dispenser and after said stop-engaging means passes the level of the stop for the preceding tier.

34. An article vendor as set forth in claim 33 wherein the elevator comprises a tray for receiving the article discharged from a dispenser, the tray being movable up and down in said passage and also movable rearward in said passage from a forward position for up-and-down movement in said passage to a rearward position as it reaches the level of a tier including a selected dispenser for receiving the article discharged from the selected dispenser.

35. An article vendor as set forth in claim 34 wherein the tray is movable to its rearward position as it reaches the level of a tier including a selected dispenser by the engagement of the stop-engaging means on the elevator with the stop for that tier and continued movement of the elevator, and wherein the vendor has means against which the elevator jams upon said continued movement of the elevator for a limited distance.

36. An article vendor as set forth in claim 35 having a drive including a slip clutch for the elevator.

37. An article vendor as set forth in claim 33 wherein said delivery opening is below the level of the lowermost tier, wherein the article delivery position of the elevator is at the level of the delivery opening, wherein the elevator normally occupies its article delivery position and travels up to a tier including a selected dispenser from its said article delivery position, and wherein said means for moving the stops is operable to move them to their stop position before said stop-engaging means, in travelling up with the elevator, reaches the level of the stop for the tier including the selected dispenser and after said stop-engaging means travels up past the level of the stop for the next tier below.

38. An article vendor as set forth in claim 37 wherein the elevator comprises a tray for receiving the article discharging from a dispenser, wherein the means for moving the elevator comprises drive means movable up and down in the enclosure, wherein means is provided pivotally mounting the tray on said drive means for swinging of the tray from a forward position for up-and-down movement in said passage to a rearward position as it reaches the level of a tier including a selected dispenser for receiving the article discharged from the selected dispenser, said stop-engaging means being so mounted relative to the tray and said pivotal mounting means as to cause swinging of the tray to its said rearward position after the stop-engaging means has engaged a stop and the pivotal mounting means continues in upward movement by said drive means, and wherein the vendor has means against which the tray jams upon said continued upward movement of the tray for a limited distance.

39. An article vendor as set forth in claim 38 having a drive for said drive means including a slip clutch for slip in the drive when the tray has swung to its rearward position.

40. An article vendor as set forth in claim 39 having means for stopping said drive in response to stopping of said drive means when the tray has swung to its rearward position.

41. An article vendor comprising:

an enclosure having a front and a delivery station at the front;

a plurality of article dispensers in the enclosure each adapted to hold a row of articles to be vended extending in rear-to-front direction;

the forward ends of the dispensers being spaced rearward from the front of the enclosure so that there is a passage between the front and the forward ends of the dispensers;

each dispenser comprising means for feeding the respective row of articles forward and discharging the forward article off the forward end of the dispenser;

article transfer means movable in the passage to a position for receiving an article from any one of the dispensers and to a position at the delivery station for delivery of the article to a purchaser;

selector means operable by a purchaser for selecting any one of the dispensers for dispensing the forward article therefrom;

means controlled by the selector means for moving the transfer means to a position for receiving an article from a selected dispenser;

means for operating the selected dispenser to discharge the forward article therefrom on to the transfer means when the transfer means is moved to the position for receiving an article from the selected dispenser, the transfer means when being moved to the delivery station;

means for sensing the presence of an article on the transfer means, in the position of the article as delivered to the transfer means, when the transfer means is at the delivery station; and means for disabling the selector means from effecting movement of the transfer means away from the delivery station in response to said sensing means sensing the presence of an article on the transfer means at the delivery station when the transfer means reaches the delivery station, whereby the selector means is rendered ineffective to move the transfer means to a position for receiving another article and the transfer means remains at the delivery station as long as an article remains on the transfer means.

42. An article vendor comprising:

an enclosure having a front with a delivery opening in the front at a delivery station;

a plurality of article dispensers in the enclosures each adapted to hold a row of articles to be vended extending in rear-to-front direction;

said dispensers being arranged in tiers one above another with the dispensers in each tier located in side-by-side relationship in the tier, each dispenser in each tier being individually operable independently of the other dispersers in the tier;

the forward ends of the dispensers being spaced rearward from the front of the enclosure so that there is a passage between the front and the forward ends of the dispensers;

each dispenser comprising means for feeding the respective row of articles forward and discharging the forward article off the forward end of the dispenser;

an elevator movable up and down in said passage, said elevator being movable to a position at the level of any of said tiers for receiving an article from any dispenser of that tier and then movable to a position for delivery of the article to a purchaser via said delivery opening;

said elevator extending throughout the width of the tiers for receiving an article from any dispenser of any tier when at the level of that tier;

selector means operable by a purchaser for selecting any one of the dispensers for dispensing the forward article therefrom;

first means controlled by said selector means for moving the elevator to the level of the tier which includes the selected dispenser;

second means controlled by said selector means for operating the selected dispenser to discharge the forward article therefrom on to the elevator when the elevator is moved to the level of the tier which includes the selected dispenser;

the elevator then being moved to its article delivery position for delivery of the article to the purchaser;

means for sensing the presence of an article on the elevator, in the position of the article as delivered to the elevator, when the elevator is in its article delivery position; and means for disabling the selector means from effecting movement of the elevator in response to said sensing means sensing the presence of an article on the elevator when the elevator reaches said article delivery position, whereby the selector means is rendered ineffective to move the elevator to a position for receiving another article and remains in article delivery position as long as an article remains on the elevator.

43. An article vendor comprising:

a cabinet having a front, rear and sides with a delivery opening in the front at a delivery level;

a plurality of article dispensers in the cabinet above the delivery level each adapted to hold a row of articles to be dispensed extending in rear-to-front direction;

said dispensers being arranged in columns located in side-by-side relationship and with the dispensers in each column located one above another, whereby each dispenser has a vertical co-ordinate and a horizontal co-ordinate, each dispenser being individually operable independently of the other dispensers;

the forward ends of the dispensers being spaced rearward from the front of the cabinet so that there is a passage between the front and the forward ends of the dispensers;

each dispenser comprising means for feeding the respective row of articles forward and discharging the forward article off the forward end of the dispenser;

a plurality of drive means, one for each dispenser, each drive means being connected to the feeding means of the respective dispenser;

the delivery opening extending across the front of the cabinet generally throughout the width of the columns at a level below the lowermost dispensers;

the front of the cabinet being windowed above the delivery opening for viewing at least the forward articles on the dispensers;

an elevator movable up and down in said passage, said elevator being movable to a position corresponding to the vertical co-ordinate of any of said dispensers for receiving an article therefrom, and then movable to a position at the delivery level for delivery of the article;

said elevator extending generally throughout the width of the columns for receiving an article from any dispenser when the elevator is in the position corresponding to the vertical co-ordinate of said dispenser, the article coming on to the elevator at a position corresponding to the horizontal co-ordinate of said dispenser and in a vertical plane between the ends of the delivery opening, the elevator holding the article without moving it laterally relative to the cabinet, the elevator carrying the article on the elevator down in said plane to the delivery level at the delivery opening with the article visible through the windowed front of the cabinet in the course of its downward movement;

selector means for selecting any one of the dispensers for dispensing the forward article therefrom;

vertical co-ordinate control means controlled by said selector means for controlling operation of the elevator to move the elevator to a position corresponding to the vertical co-ordinate of a selected dispenser;

control means controlled by said selector means for controlling operation of the drive means for the dispensers to operate the drive means of the selected dispenser for driving the feeding means of the selected dispenser forward to discharge the forward article therefrom on to the elevator when the elevator is in the position corresponding to the vertical co-ordinate of the selected dispenser, and means operable in timed relation to said control means for effecting downward movement of the elevator to the delivery level for delivery of the article, with said downward movement starting immediately upon discharge of said forward article on to the elevator.

44. An article vendor as set forth in claim 43 wherein said means controlled by the selector means for controlling operation of the drive means for the dispensers comprises horizontal co-ordinate control means operable by the selector means on making a selection to program in the horizontal co-ordinate of the selected dispenser for operation of the drive means of the selected dispenser for driving the feeding means of the selected dispenser to discharge the forward article therefrom on to the elevator when the elevator is in the position corresponding to the vertical co-ordinate of the selected dispenser.

45. An article vendor as set forth in claim 44, wherein the dispensers are arranged in tiers one above another with a plurality of dispensers in each tier located in side-by-side relationship in the tier, and wherein, with regard to at least one pair of two side-by-side dispensers in at least one tier, auxiliary means is provided for effecting individual operation of each dispenser of said pair without operating the other, and, alternatively, effecting operation in unison of both dispensers of said pair, so that articles wider than one dispenser may be vended via said pair, said control means controlled by the selector means comprising a control circuit and said auxiliary means comprising switch means in said circuit movable between a first position for effecting said individual operation of each dispenser of said pair and a second position for effecting operation in unison of both dispensers of said pair.

46. An article vendor as set forth in claim 45 wherein, with said switch means in its said second position for said operation in unison of both dispensers of said pair, the selector means for either dispenser of said pair may be operated.

* * * * *